US006352809B1

(12) United States Patent
Nukada et al.

(10) Patent No.: US 6,352,809 B1
(45) Date of Patent: Mar. 5, 2002

(54) PROCESS FOR PRODUCING ELECTROPHOTOGRAPHIC PHOTORECEPTOR, ELECTROPHOTOGRAPHIC PHOTORECEPTOR AND IMAGE-FORMING APPARATUS

(75) Inventors: Katsumi Nukada; Wataru Yamada; Kazuhiro Koseki; Tomozumi Uesaka, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/635,495

(22) Filed: Aug. 9, 2000

(30) Foreign Application Priority Data

Sep. 10, 1999 (JP) ..... 11-257784

(51) Int. Cl.[7] ..... G03G 5/00; G03G 15/02

(52) U.S. Cl. ..... 430/127; 430/132; 430/133; 430/134; 430/135; 430/58.2; 430/58.7

(58) Field of Search ..... 430/127, 132, 430/133, 134, 135, 58.2, 58.7

(56) References Cited

U.S. PATENT DOCUMENTS 5,116,703 A 5/1992 Badesha et al. ..... 430/59
6,143,452 A * 11/2000 Sakimura et al. ..... 430/58.2

FOREIGN PATENT DOCUMENTS

JP B2-2575536 10/1996
JP 9-188746 7/1997
JP A-9-190004 7/1997
JP B2-2721106 11/1997
JP A-10-95787 4/1998

OTHER PUBLICATIONS

D.S. Weiss etal., Analysis of Electrostatic Latent Image Blurring Caused by Photoreceptor Surface Treatments, Proceedings of IS&T's Eleventh International Congress on Advances in Non–Impact Printing Technologies, pp. 57–59.

* cited by examiner

*Primary Examiner*—Mark Chapman
(74) *Attorney, Agent, or Firm*—Oliff & Berridge, PLC

(57) ABSTRACT

A process for producing an electrophotographic photoreceptor, which includes contacting a solution containing at least one of optically functional organosilicon compounds represented by formula (I)

$$F—[D—A]_b \quad (I)$$

with a solid catalyst for reaction, then separating the solid catalyst to form an optically functional coating solution, and coating and curing the optically functional coating solution to form a cured film, an electrophotographic photoreceptor having at least one layer made of the cured film produced by this process, and an image-forming apparatus having the same. The process can produce an electrophotographic photoreceptor having excellent mechanical strengths and a long life stably on an industrial scale over a long period of time by using the stable coating solution having a long pot life, the electrophotographic photoreceptor is excellent in stability and mechanical strengths and has a long life, and the image-forming apparatus has an excellent stability and a long life.

10 Claims, 2 Drawing Sheets

PROCESS FOR PRODUCING ELECTROPHOTOGRAPHIC PHOTORECEPTOR, ELECTROPHOTOGRAPHIC PHOTORECEPTOR AND IMAGE-FORMING APPARATUS

FIELD OF THE INVENTION

The present invention relates to a process for producing an electrophotographic photoreceptor using an optically functional coating solution, an electrophotographic photoreceptor and an image-forming apparatus.

DESCRIPTION OF THE RELATED ART

In recent years, optically functional organic materials have attracted much interest in electrophotographic photoreceptors, organic electroluminescence elements, memory elements and wavelength conversion elements in view of the productivity, the ease of material designing and the safety. They have been put to practical use upon making various improvements. From the aspects of stabilization of organic electronic devices and prolongation of their life, for example, materials that do not cause the change in morphology of films owing to Joule heat generated have been required for organic electroluminescence elements. Further, materials having not only a chemical stability to ozone or $NO_x$ but also a stability to physical stresses such as heat and mechanical forces have been required for electrophotographic photoreceptors. For example, an electrophotographic photoreceptor has been described in detail.

With respect to an electrophotographic photoreceptor, a so-called functionally separated (laminated) structure in which a charge-generating layer and a charge transfer layer are separated has been designed in view of a photoreceptivity and a stability, and it has been put to practical use. The electrophotographic photoreceptor of this structure has two layers, a layer to which a charge-generating material is adhered with an appropriate resin as a binder and a layer obtained by dispersing or dissolving a charge transfer material thereon in a binder resin. The layer containing the charge transfer material contains a hole transfer material in many cases. A thermoplastic resin such as a polycarbonate resin, a polyester resin, an acrylic resin or a polystyrene resin and a thermosetting resin such as a polyurethane resin or an epoxy resin have been studied as the binder. In this case, the surface of the charge transfer layer has to be negatively charged by corona charge or biased-roller charge. There are problems that photoreceptor characteristics are decreased from various causes such as deterioration of a resin with ozone generated at this time, wear by electric shock due to discharge in the surface of the photoreceptor, decrease in photoreceptivity, decrease in chargeability and a mechanical destruction due to abrasion in the subsequent toner development, transfer onto paper and cleaning.

Various studies have been made to cope with these problems. For example, a polysiloxane resin is used as a copolymerizable component or blended with another resin. Specific examples thereof include the use of a thermosetting resin containing a polysiloxane resin in a charge transfer layer (Japanese Patent Laid-Open No. 238062/1986), a protecting layer containing a polysiloxane resin (Japanese Patent Laid-Open No. 108260/1987), a protecting layer obtained by dispersing a thermosetting polysiloxane resin in silica gel, a urethane resin or a fluororesin (Japanese Patent Laid-Open No. 346356/1992), and the use of a resin obtained by dispersing a thermosetting polysiloxane resin in a thermoplastic resin as a binder resin of a protecting layer or a charge transfer material (Japanese Patent Laid-Open No. 273252/1992). The increase in performance, the prolongation of life and the improvement of the cleaning property on the photoreceptor have been studied upon using characteristics of the polysiloxane.

Although the polysiloxane has characteristics that are not found in other resins, such as a transparency, a resistance to insulation breakdown, a light stability and a low surface energy, a compatibility with organic compounds is extremely poor. For this reason, it has not been singly used as a resin constituting a charge transfer material, but has been used for improving a resin constituting a charge transfer material through copolymerization or blending. For the polysiloxane resin alone to be used as a binder constituting a charge transfer layer, there is a need to find a charge transfer material soluble in a polysiloxane resin. To this end, various studies have been made. Examples thereof include the use of a resin in which a charge transfer agent having an unsaturated bond is directly bound to a polysiloxane such as poly(hydrogenmethylsiloxane) through hydrosilylation as a binder resin of a protecting layer or a charge transfer material (Japanese Patent Laid-Open No. 319353/1996), the use of an inorganic thin film formed by plasma CVD as a protecting layer (Japanese Patent Laid-Open No. 333881/1995), the use of a thin film formed by the sol-gel method as a protecting layer (Proceedings of IS & T's Eleventh International Congress on Advances in Non-Impact Printing Technologies, pp. 57 to 59(1995)), and the use of an organosilicon-modified hole-transferring compound in which silicon having a hydrolyzable group is directly introduced in a charge transfer agent as an electrophotographic photoreceptor (Japanese Patent Laid-Open No. 190004/1997). Of these, the products disclosed in Proceedings of IS & T's Eleventh International Congress on Advances in Non-Impact Printing Technologies, pp. 57 to 59, U.S. Pat. No. 2,575,536 and Japanese Patent Laid-Open No. 190004/1997 have drawn high attention because the siloxane forms a three-dimensional network to give a strong film whereby mechanical strengths are greatly improved.

Nevertheless, in Proceedings of IS & T's Eleventh International Congress on Advances in Non-Impact Printing Technologies, pp. 57 to 59, a specific structure of a compound used is not described at all. Further, Japanese Patent Laid-Open No. 190004/1997 discloses a method in which an unsaturated aliphatic group bound or newly bound to an aromatic group constituting an organosilicon-modified hole-transferring compound and a silane having hydrogen and a hydrolyzable group as a substituent of a silicon atom are linked by a hydrosilylation reaction in the presence of a catalyst made of a platinum compound. However, in this reaction, an isomer different in a bonding position of silicon is formed, and a reductant in which an unsaturated aliphatic group is reduced is easily formed. Thus, as is clear from a spectrum of Japanese Patent Laid-Open No. 190004/1997, a mixture of plural compounds tends to be provided. When this reductant is used as a charge transfer layer, no siloxane linkage is formed, and strengths of a film are decreased. Further, when column chromatography is conducted for purification of this, the yield is notably reduced owing to the decomposition and the reaction of the organosilicon-modified hole-transferring compound. Moreover, U.S. Pat. No. 2575536 discloses specific compounds. It is, however, generally known that characteristics of an electrophotographic photoreceptor are greatly influenced by a molecular structure such as a basic skeleton of compounds used or a polarity of a bonding chain, and the compounds disclosed are still unsatisfactory.

Meanwhile, electron-transferring materials have been assiduously studied in the field of electrophotographic photoreceptors. For example, trinitrofluorenone described in Japanese Patent Publication No. 10496/1975, dicyanomethylenefluorenone derivatives described in Japanese Patent Laid-Open No. 143764/1986, anthraquinone derivatives described in Japanese Patent Laid-Open No. 225151/1986, thiopyrane derivatives described in Japanese Patent Laid-Open No. 222477/1985, fluorenone derivatives described in Japanese Patent Laid-Open Nos. 279582/1993, 233134/1995 and 258189/1995, benzotiazole or benzoxazole derivatives described in Japanese Patent Laid-Open Nos. 245601/1996, 283249/1996, 301858/1996 and 286402/1996, benzoquinone derivatives described in Japanese Patent Laid-Open No. 15878/1996, diphenoquinone derivatives described in *Denshishashin Gakkaishi*, vol. 30, No. 3, 266 (1991), imide compound derivatives described in Japanese Patent Laid-Open Nos. 25136/1993, 25174/1993, 117274/1993, 125043/1993 and 132464/1993, and an electron-transferring polymer obtained by introducing an electron-transferring group into a polymer as described in Japanese Patent Laid-Open Nos. 12153/1977 and 12154/1977 and Macromolecules, 22, 2266 (1989) are disclosed. However, the main aim of these materials is to improve a low solubility in an organic solvent or a low compatibility with a binder polymer that is a substantial defect of an electron-transferring material.

Further, in an electrophotographic photoreceptor, an undercoat layer or an intermediate layer is generally interposed to improve an adhesion between a photoreceptive layer and a substrate and a coatability of a photoreceptive layer, to protect a surface of a substrate, to cover a defect of a substrate, to protect a photoreceptive layer from electrical breakdown and to improve a carrier injecting property of a photoreceptive layer.

In case of a positively charged electrophotographic photoreceptor, an electron-generating material is generally used in an uppermost surface layer. Especially in case of a positively charged electrophotographic photoreceptor in which a charge-generating layer is formed on a hole-transferring charge transfer layer, a surface-protecting layer is formed to offset low mechanical strengths of a charge-generating layer.

In the undercoat layer or the surface-protecting layer of the positively charged electrophotographic photoreceptor, it is advisable to basically use an electron-transferring material. For example, Japanese Patent Publication No. 35551/1986 and Japanese Patent Laid-Open No. 160147/1984 describe that an undercoat layer contains an electron-accepting material.

When an electron-transferring material is used for this purpose in, for example, an undercoat layer, this material is dissolved in a coating solvent when forming the undercoat layer. When a photoreceptive layer is further formed on the undercoat layer through coating, the material has to be insoluble in the coating solvent of an upper layer.

However, it is difficult to attain the same with this material. There are problems that the electron-transferring material is dissolved in coating of the upper layer to cause delamination or cracking of the undercoat layer and no satisfactory electron transferability can be retained owing to dissolution.

Further, when the electron-transferring material is used as a surface-protecting layer, it is advisable that a film is as thin as possible for retaining electrical characteristics. However, no satisfactory strengths are obtained with the material dispersed in a binder polymer, and it is impossible to reduce a thickness of a film. Accordingly, there are problems that a residual potential is generated and a surface potential is increased in cycles.

Further, in order to improve this, Japanese Patent Publication No. 86694/1995 discloses that a condensed layer of an alkoxysilane compound having an electron-accepting atom or an electron attractive group is used in a surface-protecting layer. The surface-protecting layer obtained by this method is excellent in strengths, but has a low electron transferability. Thus, it still suffers problems that a residual potential is generated and a surface potential is increased in cycles.

For solving these problems, we developed novel materials disclosed in Japanese Patent Laid-Open No. 95787/1998, and indicated that these materials have excellent characteristics.

It was, however, found that even though using an optically functional organosilicon compound, like these materials, in which silicon having a hydrolyzable group is directly introduced to allow hybridization of organic and inorganic materials through chemical bonding, phase separation occurs before a curing reaction only by mixing and coating the same in the formation of a cured film so that a uniform film is not obtained in many cases.

Accordingly, as disclosed in, for example, U. S. Pat. No. 5,116,703 and Japanese Patent Laid-Open No. 188764/1997, a method is used in which organic material and inorganic material precursors are previously co-hydrolyzed and partially reacted and the resulting product is then coated. The co-hydrolysis is conducted by dissolving these materials in a soluble solvent, adding an appropriate amount of water, and adding an acid catalyst such as acetic acid, hydrochloric acid, sulfuric acid, phosphoric acid or nitric acid or a transesterification catalyst such as alkoxides of various metals. This method is quite effective for obtaining a uniform film.

Nevertheless, these catalysts activate not only the hydrolysis but also a crosslinking reaction after the hydrolysis, and the reaction proceeds even at room temperature. Thus, gelation occurs, and a so-called pot life is short.

For solving this point, U.S. Pat. No. 2,721,106 indicates a method in which co-hydrolysis is conducted using a catalyst insoluble in a system and a polysiloxane is separated from the system after formation. In comparison with the use of an ordinary liquid catalyst as a uniform solution by being dissolved in a system, the reaction rate in this method is low, and the reaction proceeds only on the surface of the catalyst. Therefore, it is generally used by heating.

Accordingly, unless a material similar in reactivity and compatibility is used, only the reaction of a highly reactive material might proceed to cause phase separation or crosslinking. U.S. Pat. No. 2,721,106 discloses only a material which contains an organic component with a low molecular weight and which can easily form a relatively uniform hybrid film of organic and inorganic components. It does not disclose a material effectively used in a material system in which an organic component has a molecular weight of more than 200, more than 300 or more than 400 and is greatly different in properties from an inorganic component. Thus, the development of a process for producing an electrophotographic photoreceptor upon using excellent characteristics of a material as disclosed in Japanese Patent Application Nos. 351809/1997 and 187931/1996 and Japanese Patent Laid-Open No. 95787/1998 has been in demand.

SUMMARY OF THE INVENTION

The present invention provides a process for producing an electrophotographic photoreceptor in which an electrophotographic photoreceptor excellent in photoelectric characteristics and mechanical strengths and having a long life can stably be obtained on an industrial scale over a long period of time using a stable coating solution having a long pot life.

The present invention also provides an electrophotographic photoreceptor excellent in stability, photoelectric characteristics and mechanical strengths and having a long life.

The present invention yet provides an image-forming apparatus excellent in stability and having a long life.

The first aspect of the present invention is a process for producing an electrophotographic photoreceptor, which includes contacting a solution containing at least one of optically functional organosilicon compounds represented by formula (I)

$$F—[D—A]_b \quad (I)$$

wherein

F represents an organic group derived from optically functional compounds,

D represents a flexible subunit,

A represents a substituted silicon group having a hydrolyzable group represented by $—Si(R_1)_{(3-a)}Q_a$ in which $R_1$ represents hydrogen, an alkyl group or a substituted or unsubstituted aryl group, Q represents a hydrolyzable group, and a represents an integer of 1 to 3, and b represents an integer of 1 to 4 with a solid catalyst for reaction, then separating the solid catalyst to form an optically functional coating solution, and coating and curing the optically functional coating solution to form a layer made of a cured film.

The organic group F derived from the optically functional compounds may be a hole-transportable group or an electron-transportable group.

The organic group F derived from the optically functional compounds may be a group represented by formula (II), (III-1) or (III-2)

(II)

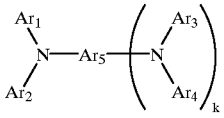

wherein $Ar^1$ to $Ar^4$, independently from each other, represent a substituted or unsubstituted aryl group, $Ar^5$ represents a substituted or unsubstituted aryl or arylene group, provided at least one to four of $Ar^1$ to $Ar^5$ have a binding site capable of being bound to a bonding group represented by —D—A in formula (I), and k represents 0or 1.

(III-1)

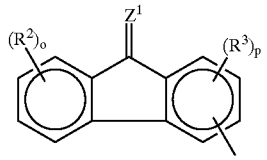

(III-2)

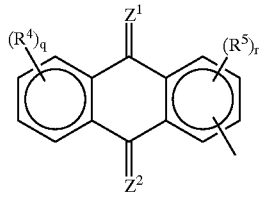

wherein $R^2$ to $R^5$, independently from each other, represent hydrogen, a halogen, a nitro group or a cyano group, $Z^1$ and $Z^2$, independently from each other, represent =), $=C(CN)_2$, $=C(CO_2R^a)$, =N—CN or $=N—Ar^a$ in which $R^a$ represents an alkyl group having 1 to 10 carbon atoms or a substituted or unsubstituted aryl group having 1 to 10 carbon atoms, and $Ar^a$ represents a substituted or unsubstituted aryl group, and o to r, independently from each other, represent 0, 1 or 2.

In the aforementioned process, at least one of the compounds having the group capable of being bound to the optically functional organosilicon compounds represented by formula (I) may be added to the optically functional coating solution before being contacted with the solid catalyst for reaction.

Also, at least one of the compounds having the group capable of being bound to the optically functional organosilicon compounds represented by formula (I) may be added to the optically functional coating solution after separating the solid catalyst.

In the aforementioned process, at least one curing catalyst may be added to the optically functional coating solution.

The second aspect of the present invention is an electrophotographic photoreceptor having at least one layer made of the cured film formed by the aforementioned process for producing the electrophotographic photoreceptor.

The layer made of the cured film may be the uppermost surface layer.

The third aspect of the present invention is an image-forming apparatus having at least an electrophotographic photoreceptor and its charging unit, the electrophotographic photoreceptor being the aforementioned electrophotographic photoreceptor.

The charging unit may be a contact-type charging system such as biased roller type charging system.

According to the process for producing the electrophotographic photoreceptor in the invention, the coating solution having the long pot life and the improved stability is used upon separating the solid catalyst, whereby the electrophotographic photoreceptor can stably be produced on an industrial scale over a long period of time. Further, the use of the optically functional organosilicon compounds represented by formula (I) makes it possible to form the siloxane-type crosslinked cured film and produce the electrophotographic photoreceptor having high photoelectric characteristics and also strong mechanical strengths.

In the electrophotographic photoreceptor of the invention, the coating solution having the long pot life and the improved stability is used upon separating the solid catalyst, and the optically functional organosilicon compounds represented by formula (I) are used, with the result that the siloxane-type crosslinked cured film can be formed and high mechanical strengths are realized while having the excellent stability and the high photoelectric characteristics.

The image-forming apparatus of the invention is excellent in stability and has a long life because the electrophotographic photoreceptor of the invention is mounted thereon.

BRIEF DESCRIPTION OF THE DRAWINGS

Preferred embodiments of the invention will be described in detail based on the following figures, wherein.

DESCRIPTION OF THE PREFERRED EMBODIMENTS

Figure 1:
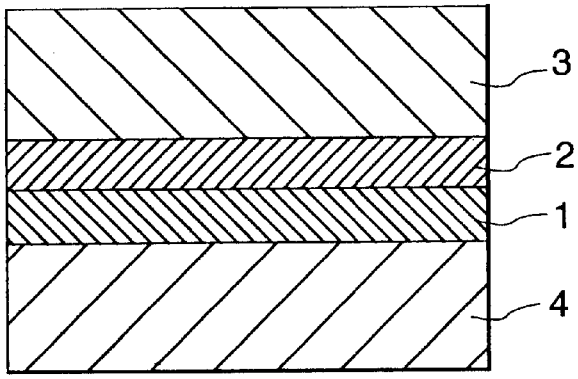
FIG. 1 is an enlarged sectional view showing an example of an electrophotographic photoreceptor of the invention.

The invention is described in detail below.

The process for producing the electrophotographic photoreceptor, which includes contacting a solution containing at least one of optically functional organosilicon compounds represented by the following formula (I) with a solid catalyst for reaction, then separating the solid catalyst to produce an optically functional coating solution (which is sometimes referred to as a step of producing an optically functional coating solution), and coating and curing the optically functional coating solution to form a layer made of a cured film (which is sometimes referred to as a step of forming a cured film).

The step of producing the optically functional coating solution is described in detail.

The optically functional coating solution can be produced by contacting a solution containing at least one of the optically functional organosilicon compounds (which is sometimes referred to as an optically functional organosilicon compound-containing solution) represented by the following formula (I) with a solid catalyst for reaction and then separating the solid catalyst.

$$F—[D—A]_b \quad (I)$$

wherein

F represents an organic group derived from optically functional compounds,

D represents a flexible subunit,

A represents a substituted silicon group having a hydrolyzable group represented by $—Si(R_1)_{(3-a)}Q_a$ in which $R_1$ represents hydrogen, an alkyl group or a substituted or unsubstituted aryl group, Q represents a hydrolyzable group (for example, an alkoxy group, a methyl ethyl ketoxime group, a diethylamino group, an acetoxy group, a propenoxy group or a halogen), and a represents an integer of 1 to 3, and b represents an integer of 1 to 4.

In formula (I), A represents a substituted silicon group having a hydrolyzable group represented by $—Si(R_1)_{(3-a)}Q_a$. This substituted silicon group has such a function that the Si groups mutually allow a crosslinking reaction to form a three-dimensional Si—O—Si linkage, namely, an inorganic vitreous network.

In formula (I), D represents a flexible subunit. Specifically, this is to directly bind F for imparting photoelectric characteristics to the three-dimensional inorganic vitreous network. Thus, D acts to impart an appropriate flexibility to the inorganic vitreous network which is hard and brittle and to improve strengths as a film.

In formula (I), specific examples of D can include divalent hydrocarbon groups such as $—C_nH_{2n}—$, $—C_nH_{(2n-2)}—$ and $—C_nH_{(2n-4)}—$ in which n represents an integer of 1 to 15, —COO—, —S—, —O—, $—CH_2—C_6H_4—$, —N=CH—, $—(C_6H_4)—(C_6H_4)—$, a combination of these groups, and these groups having a substituent.

In formula (I), b is preferably 2 or more. When b is 2 or more, two or more Si atoms are contained in the optically functional organosilicon compounds represented by formula (I), whereby the inorganic vitreous network is easily formed and mechanical strengths are improved.

In formula (I), F represents an organic group derived from the optically functional compounds. Specifically, it is a group having an optically functional which group absorbs a light energy to show a physical or physicochemical change (for example, photoisomerization, photochromism, photoionization, light-emission, non-linear optical effect or photoelectric chemical effect). As the organic group derived from the optically functional compounds, a group having an aromatic ring in a molecule is preferable because a light energy is greatly absorbed and a light stability is excellent.

In formula (I), F is preferably a group having a hole transportability or an electron transportability. Specific examples of the group having the electron transportability include organic groups derived from a quinone compound, a fluorenone compound, a xanthone compound, a benzophenone compound, a cyanovinyl compound and an ethylenic compound. Specific examples of the group having the hole transportability include organic groups derived from a triarylamine compound, a benzidine compound, an arylalkane compound, an aryl-substituted ethylenic compound, a stilbene compound, an anthracene compound and a hydrazone compound. Examples of the group having light carrier generating properties include organic groups derived from a phthalocyanine compound and a porphyrin compound.

In formula (I), it is especially preferable that F is an organic group represented by the following formula (II), (III-1) or (III-2). The organic group represented by the following formula (II) is an organic group having a hole transportability. It is especially preferable because of the excellent hole transporting property and the excellent mechanical properties. The organic groups represented by the following formulas (III-1) and (III-2) are groups having the electron transportability. They are especially preferable because of the excellent electron transportability and the excellent mechanical properties.

(II)

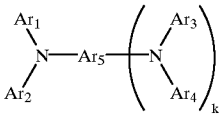

wherein $Ar^1$ to $Ar^4$, independently from each other, represent a substituted or unsubstituted aryl group, $Ar^5$ represents a substituted or unsubstituted aryl or arylene group, provided at least one to four of $Ar^1$ to $Ar^5$ have a binding site capable of being bound to a bonding group represented by —D—A in formula (I), and k represents 0 or 1.

In formula (II), preferable examples of $Ar^1$ to $Ar^4$ are those listed in the following structure group 1.

Structure Group 1

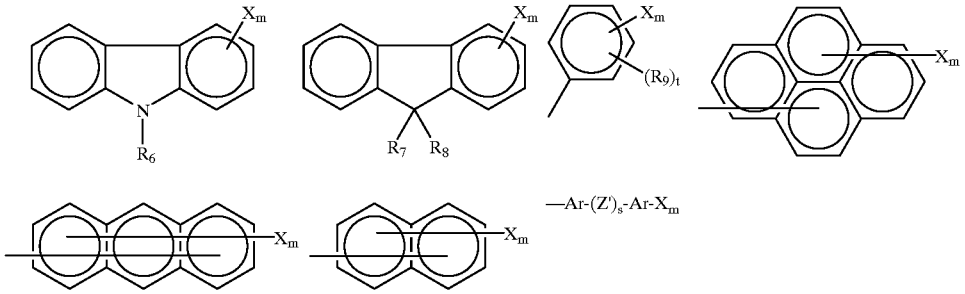

In the structure group 1, preferable examples of Ar are those listed in the following structure group 2.

Structure Group 2

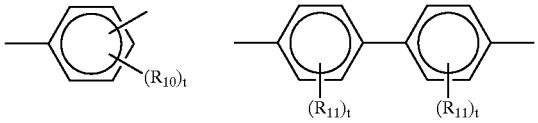

In the structure group 1, preferable examples of Z' are those listed in the following structure group 3.

Structure Group 3

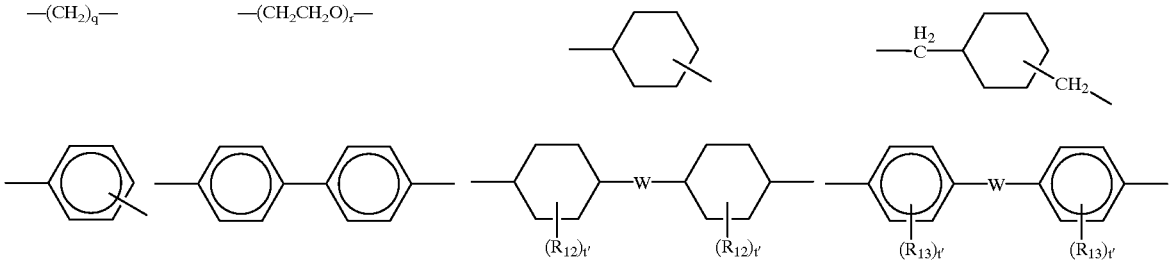

In the structure group 3, preferable examples of W are those listed in the following structure group 4.

Structure Group 4

| | | | | |
|---|---|---|---|---|
| —$CH_2$— | —$C(CH_3)_2$— | —O— | —S— | —$C(CF_3)_2$— |
| —$Si(CH_3)_2$— | 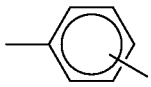 | 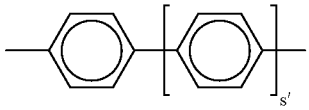 | 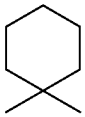 | |

In the structure groups 1 to 4, $R_6$'s, independently from each other, represent hydrogen, an alkyl group having 1 to 4 carbon atoms, a phenyl group substituted with an alkyl group having 1 to 4 carbon atoms or an alkoxy group having 1 to 4 carbon atoms, an unsubstituted phenyl group or an aralkyl group having 7 to 10 carbon atoms. $R_7$ to $R_{13}$, independently from each other, represent hydrogen, an alkyl group having 1 to 4 carbon atoms, an alkoxy group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms or a halogen. m and s, independently from each other, represent 0 or 1. q and r, independently from each other, represent an integer of 1 to 10. t and t', independently from each other, represent an integer of 1 to 3. s' represents an integer of 0 to 3. X is the same as —D—A in formula (I).

In formula (II), specific examples of the structure of $Ar_5$ include a structure of $Ar_1$ to $Ar_4$ with m=1 in case of k=O, and a structure of $Ar_1$ to $Ar_4$ with m=0 in case of k=1.

(III-1)

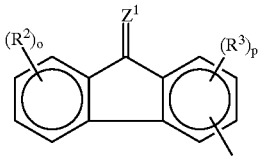

-continued (III-2)

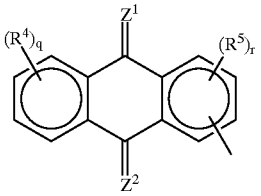

wherein $R^2$ to $R^5$, independently from each other, represent hydrogen, a halogen, a nitro group or a cyano group, $Z^1$ and $Z^2$, independently from each other, represent =O, $=C(CN)_2$, $=C(CO_2R^a)$, =N—CN or $=N—Ar^a$ in which $R^a$ represents an alkyl group having 1 to 10 carbon atoms or a substituted or unsubstituted aryl group having 1 to 10 carbon atoms, and $Ar^a$ represents a substituted or unsubstituted aryl group such as a phenyl group, a tolyl group or a biphenyl group, and o to r, independently from each other, represent 0, 1 or 2.

Specific examples of the compound in which the organic group in formula (I) is represented by formmula (II) are shown in Tables 1 to 55 below. However, these specific examples are not critical in the invention. Incidentally, numbers of Example Compounds indicated in Examples to be described later are those in which "II-" is added to compound numbers in these tables. For instance, when the compound number is "12",the Example Compound number is "(II-12)".

In Tables 1 to 55, k and $Ar^1$ to $Ar^5$ correspond to k and $Ar^1$ to $Ar^5$ in formula (II) and X corresponds to —D—A in formula (I).

In table 1 to 55, Me represents a —$CH_3$, Et represents —$C_2H_5$, and i-Pr represents isopropyl group.

TABLE 1
| COMPOUND | k | $Ar^1$ | $Ar^2$ | $Ar^3$ | $Ar^4$ | $Ar^5$ | X |
|---|---|---|---|---|---|---|---|
| 1 | 0 | 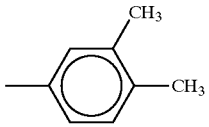 | 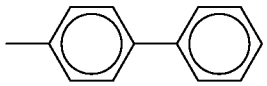 | — | — | 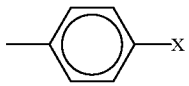 | —CH═NCH$_2$— —Si(OMe)$_2$Me |
| 2 | 0 | 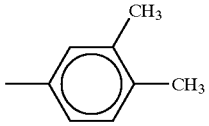 | 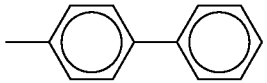 | — | — | 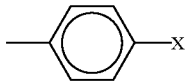 | —CH═N(CH$_2$)$_3$ —Si(OMe)$_3$ |
| 3 | 0 | 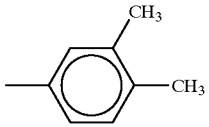 | 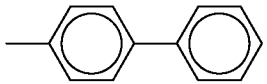 | — | — | 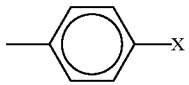 | —CH═N(CH$_2$)$_3$— —Si(OEt)$_3$ |
| 4 | 0 | 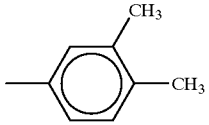 | 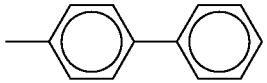 | — | — | 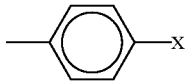 | 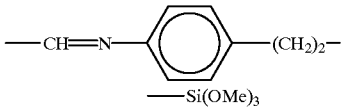 |
| 5 | 0 | 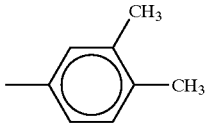 | 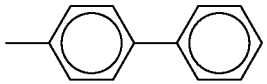 | — | — | 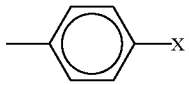 | 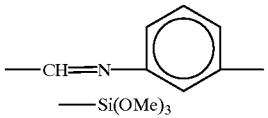 |

TABLE 2
| COMPOUND | k | $Ar^1$ | $Ar^2$ | $Ar^3$ | $Ar^4$ | $Ar^5$ | X |
|---|---|---|---|---|---|---|---|
| 6 | 0 | 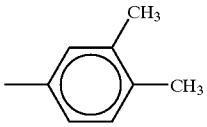 | 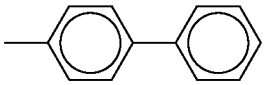 | — | — | 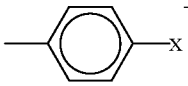 | —O(CH$_2$)$_3$Si(OMe)$_3$ |
| 7 | 0 | 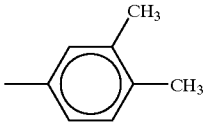 | 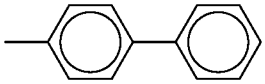 | — | — | 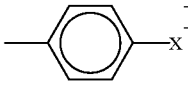 | —O(CH$_2$)$_3$—<br>—SiMe(OMe)$_2$ |
| 8 | 0 | 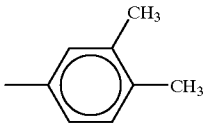 | 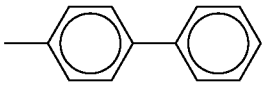 | — | — | 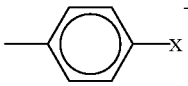 | —O(CH$_2$)$_3$Si(OEt)$_3$ |
| 9 | 0 | 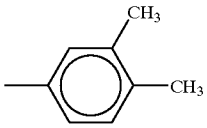 | 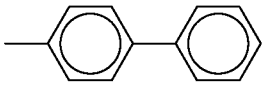 | — | — | 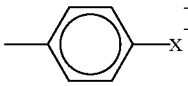 | —CH$_2$O(CH$_2$)$_3$—<br>—Si(OMe)$_3$ |
| 10 | 0 | 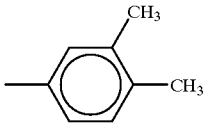 | 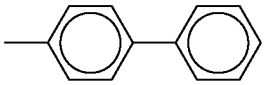 | — | — | 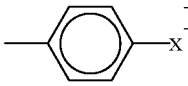 | —(CH$_2$)$_3$O(CH$_2$)$_3$—<br>—Si(OMe)$_3$ |
35
TABLE 3
| COM-POUND | k | $Ar^1$ | $Ar^2$ | $Ar^3$ | $Ar^4$ | $Ar^5$ | X |
|---|---|---|---|---|---|---|---|
| 11 | 0 | 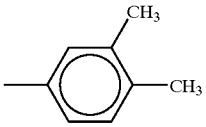 | 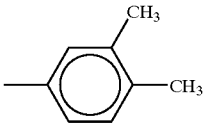 | — | — | 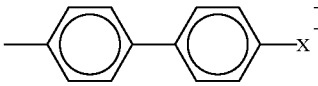 | —COO(CH$_2$)$_3$—<br>—Si(OMe)$_3$ |
| 12 | 0 | 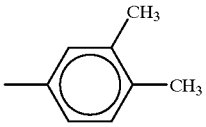 | 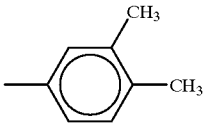 | — | — | 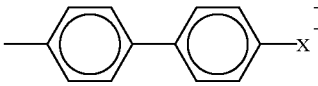 | —CH$_2$COO(CH$_2$)$_3$—<br>—Si(OMe)$_3$ |
| 13 | 0 | 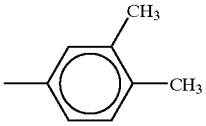 | 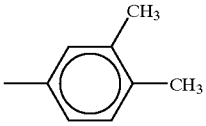 | — | — | 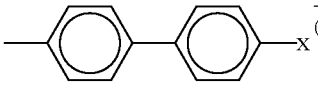 | —(CH$_2$)$_2$COO<br>(CH$_2$)$_3$Si(OMe)$_3$ |
| 14 | 0 | 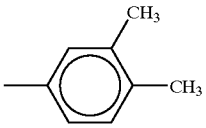 | 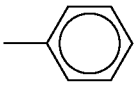 | — | — | 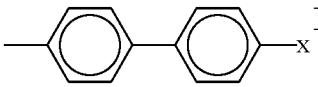 | —COO(CH$_2$)$_3$—<br>—Si(OMe)$_3$ |

TABLE 3-continued
| COM-POUND | k | $Ar^1$ | $Ar^2$ | $Ar^3$ | $Ar^4$ | $Ar^5$ | X |
|---|---|---|---|---|---|---|---|
| 15 | 0 | 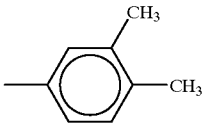 | 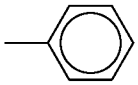 | — | — | 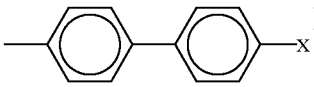 | —$CH_2COO(CH_2)_3$—<br>—$Si(OMe)_3$ |
TABLE 4
| COM-POUND | k | $Ar^1$ | $Ar^2$ | $Ar^3$ | $Ar^4$ | $Ar^5$ | X |
|---|---|---|---|---|---|---|---|
| 16 | 0 | 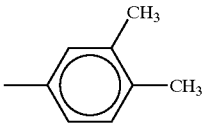 | 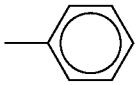 | — | — | 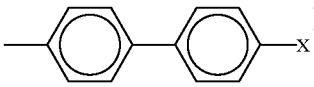 | —$(CH_2)_2COO$—<br>—$(CH_2)_3Si(OMe)_3$ |
| 17 | 0 | 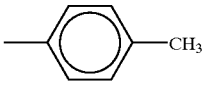 | 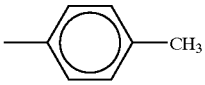 | — | — | 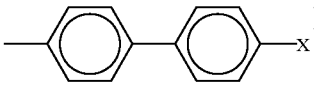 | —$COO(CH_2)_3$—<br>—$Si(OMe)_3$ |
| 18 | 0 | 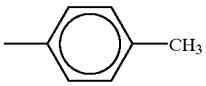 | 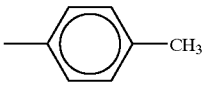 | — | — | 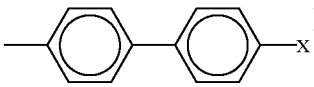 | —$CH_2COO(CH_2)_3$—<br>—$Si(OMe)_3$ |
| 19 | 0 | 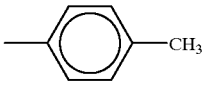 | 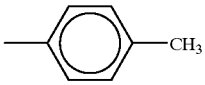 | — | — | 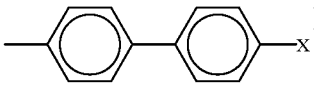 | —$(CH_2)_2COO$—<br>—$(CH_2)_3Si(OMe)_3$ |
| 20 | 0 | 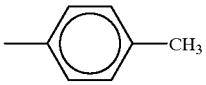 | 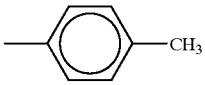 | — | — | 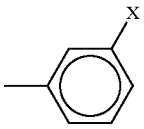 | —$COO(CH_2)_3$—<br>—$Si(OMe)_3$ |
TABLE 5
| COMPOUND | k | $Ar^1$ | $Ar^2$ | $Ar^3$ | $Ar^4$ | $Ar^5$ | X |
|---|---|---|---|---|---|---|---|
| 21 | 0 | 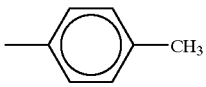 | 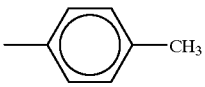 | — | — | 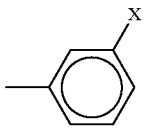 | —$COOCH_2C_6H_4$—<br>—$Si(OMe)_3$ |
| 22 | 0 | 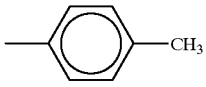 | 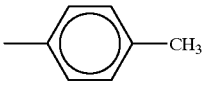 | — | — | 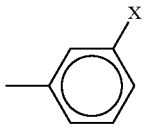 | —$COOCH_2C_6H_4$—<br>—$(CH_2)_3Si(OMe)_3$ |

TABLE 5-continued
| COMPOUND | k | $Ar^1$ | $Ar^2$ | $Ar^3$ | $Ar^4$ | $Ar^5$ | X |
|---|---|---|---|---|---|---|---|
| 23 | 0 | 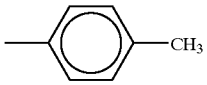 | 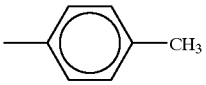 | — | — | 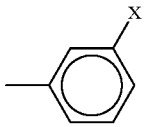 | —$CH_2COO(CH_2)_3$— —$Si(OMe)_3$ |
| 24 | 0 | 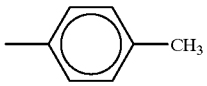 | 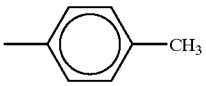 | — | — | 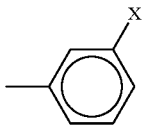 | —$CH_2COOCH_2$— —$C_6H_4Si(OMe)_3$ |
| 25 | 0 | 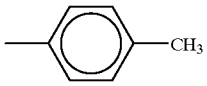 | 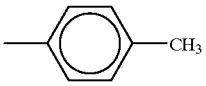 | — | — | 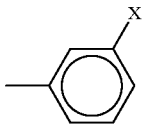 | —$CH_2COO$— —$CH_2C_6H_4(CH_2)_2$— —$Si(OMe)_3$ |
TABLE 6
| COMPOUND | k | $Ar^1$ | $Ar^2$ | $Ar^3$ | $Ar^4$ | $Ar^5$ | X |
|---|---|---|---|---|---|---|---|
| 26 | 0 | 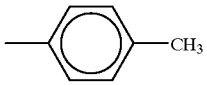 | 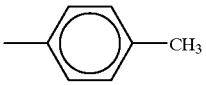 | — | — | 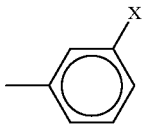 | —$(CH_2)_2COO$— —$(CH_2)_3Si(OMe)_3$ |
| 27 | 0 | 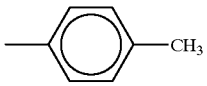 | 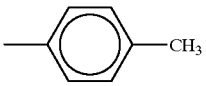 | — | — | 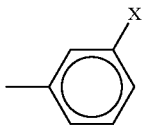 | —$(CH_2)_2COOCH_2$— —$C_6H_4Si(OMe)_3$ |
| 28 | 0 | 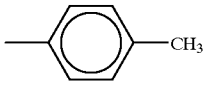 | 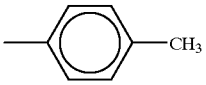 | — | — | 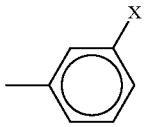 | —$CH_2COO$— —$CH_2C_6H_4(CH_2)_2$— —$Si(OMe)_3$ |
| 29 | 0 | 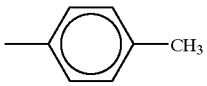 | 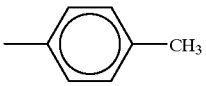 | — | — | 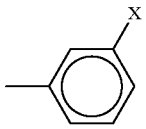 | —$COO(CH_2)_3$— —$Si(OMe)_3$ |
| 30 | 0 | 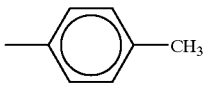 | 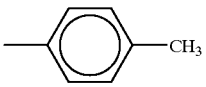 | — | — | 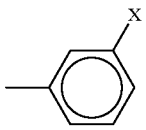 | —$COOCH_2C_6H_4$— —$(CH_2)_2Si(OMe)_3$ |

TABLE 7
| COMPOUND | k | $Ar^1$ | $Ar^2$ | $Ar^3$ | $Ar^4$ |
|---|---|---|---|---|---|
| 31 | 0 | 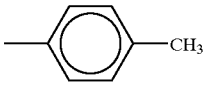 | 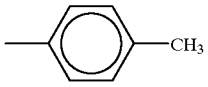 | — | — |
| 32 | 0 | 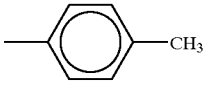 | 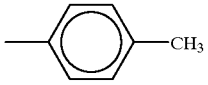 | — | — |
| 33 | 0 | 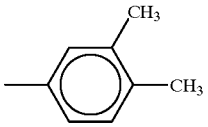 | 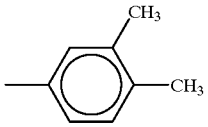 | — | — |
| 34 | 0 | 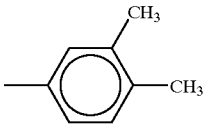 | 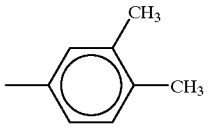 | — | — |
| 35 | 0 | 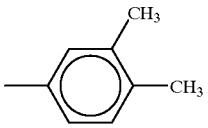 | 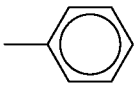 | — | — |
| COMPOUND | $Ar^5$ | X |
|---|---|---|
| 31 | 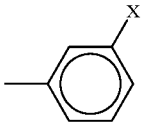 | —$(CH_2)_3$COO—<br>—$(CH_2)_3$Si(OMe)$_3$ |
| 32 | 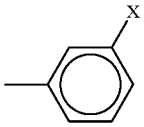 | —$(CH_2)_2$COO—<br>—$CH_2C_6H_4(CH_2)_2$—<br>—Si(OMe)$_3$ |
| 33 | 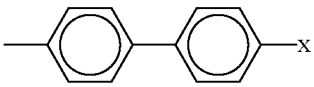 | —COO$(CH_2)_3$—<br>—Si(OMe)$_3$ |
| 34 | 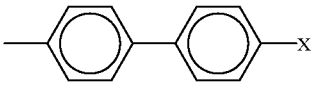 | —$COOCH_2$—<br>—$C_6H_4$Si(OMe)$_3$ |
| 35 | 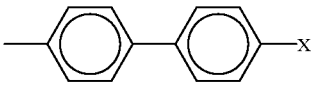 | —COO$(CH_2)_3$—<br>—Si(OMe)$_3$ |

TABLE 8
| COMPOUND | k | $Ar^1$ | $Ar^2$ | $Ar^3$ | $Ar^4$ | $Ar^5$ | X |
|---|---|---|---|---|---|---|---|
| 36 | 0 | 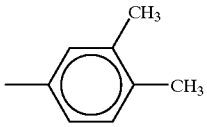 | 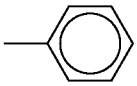 | — | — | 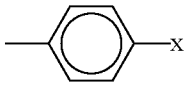 | —COO$(CH_2)_3$— —Si$(OMe)_3$ |
| 37 | 0 | 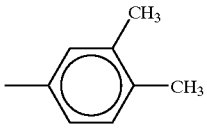 | 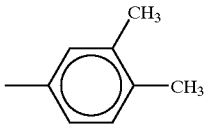 | — | — | 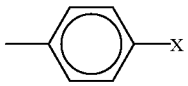 | —COO$(CH_2)_3$— —Si$(OMe)_3$ |
| 38 | 0 | 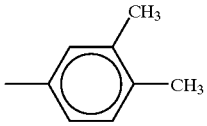 | 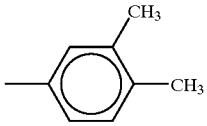 | — | — | 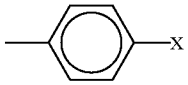 | —$COOCH_2C_6H_4$— —$(CH_2)_2$Si$(OMe)_3$ |
| 39 | 0 | 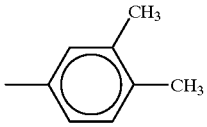 | 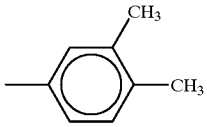 | — | — | 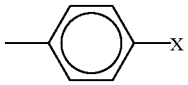 | —$CH_2COO(CH_2)_3$— —Si$(OMe)_3$ |
| 40 | 0 | 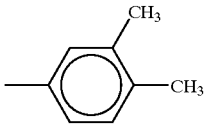 | 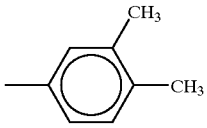 | — | — | 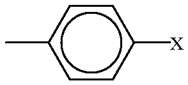 | —$CH_2COO$— —$CH_2C_6H_4(CH_2)_2$— —Si$(OMe)_3$ |
TABLE 9
| COMPOUND | k | $Ar^1$ | $Ar^2$ | $Ar^3$ | $Ar^4$ | $Ar^5$ | X |
|---|---|---|---|---|---|---|---|
| 41 | 0 | 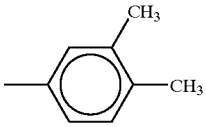 | 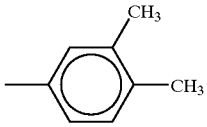 | — | — | 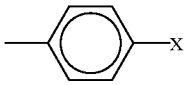 | —$(CH_2)_2COO$— —$(CH_2)_3$Si$(OMe)_3$ |
| 42 | 0 | 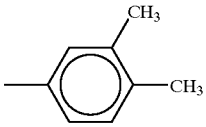 | 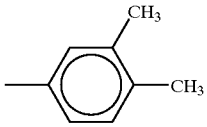 | — | — | 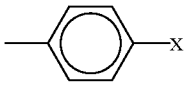 | —$(CH_2)_2COO$— —$CH_2C_6H_4(CH_2)_2$— —Si$(OMe)_3$ |
| 43 | 0 | 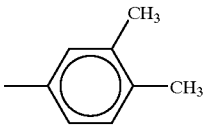 | 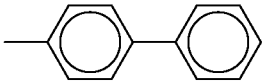 | — | — | 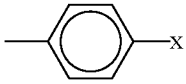 | —COO$(CH_2)_3$— —Si$(OMe)_3$ |
| 44 | 0 | 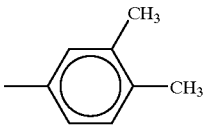 | 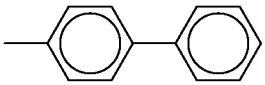 | — | — | 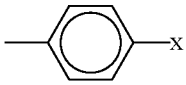 | —$COOCH_2C_6H_4$— —$(CH_2)_2$Si$(OMe)_3$ |

TABLE 9-continued
| COMPOUND | k | $Ar^1$ | $Ar^2$ | $Ar^3$ | $Ar^4$ | $Ar^5$ | X |
|---|---|---|---|---|---|---|---|
| 45 | 0 | 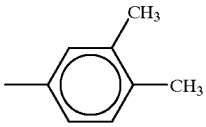 | 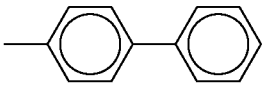 | — | — | 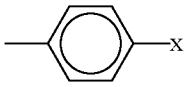 | —$CH_2COO(CH_2)_3$—<br>—$Si(OMe)_3$ |
TABLE 10
| COMPOUND | k | $Ar^1$ | $Ar^2$ | $Ar^3$ | $Ar^4$ | $Ar^5$ | X |
|---|---|---|---|---|---|---|---|
| 46 | 0 | 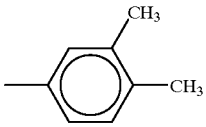 | 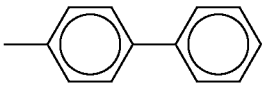 | — | — | 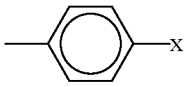 | —$CH_2COO$—<br>—$CH_2C_6H_4(CH_2)_2$—<br>—$Si(OMe)_3$ |
| 47 | 0 | 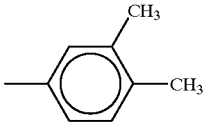 | 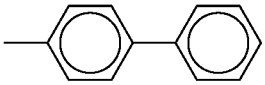 | — | — | 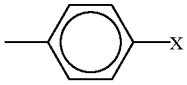 | —$(CH_2)_2COO$—<br>—$(CH_2)_3Si(OMe)_3$ |
| 48 | 0 | 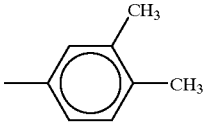 | 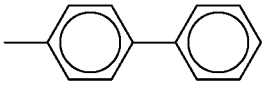 | — | — | 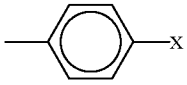 | —$(CH_2)_2COO$—<br>—$CH_2C_6H_4(CH_2)_2$—<br>—$Si(OMe)_3$ |
| 49 | 0 | 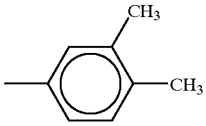 | 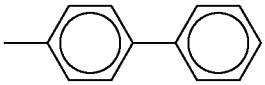 | — | — | 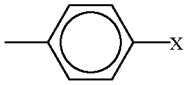 | —CH═CH$Si(OEt)_3$ |
| 50 | 0 | 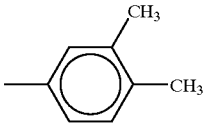 | 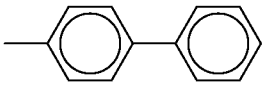 | — | — | 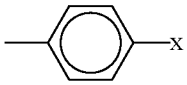 | —CH═$CHCH_2$—<br>—$Si(OEt)_3$ |
TABLE 11
| COMPOUND | k | $Ar^1$ | $Ar^2$ | $Ar^3$ | $Ar^4$ | $Ar^5$ | X |
|---|---|---|---|---|---|---|---|
| 51 | 0 | 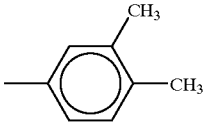 | 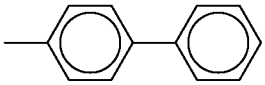 | — | — | 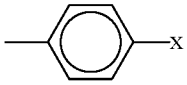 | —CH═$CH(CH_2)_2$—<br>—$Si(OMe)_3$ |
| 52 | 0 | 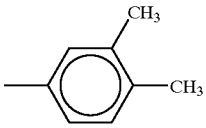 | 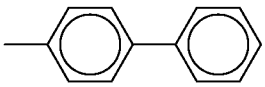 | — | — | 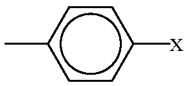 | —CH═$CH(CH_2)_2$—<br>—$SiMe(OMe)_2$ |

TABLE 11-continued
| COMPOUND | k | $Ar^1$ | $Ar^2$ | $Ar^3$ | $Ar^4$ | $Ar^5$ | X |
|---|---|---|---|---|---|---|---|
| 53 | 0 | 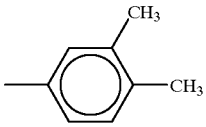 | 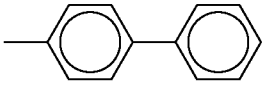 | — | — | 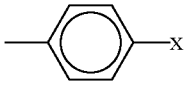 | —CH═CHCH$_2$— —Si(OMe)$_2$Me |
| 54 | 0 | 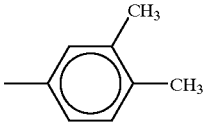 | 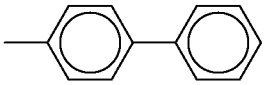 | — | — | 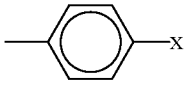 | —CH═CH(CH$_2$)$_2$— —Si(OEt)$_3$ |
| 55 | 0 | 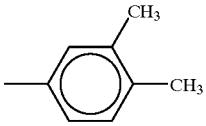 | 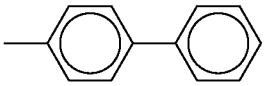 | — | — | 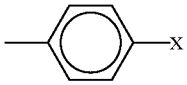 | —CH═CH(CH$_2$)$_{10}$— —Si(OMe)$_3$ |
TABLE 12
| COM-POUND | k | $Ar^1$ | $Ar^2$ | $Ar^3$ | $Ar^4$ | $Ar^5$ | X |
|---|---|---|---|---|---|---|---|
| 56 | 0 | 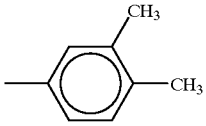 | 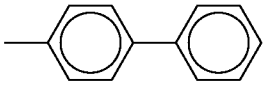 | — | — | 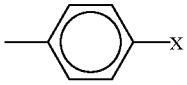 | —CH═CHC$_6$H$_4$— —Si(OMe)$_3$ |
| 57 | 0 | 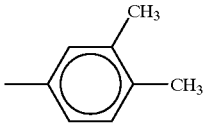 | 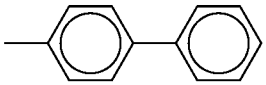 | — | — | 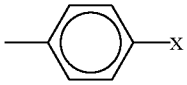 | —CH═CHC$_6$H$_4$— —(CH$_2$)$_2$Si(OMe)$_3$ |
| 58 | 0 | 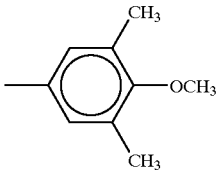 | 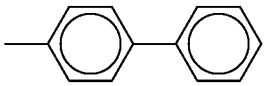 | — | — | 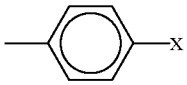 | —CH═CH(CH$_2$)$_2$— —Si(OMe)$_3$ |
| 59 | 0 | 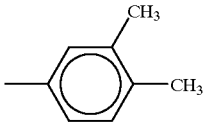 | 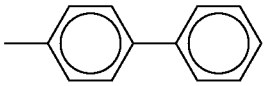 | — | — | 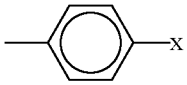 | —(CH$_2$)$_2$Si(OEt)$_3$ |
| 60 | 0 | 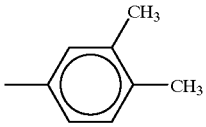 | 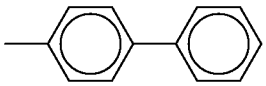 | — | — | 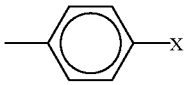 | —(CH$_2$)$_3$Si(OEt)$_3$ |

TABLE 13
| COMPOUND | k | $Ar^1$ | $Ar^2$ | $Ar^3$ | $Ar^4$ | $Ar^5$ | X |
|---|---|---|---|---|---|---|---|
| 61 | 0 | 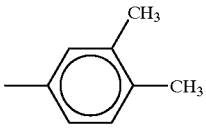 | 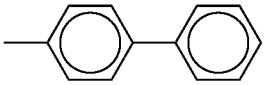 | — | — | 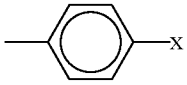 | —$(CH_2)_4Si(OMe)_3$ |
| 62 | 0 | 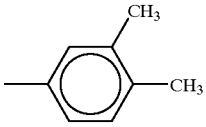 | 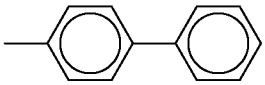 | — | — | 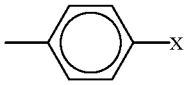 | —$(CH_2)_4$—<br>—$SiMe(OMe)_2$ |
| 63 | 0 | 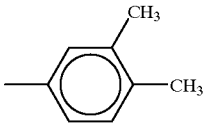 | 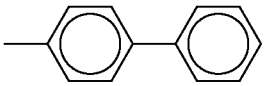 | — | — | 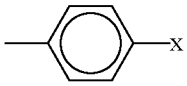 | —$(CH_2)_4$—<br>—$SiMe_2(OMe)$ |
| 64 | 0 | 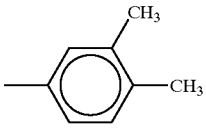 | 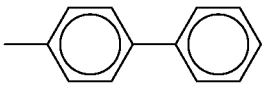 | — | — | 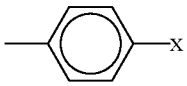 | —$(CH_2)_4Si(OEt)_3$ |
| 65 | 0 | 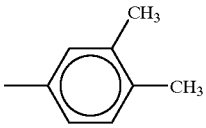 | 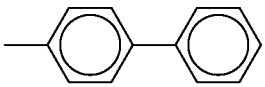 | — | — | 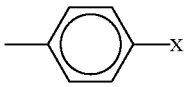 | —$(CH_2)_6SiMe(OEt)_2$ |
TABLE 14
| COMPOUND | k | $Ar^1$ | $Ar^2$ | $Ar^3$ |
|---|---|---|---|---|
| 66 | 0 | 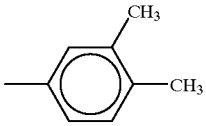 | 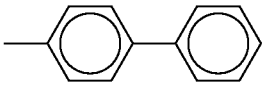 | — |
| 67 | 0 | 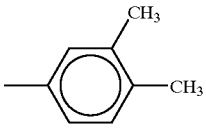 | 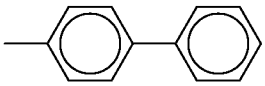 | — |
| 68 | 0 | 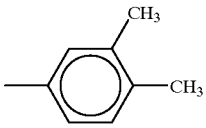 | 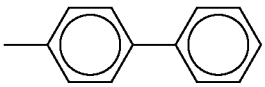 | — |
| 69 | 1 | 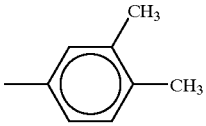 | 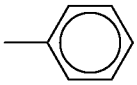 | 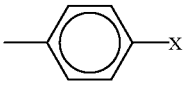 |

TABLE 14-continued
| | | | | |
|---|---|---|---|---|
| 70 | 1 | 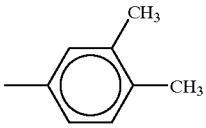 | 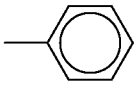 | 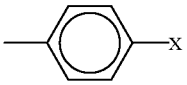 |
| COMPOUND | $Ar^4$ | $Ar^5$ | X |
|---|---|---|---|
| 66 | — | 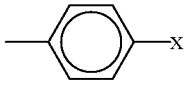 | $—(CH_2)_{12}Si(OMe)_3$ |
| 67 | — | 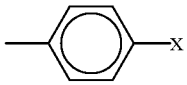 | $—(CH_2)_2C_6H_4—$ $—(CH_2)_2Si(OMe)_3$ |
| 68 | — | 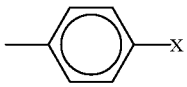 | $—C_2H_4C_4H_6—$ $—Si(OMe)_3$ |
| 69 | 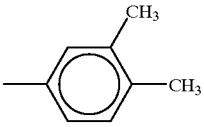 | 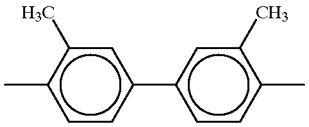 | $—CH{=}N(CH_2)_3—$ $—Si(OMe)_3$ |
| 70 | 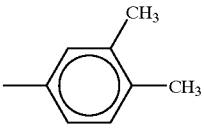 | 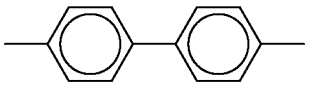 | $—CH{=}N(CH_2)_3—$ $—Si(OMe)_3$ |
TABLE 15
| COMPOUND | k | $Ar^1$ | $Ar^2$ | $Ar^3$ | $Ar^4$ |
|---|---|---|---|---|---|
| 71 | 1 | 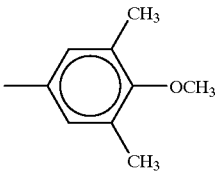 | 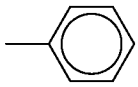 | 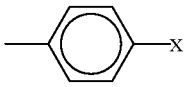 | 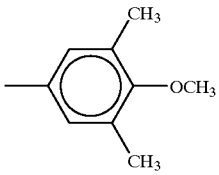 |
| 72 | 1 | 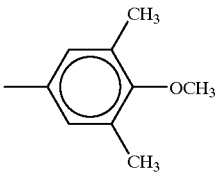 | 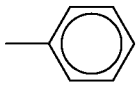 | 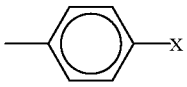 | 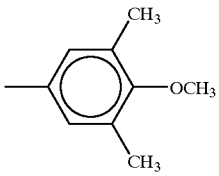 |
| 73 | 1 | 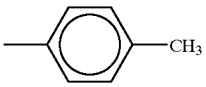 | 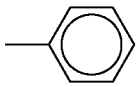 | 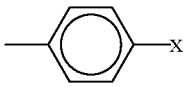 | 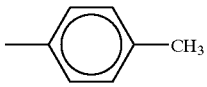 |

TABLE 15-continued
| | | | | | |
|---|---|---|---|---|---|
| 74 | 1 | 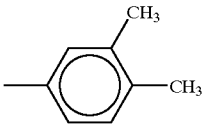 | 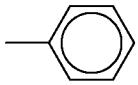 | 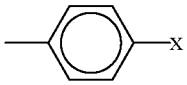 | 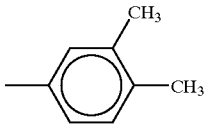 |
| 75 | 1 | 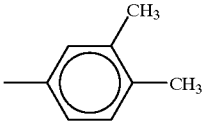 | 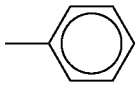 | 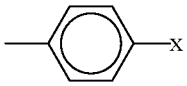 | 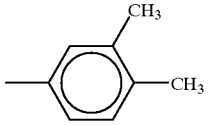 |
| COMPOUND | $Ar^5$ | X |
|---|---|---|
| 71 | 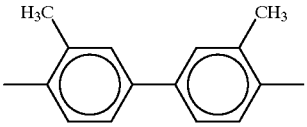 | —CH═N(CH$_2$)$_3$— —Si(OMe)$_3$ |
| 72 | 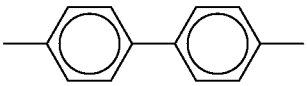 | —CH═N(CH$_2$)$_3$— —Si(OMe)$_3$ |
| 73 | 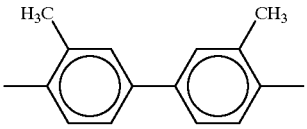 | —CH═N(CH$_2$)$_3$— —Si(OMe)$_3$ |
| 74 | 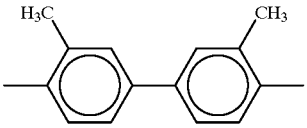 | 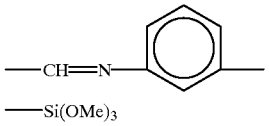 |
| 75 | 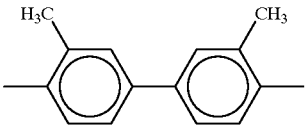 | —O(CH$_2$)$_3$Si(OMe)$_3$ |
TABLE 16
| COMPOUND | k | $Ar^1$ | $Ar^2$ | $Ar^3$ | $Ar^4$ |
|---|---|---|---|---|---|
| 76 | 1 | 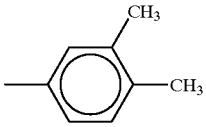 | 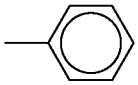 | 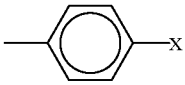 | 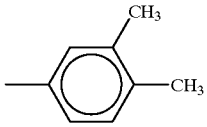 |
| 77 | 1 | 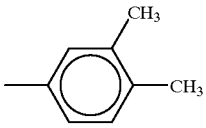 | 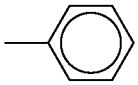 | 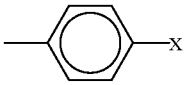 | 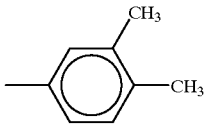 |

TABLE 16-continued
| | | | | | |
|---|---|---|---|---|---|
| 78 | 1 | 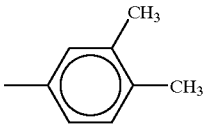 | 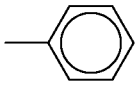 | 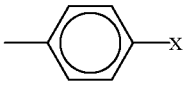 | 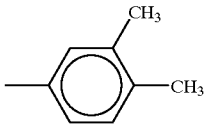 |
| 79 | 1 | 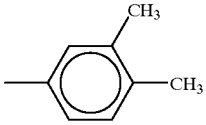 | 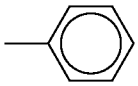 | 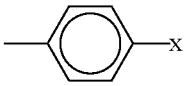 | 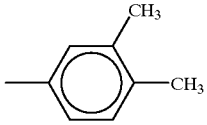 |
| 80 | 1 | 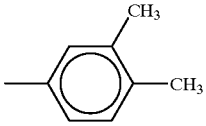 | 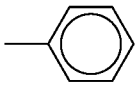 | 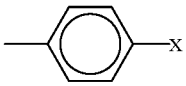 | 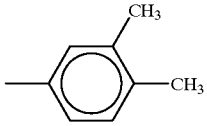 |
| COMPOUND | $Ar^5$ | X |
|---|---|---|
| 76 | 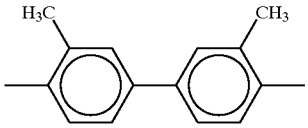 | $—O(CH_2)_3Si(OEt)_3$ |
| 77 | 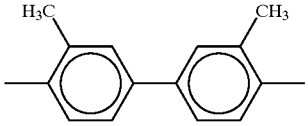 | $—CH_2O(CH_2)_3—$ $—Si(OMe)_3$ |
| 78 | 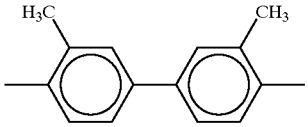 | $—(CH_2)_3O(CH_2)_3—$ $—Si(OMe)_3$ |
| 79 | 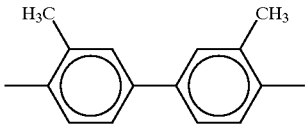 | $—(CH_2)_4Si(OMe)_3$ |
| 80 | 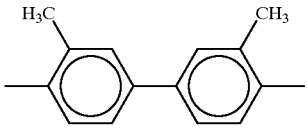 | $—(CH_2)_2C_6H_4—$ $—Si(OMe)_3$ |
TABLE 17
| COMPOUND | k | $Ar^1$ | $Ar^2$ | $Ar^3$ | $Ar^4$ |
|---|---|---|---|---|---|
| 81 | 1 | 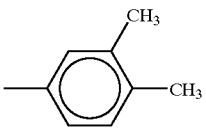 | 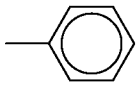 | 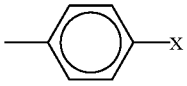 | 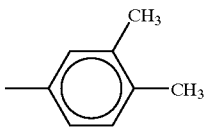 |

TABLE 17-continued
| | | | | | |
|---|---|---|---|---|---|
| 82 | 1 | 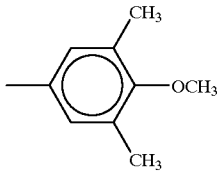 | 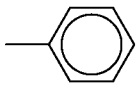 | 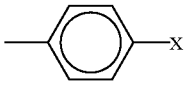 | 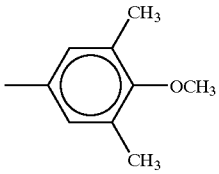 |
| 83 | 1 | 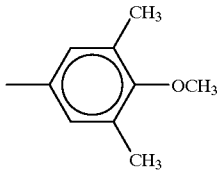 | 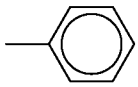 | 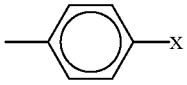 | 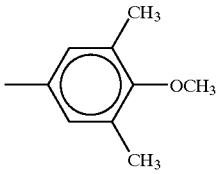 |
| 84 | 1 | 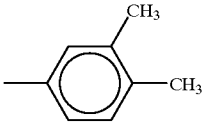 | 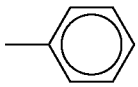 | 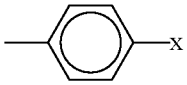 | 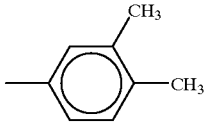 |
| 85 | 1 | 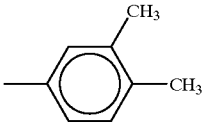 | 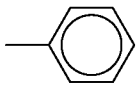 | 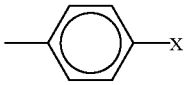 | 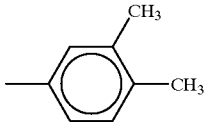 |
| COMPOUND | $Ar^5$ | X |
|---|---|---|
| 81 | 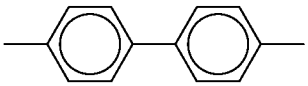 | —$(CH_2)_4Si(OMe)_3$ |
| 82 | 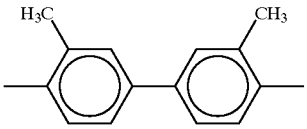 | —$(CH_2)_4Si(OMe)_3$ |
| 83 | 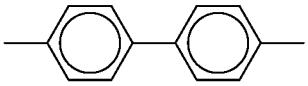 | —$(CH_2)_4Si(OMe)_3$ |
| 84 | 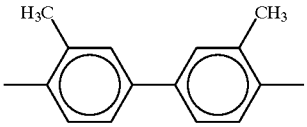 | —CH═CH$(CH_2)_2$— —$Si(OMe)_3$ |
| 85 | 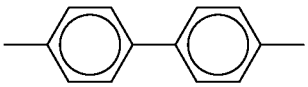 | —CH═CH$(CH_2)_2$— —$Si(OMe)_3$ |

TABLE 18
| COMPOUND | k | $Ar^1$ | $Ar^2$ | $Ar^3$ | $Ar^4$ |
|---|---|---|---|---|---|
| 86 | 1 | 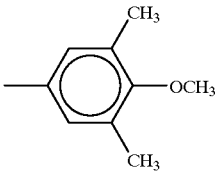 | 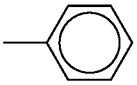 | 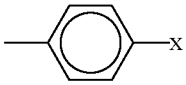 | 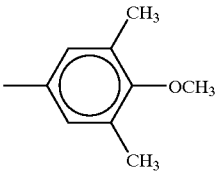 |
| 87 | 1 | 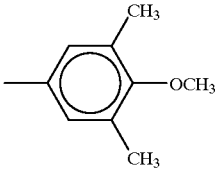 | 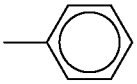 | 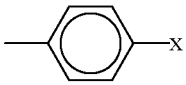 | 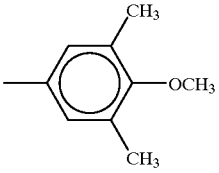 |
| 88 | 1 | 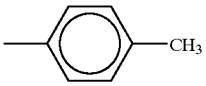 | 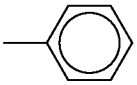 | 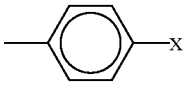 | 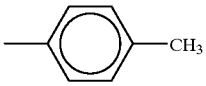 |
| 89 | 0 | 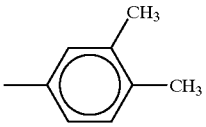 | 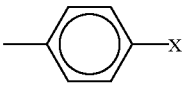 | — | — |
| 90 | 0 | 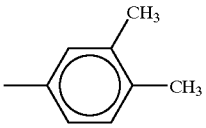 | 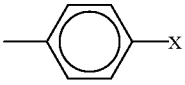 | — | — |
| COMPOUND | $Ar^5$ | X |
|---|---|---|
| 86 | 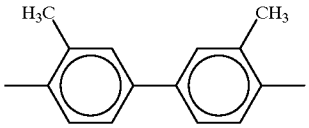 | —CH═CH$(CH_2)_2$— —Si$(OMe)_3$ |
| 87 | 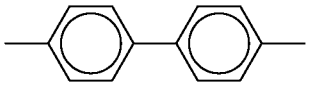 | —CH═CH$(CH_2)_2$— —Si$(OMe)_3$ |
| 88 | 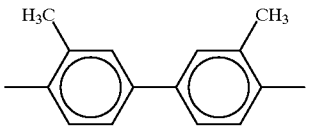 | —CH═CH$(CH_2)_2$— —Si$(OMe)_3$ |
| 89 | 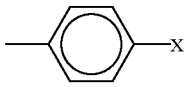 | —$(CH_2)_2$Si$(OEt)_3$ |
| 90 | 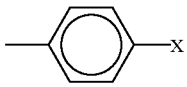 | —$(CH_2)_3$Si$(OEt)_3$ |

TABLE 19
| COMPOUND | k | $Ar^1$ | $Ar^2$ | $Ar^3$ | $Ar^4$ | $Ar^5$ | X |
|---|---|---|---|---|---|---|---|
| 91 | 0 | 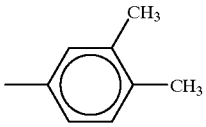 | 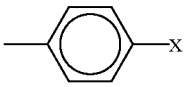 | — | — | 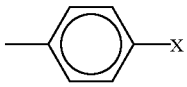 | —$(CH_2)_3$— —$Si(OMe)_2Me$ |
| 92 | 0 | 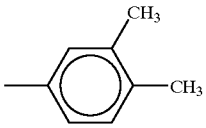 | 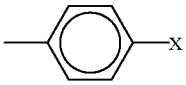 | — | — | 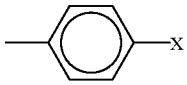 | —$(CH_2)_4Si(OMe)_3$ |
| 93 | 0 | 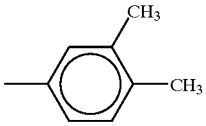 | 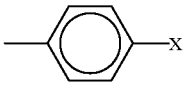 | — | — | 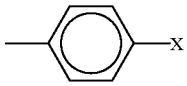 | —$(CH_2)_{12}Si(OMe)_3$ |
| 94 | 0 | 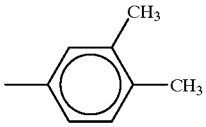 | 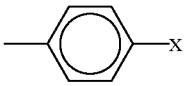 | — | — | 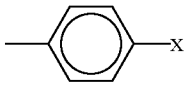 | —$(CH_2)_4Si(OEt)_3$ |
| 95 | 0 | 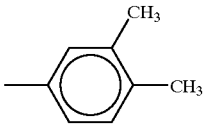 | 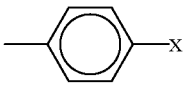 | — | — | 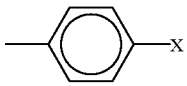 | —$(CH_2)_2C_6H_4$— —$Si(OMe)_3$ |
TABLE 20
| COMPOUND | k | $Ar^1$ | $Ar^2$ | $Ar^3$ | $Ar^4$ | $Ar^5$ | X |
|---|---|---|---|---|---|---|---|
| 96 | 0 | 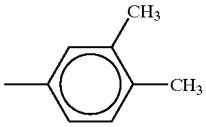 | 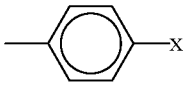 | — | — | 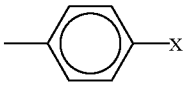 | —$(CH_2)_2C_6H_4$— —$(CH_2)_2Si(OMe)_3$ |
| 97 | 0 | 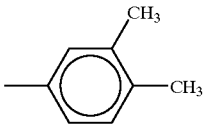 | 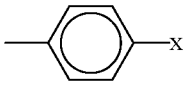 | — | — | 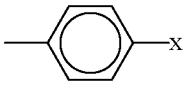 | —$(CH_2)_4Si(OMe)_3$ |
| 98 | 0 | 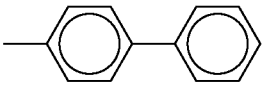 | 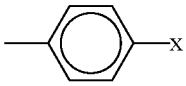 | — | — | 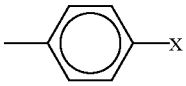 | —$(CH_2)_4Si(OMe)_3$ |
| 99 | 0 | 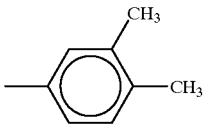 | 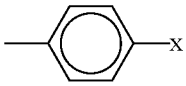 | — | — | 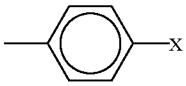 | —CH═CH$Si(OEt)_3$ |

TABLE 20-continued
| COMPOUND | k | $Ar^1$ | $Ar^2$ | $Ar^3$ | $Ar^4$ | $Ar^5$ | X |
|---|---|---|---|---|---|---|---|
| 100 | 0 | 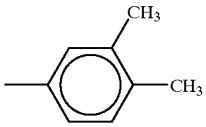 | 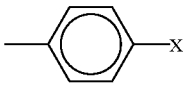 | — | — | 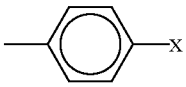 | —CH═CHCH$_2$— —Si(OMe)$_2$Me |
TABLE 21
| COMPOUND | k | $Ar^1$ | $Ar^2$ | $Ar^3$ | $Ar^4$ | $Ar^5$ | X |
|---|---|---|---|---|---|---|---|
| 101 | 0 | 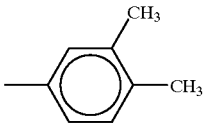 | 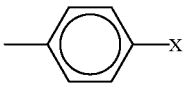 | — | — | 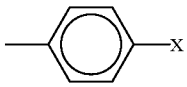 | —CH═CH(CH$_2$)$_2$— —Si(OMe)$_3$ |
| 102 | 0 | 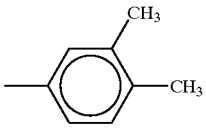 | 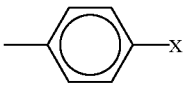 | — | — | 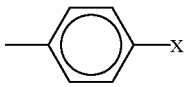 | —CH═CH(CH$_2$)$_2$— —Si(OMe)$_2$Me |
| 103 | 0 | 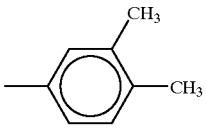 | 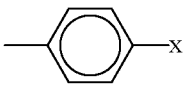 | — | — | 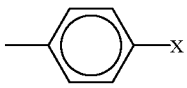 | —CH═CH(CH$_2$)$_2$— —SiMe$_2$(OMe) |
| 104 | 0 | 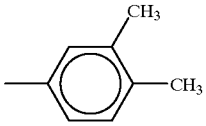 | 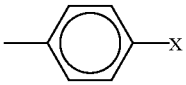 | — | — | 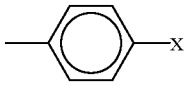 | —CH═CH(CH$_2$)$_2$— —Si(OEt)$_3$ |
| 105 | 0 | 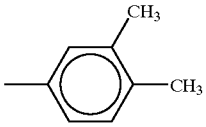 | 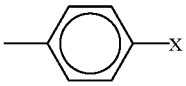 | — | — | 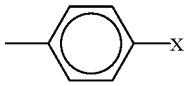 | —CH═CH(CH$_2$)$_{10}$— —Si(OMe)$_3$ |
TABLE 22
| COMPOUND | k | $Ar^1$ | $Ar^2$ | $Ar^3$ | $Ar^4$ | $Ar^5$ | X |
|---|---|---|---|---|---|---|---|
| 106 | 0 | 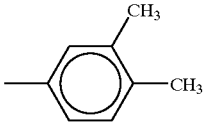 | 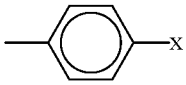 | — | — | 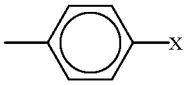 | —CH═CHC$_6$H$_4$— —Si(OMe)$_3$ |
| 107 | 0 | 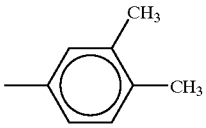 | 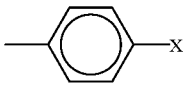 | — | — | 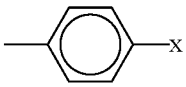 | —CH═CHC$_6$H$_4$— —(CH$_2$)$_2$Si(OMe)$_3$ |

TABLE 22-continued
| COMPOUND | k | $Ar^1$ | $Ar^2$ | $Ar^3$ | $Ar^4$ | $Ar^5$ | X |
|---|---|---|---|---|---|---|---|
| 108 | 0 | 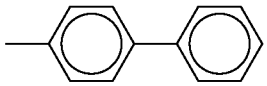 | 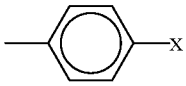 | — | — | 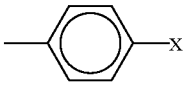 | —CH═CH$(CH_2)_2$— —Si$(OMe)_3$ |
| 109 | 0 | 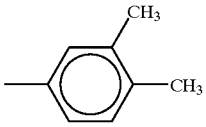 | 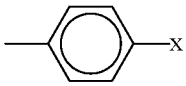 | — | — | 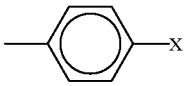 | —CH═N$(CH_2)_3$— —Si$(OMe)_3$ |
| 110 | 0 | 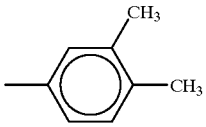 | 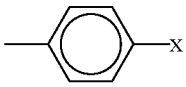 | — | — | 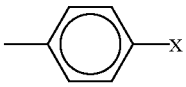 | —CH═N$(CH_2)_3$— —Si$(OEt)_3$ |
25
TABLE 23
| COMPOUND | k | $Ar^1$ | $Ar^2$ | $Ar^3$ | $Ar^4$ | $Ar^5$ | X |
|---|---|---|---|---|---|---|---|
| 111 | 0 | 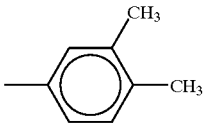 | 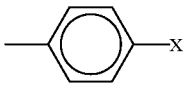 | — | — | 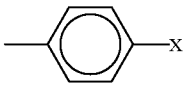 | —CH═N$CH_2$— —Si$(OMe)_2$Me |
| 112 | 0 | 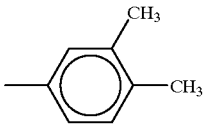 | 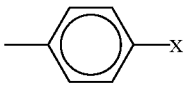 | — | — | 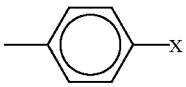 | —CH═N$C_6H_4$— —$(CH_2)_2$Si$(OMe)_3$ |
| 113 | 0 | 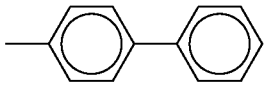 | 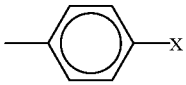 | — | — | 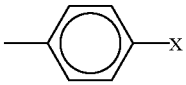 | —CH═N$(CH_2)_3$— —Si$(OMe)_3$ |
| 114 | 0 | 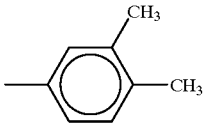 | 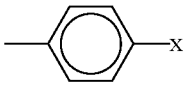 | — | — | 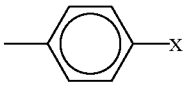 | —O$(CH_2)_3$Si$(OMe)_3$ |
| 115 | 0 | 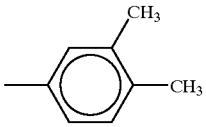 | 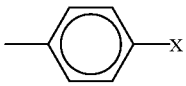 | — | — | 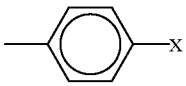 | —O$(CH_2)_3$Si$(OEt)_3$ |

TABLE 24

| COMPOUND | k | $Ar^1$ | $Ar^2$ | $Ar^3$ | $Ar^4$ | $Ar^5$ | X |
|---|---|---|---|---|---|---|---|
| 116 | 0 | 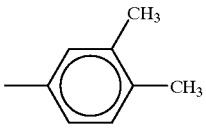 | 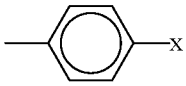 | — | — | 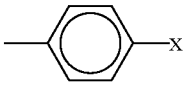 | —$CH_2O(CH_2)_3$—<br>—$Si(OMe)_3$ |
| 117 | 0 | 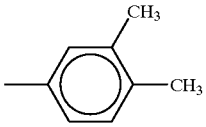 | 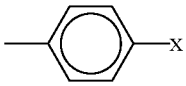 | — | — | 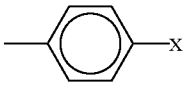 | —$(CH_2)_3O(CH_2)_3$—<br>—$Si(OMe)_3$ |
| 118 | 0 | 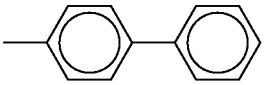 | 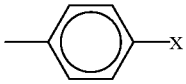 | — | — | 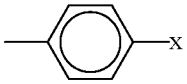 | —$CH_2O(CH_2)_3$—<br>—$Si(OMe)_3$ |
| 119 | 0 | 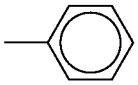 | 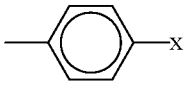 | — | — | 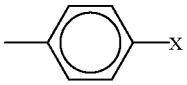 | —$CH_2COO(CH_2)_3$—<br>—$Si(OMe)_3$ |
| 120 | 0 | 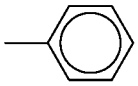 | 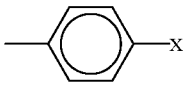 | — | — | 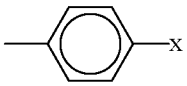 | —$(CH_2)_2COO$—<br>—$(CH_2)_3Si(OMe)_3$ |

TABLE 25

| COMPOUND | k | $Ar^1$ | $Ar^2$ | $Ar^3$ | $Ar^4$ | $Ar^5$ | X |
|---|---|---|---|---|---|---|---|
| 121 | 0 | 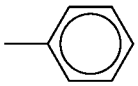 | 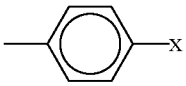 | — | — | 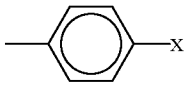 | —$(CH_2)_2COO$—<br>—$CH_2C_6H_4(CH_2)_2$—<br>—$Si(OMe)_3$ |
| 122 | 0 | 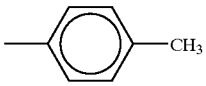 | 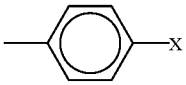 | — | — | 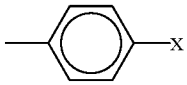 | —$CH_2COO$—<br>—$CH_2C_6H_4(CH_2)_2$—<br>—$Si(OMe)_3$ |
| 123 | 0 | 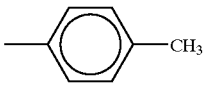 | 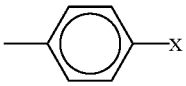 | — | — | 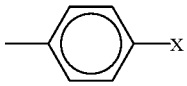 | —$(CH_2)_2COO$—<br>—$(CH_2)_3Si(OMe)_3$ |
| 124 | 0 | 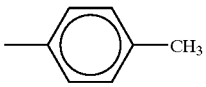 | 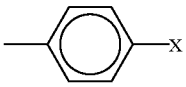 | — | — | 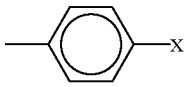 | —$(CH_2)_2COO$—<br>—$CH_2C_6H_4(CH_2)_2$—<br>—$Si(OMe)_3$ |
| 125 | 0 | 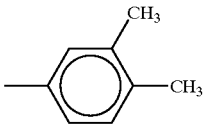 | 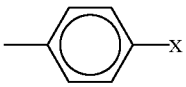 | — | — | 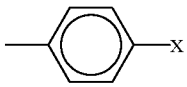 | —$CH_2COO$—<br>—$CH_2C_6H_4(CH_2)_2$—<br>—$Si(OMe)_3$ |

TABLE 26
| COM-POUND | k | $Ar^1$ | $Ar^2$ | $Ar^3$ | $Ar^4$ | $Ar^5$ | X |
|---|---|---|---|---|---|---|---|
| 126 | 0 | 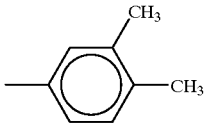 | 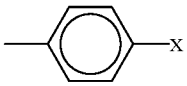 | — | — | 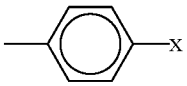 | —$(CH_2)_2COO$—<br>—$(CH_2)_3Si(OMe)_3$ |
| 127 | 0 | 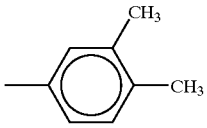 | 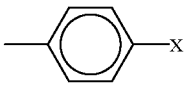 | — | — | 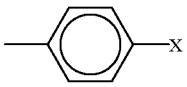 | —$(CH_2)_2COO$—<br>—$CH_2C_6H_4Si(OMe)_3$ |
| 128 | 0 | 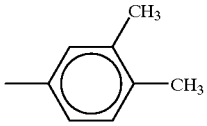 | 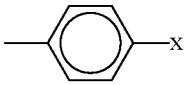 | — | — | 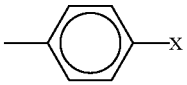 | —$(CH_2)_2COO$—<br>—$CH_2C_6H_4(CH_2)_2$—<br>—$Si(OMe)_3$ |
| 129 | 0 | 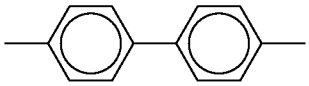 | 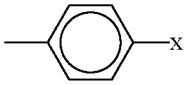 | — | — | 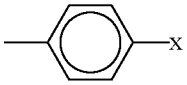 | —$CH_2COO(CH_2)_3$—<br>—$Si(OMe)_3$ |
| 130 | 0 | 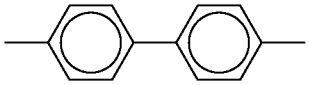 | 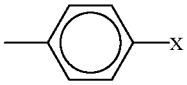 | — | — | 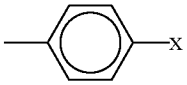 | —$(CH_2)_2COO$—<br>—$(CH_2)_3Si(OMe)_3$ |

TABLE 27
| COMPOUND | k | $Ar^1$ | $Ar^2$ | $Ar^3$ | $Ar^4$ | $Ar^5$ | X |
|---|---|---|---|---|---|---|---|
| 131 | 0 | 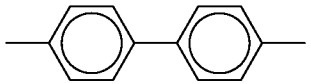 | 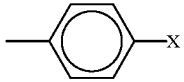 | — | — | 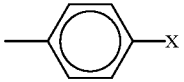 | —$(CH_2)_2COO$—<br>—$CH_2C_6H_4(CH_2)_2$—<br>—$Si(OMe)_3$ |
| 132 | 0 | 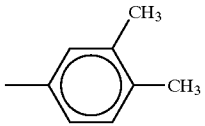 | 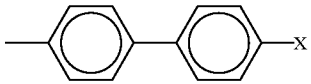 | — | — | 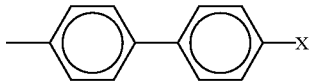 | —$COO(CH_2)_3$—<br>—$Si(OMe)_3$ |
| 133 | 0 | 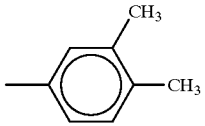 | 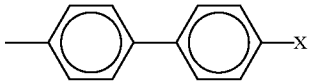 | — | — | 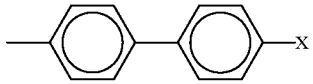 | —$COOCH_2C_6H_4$—<br>—$(CH_2)_2Si(OMe)_3$ |
| 134 | 0 | 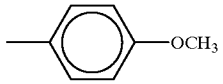 | 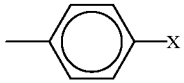 | — | — | 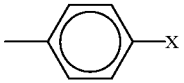 | —$CH_2COO$—<br>—$CH_2C_6H_4(CH_2)_2$—<br>—$Si(OMe)_3$ |
| 135 | 0 | 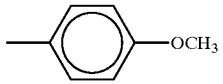 | 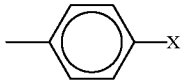 | — | — | 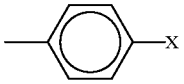 | —$(CH_2)_2COO$—<br>—$(CH_2)_3Si(OMe)_3$ |

TABLE 28
| COMPOUND | k | $Ar^1$ | $Ar^2$ | $Ar^3$ | $Ar^4$ | $Ar^5$ | X |
|---|---|---|---|---|---|---|---|
| 136 | 0 | 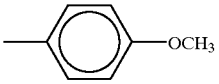 | 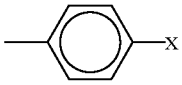 | — | — | 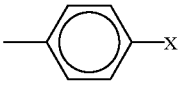 | —$(CH_2)_2COO$— —$CH_2C_6H_4(CH_2)_2$— —$Si(OMe)_3$ |
| 137 | 0 | 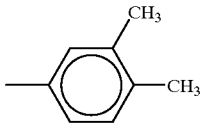 | 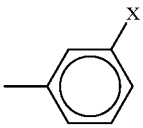 | — | — | 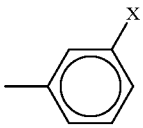 | —$(CH_2)_2COO$— —$(CH_2)_3Si(OMe)_3$ |
| 138 | 0 | 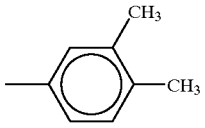 | 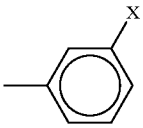 | — | — | 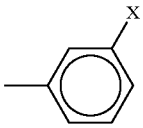 | —$(CH_2)_2COO$— —$CH_2C_6H_4Si(OMe)_3$ |
| 139 | 0 | 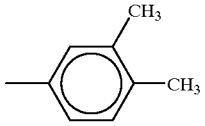 | 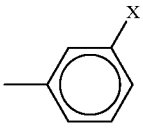 | — | — | 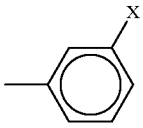 | —$CH_2)_2COO$— —$CH_2C_6H_4(CH_2)_2$— —$Si(OMe)_3$ |
| 140 | 0 | 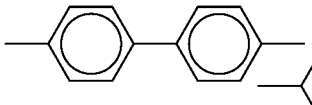 | 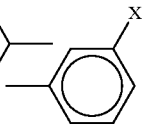 | — | — | 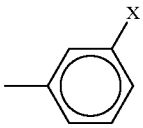 | —$CH_2COO(CH_2)_3$— —$Si(OMe)_3$ |

TABLE 29
| COMPOUND | k | $Ar^1$ | $Ar^2$ | $Ar^3$ | $Ar^4$ | $Ar^5$ | X |
|---|---|---|---|---|---|---|---|
| 141 | 0 | 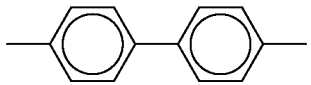 | 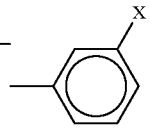 | — | — | 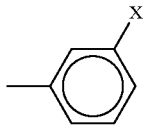 | —$(CH_2)_2COO$—<br>—$(CH_2)_3Si(OMe)_3$ |
| 142 | 0 | 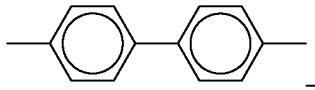 | 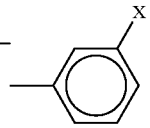 | — | — | 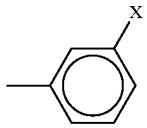 | —$(CH_2)_2COO$—<br>—$CH_2C_6H_4(CH_2)_2$—<br>—$Si(OMe)_3$ |
| 143 | 1 | 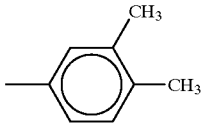 | 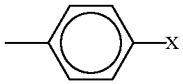 | 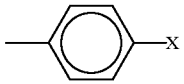 | 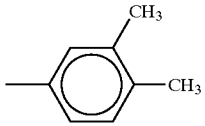 | 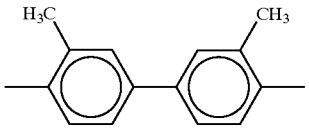 | —$(CH_2)_2Si(OEt)_3$ |
| 144 | 1 | 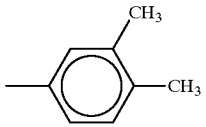 | 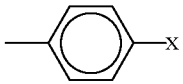 | 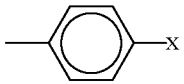 | 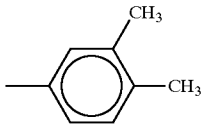 | 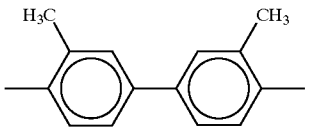 | —$(CH_2)_3Si(OEt)_3$ |
| 145 | 1 | 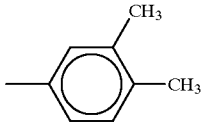 | 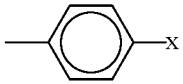 | 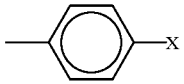 | 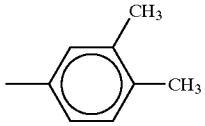 | 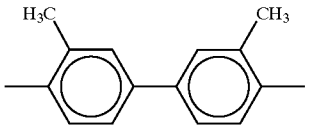 | —$(CH_2)_4Si(OMe)_3$ |

TABLE 30
| COMPOUND | k | $Ar^1$ | $Ar^2$ | $Ar^3$ | $Ar^4$ | $Ar^5$ | X |
|---|---|---|---|---|---|---|---|
| 146 | 1 | 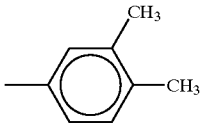 | 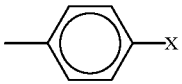 | 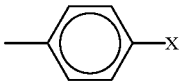 | 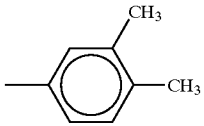 | 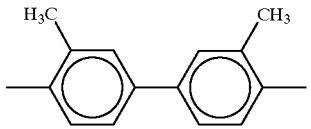 | —$(CH_2)_4$— —$SiMe(OMe)_2$ |
| 147 | 1 | 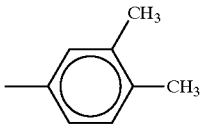 | 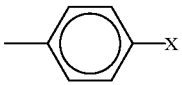 | 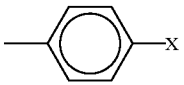 | 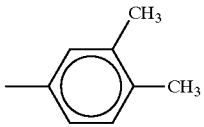 | 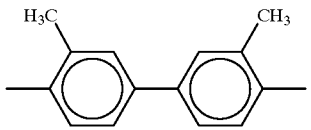 | —$(CH_2)_4$— —$SiMe_2(OMe)$ |
| 148 | 1 | 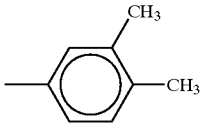 | 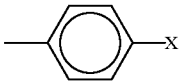 | 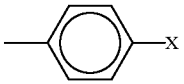 | 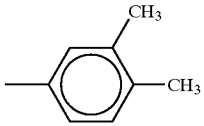 | 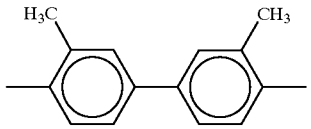 | —$(CH_2)_4Si(OEt)_3$ |
| 149 | 1 | 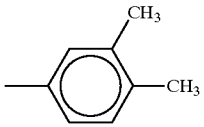 | 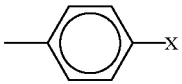 | 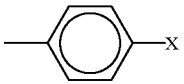 | 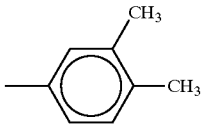 | 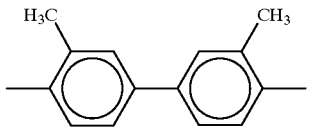 | —$(CH_2)_2C_6H_4$— —$Si(OMe)_3$ |
| 150 | 1 | 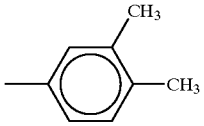 | 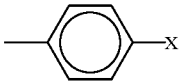 | 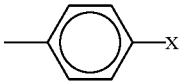 | 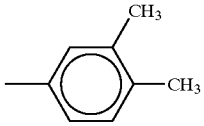 | 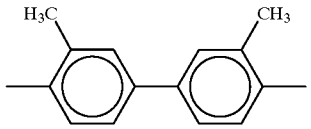 | —$(CH_2)_2C_6H_4$— —$(CH_2)_2Si(OMe)_3$ |

TABLE 31
| COMPOUND | k | $Ar^1$ | $Ar^2$ | $Ar^3$ | $Ar^4$ | $Ar^5$ | X |
|---|---|---|---|---|---|---|---|
| 151 | 1 | 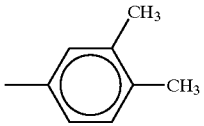 | 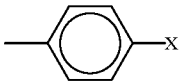 | 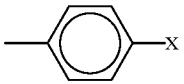 | 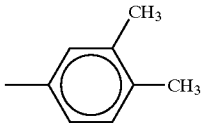 | 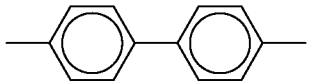 | —$(CH_2)_3$— —$Si(OMe)_2Me$ |
| 152 | 1 | 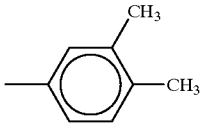 | 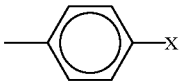 | 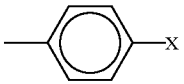 | 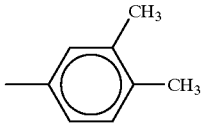 | 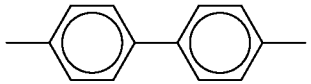 | —$(CH_2)_4Si(OMe)_3$ |
| 153 | 1 | 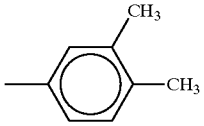 | 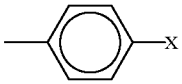 | 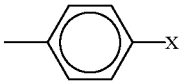 | 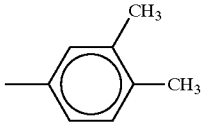 | 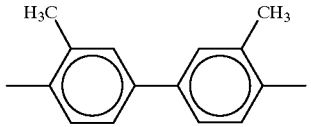 | —CH═CH$Si(OEt)_3$ |
| 154 | 1 | 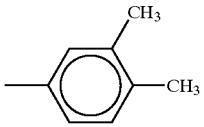 | 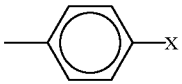 | 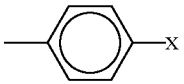 | 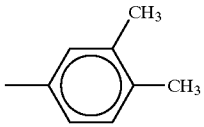 | 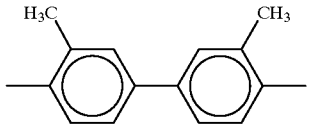 | —CH═$CHCH_2$— —$Si(OMe)_2Me$ |
| 155 | 1 | 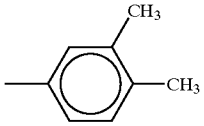 | 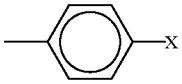 | 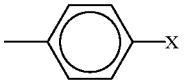 | 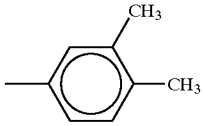 | 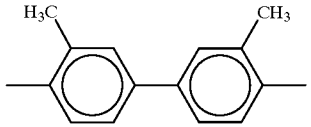 | —CH═$CH(CH_2)_2$— —$Si(OMe)_3$ |

TABLE 32
| COMPOUND | k | $Ar^1$ | $Ar^2$ | $Ar^3$ | $Ar^4$ | $Ar^5$ | X |
|---|---|---|---|---|---|---|---|
| 156 | 1 | 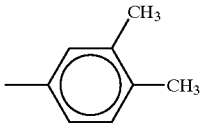 | 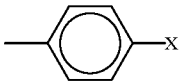 | 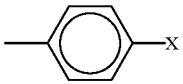 | 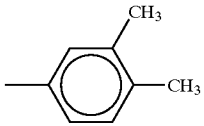 | 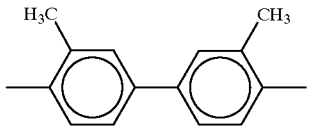 | —CH═CH$(CH_2)_2$— —SiMe$(OMe)_2$ |
| 157 | 1 | 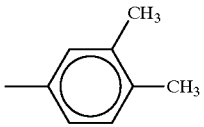 | 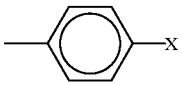 | 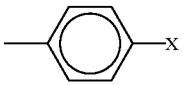 | 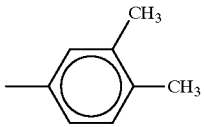 | 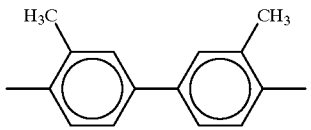 | —CH═CH$(CH_2)_2$— —$SiMe_2(OMe)$ |
| 158 | 1 | 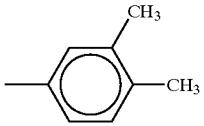 | 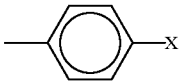 | 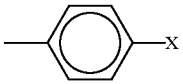 | 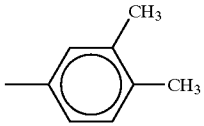 | 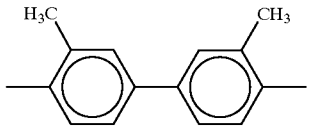 | —CH═CH$(CH_2)_2$— —$Si(OEt)_3$ |
| 159 | 1 | 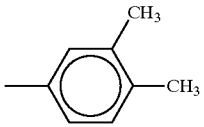 | 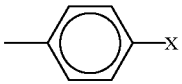 | 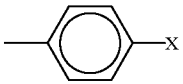 | 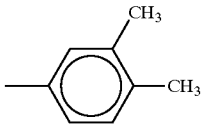 | 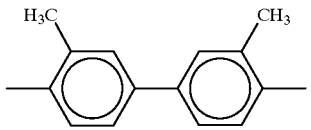 | —CH═$CHC_6H_4$— —$Si(OMe)_3$ |
| 160 | 1 | 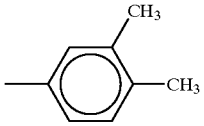 | 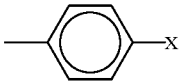 | 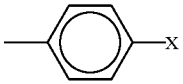 | 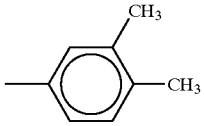 | 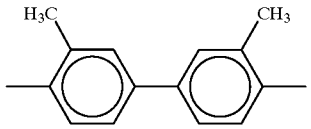 | —CH═$CHC_6H_4$— —$(CH_2)_2Si(OMe)_3$ |

TABLE 33
| COMPOUND | k | $Ar^1$ | $Ar^2$ | $Ar^3$ | $Ar^4$ | $Ar^5$ | X |
|---|---|---|---|---|---|---|---|
| 161 | 1 | 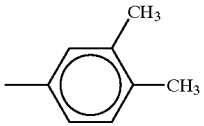 | 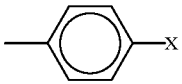 | 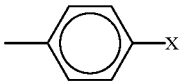 | 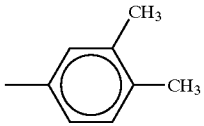 | 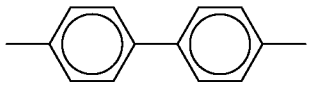 | —CH═CHCH$_2$— —Si(OMe)$_2$Me |
| 162 | 1 | 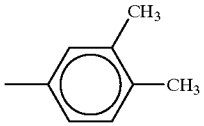 | 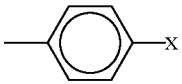 | 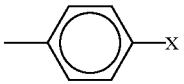 | 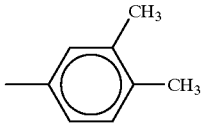 | 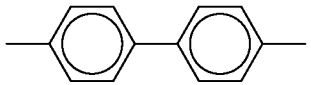 | —CH═CH(CH$_2$)$_2$— —Si(OMe)$_3$ |
| 163 | 1 | 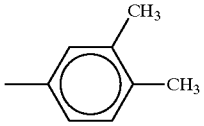 | 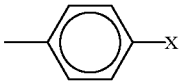 | 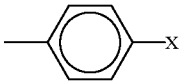 | 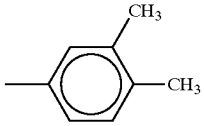 | 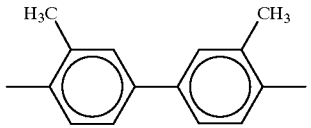 | —CH═NCH$_2$— —Si(OMe)$_2$Me |
| 164 | 1 | 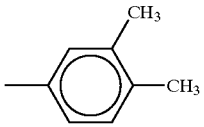 | 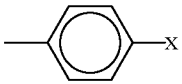 | 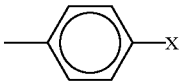 | 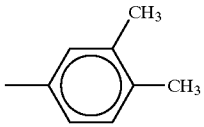 | 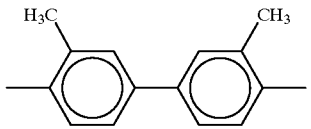 | —CH═N(CH$_2$)$_2$— —Si(OEt)$_3$ |
| 165 | 1 | 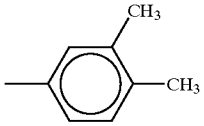 | 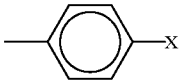 | 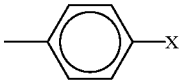 | 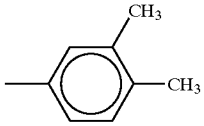 | 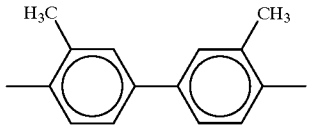 | —CH═N(CH$_2$)$_3$— —Si(OMe)$_3$ |

TABLE 34
| COMPOUND | k | $Ar^1$ | $Ar^2$ | $Ar^3$ | $Ar^4$ | $Ar^5$ | X |
|---|---|---|---|---|---|---|---|
| 166 | 1 | 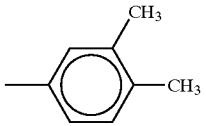 | 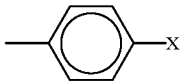 | 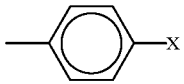 | 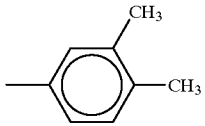 | 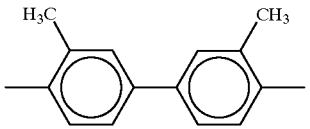 | 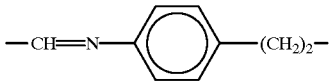 |
| 167 | 1 | 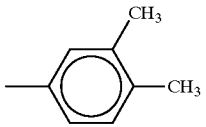 | 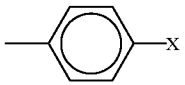 | 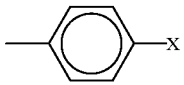 | 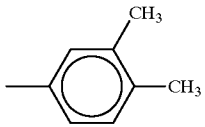 | 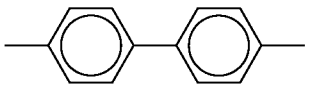 | —CH═NCH$_2$—<br>—Si(OMe)$_2$Me |
| 168 | 1 | 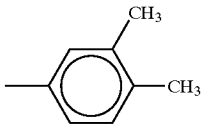 | 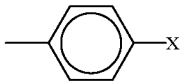 | 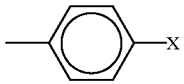 | 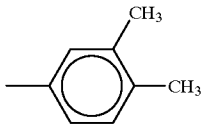 | 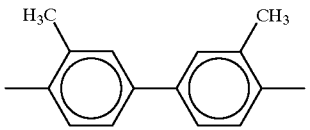 | —O(CH$_2$)$_3$Si(OMe)$_3$ |
| 169 | 1 | 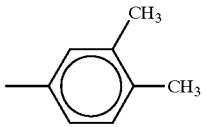 | 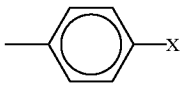 | 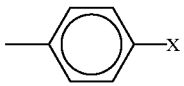 | 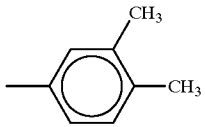 | 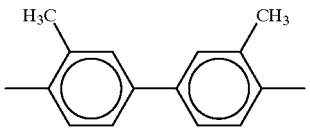 | —O(CH$_2$)$_3$—<br>—SiMe(OMe)$_2$ |
| 170 | 1 | 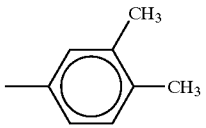 | 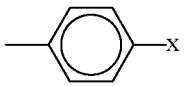 | 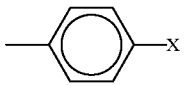 | 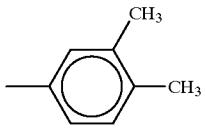 | 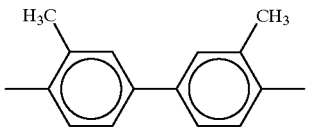 | —O(CH$_2$)$_3$Si(OEt)$_3$ |

TABLE 35
| COMPOUND | k | $Ar^1$ | $Ar^2$ | $Ar^3$ | $Ar^4$ | $Ar^5$ | X |
|---|---|---|---|---|---|---|---|
| 171 | 1 | 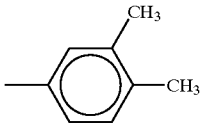 | 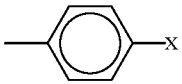 | 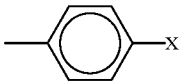 | 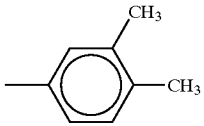 | 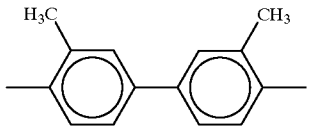 | $—CH_2O(CH_2)_3—$ $—Si(OMe)_3$ |
| 172 | 1 | 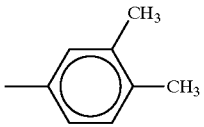 | 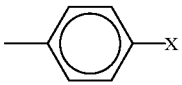 | 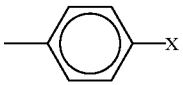 | 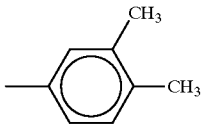 | 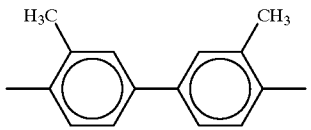 | $—(CH_2)_3O(CH_2)_3—$ $—Si(OMe)_3$ |
| 173 | 1 | 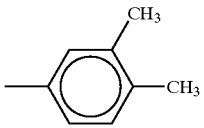 | 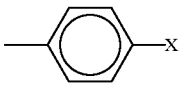 | 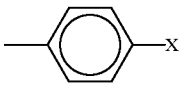 | 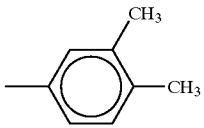 | 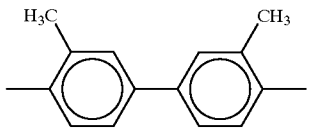 | $—COO(CH_2)_3—$ $—Si(OMe)_3$ |
| 174 | 1 | 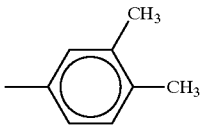 | 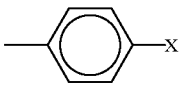 | 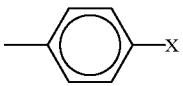 | 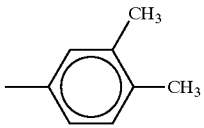 | 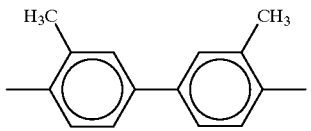 | $—COOCH_2C_6H_4—$ $—(CH_2)_3—Si(OMe)_3$ |
| 175 | 1 | 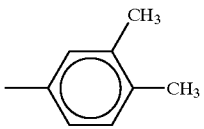 | 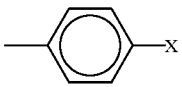 | 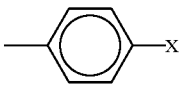 | 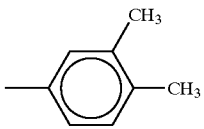 | 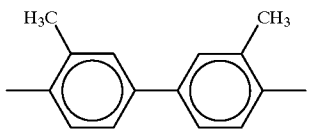 | $—CH_2COO)CH_2)_3—$ $—Si(OMe)_3$ |

TABLE 36
| COMPOUND | k | $Ar^1$ | $Ar^2$ | $Ar^3$ | $Ar^4$ | $Ar^5$ | X |
|---|---|---|---|---|---|---|---|
| 176 | 1 | 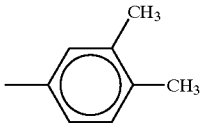 | 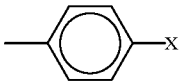 | 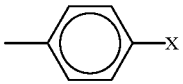 | 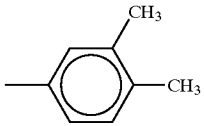 | 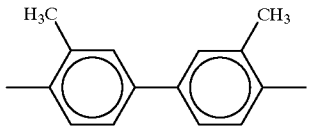 | —$CH_2COO$— —$CH_2C_6H_4(CH_2)_2$— —$Si(OMe)_3$ |
| 177 | 1 | 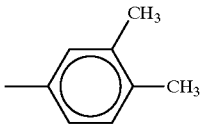 | 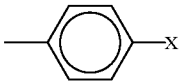 | 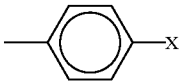 | 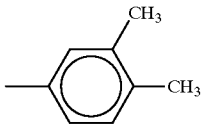 | 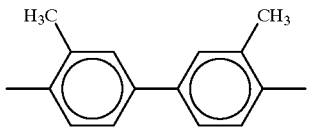 | —$(CH_2)_2COO$— —$(CH_2)_3Si(OMe)_3$ |
| 178 | 1 | 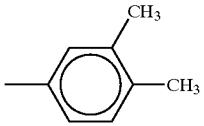 | 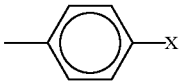 | 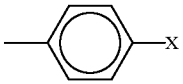 | 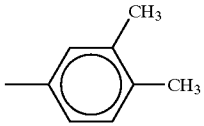 | 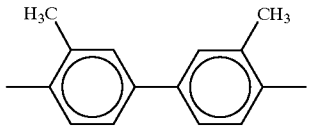 | —$(CH_2)_2COO$— —$CH_2C_6H_4(CH_2)_2$— —$Si(OMe)_3$ |
| 179 | 1 | 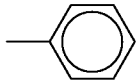 | 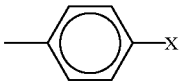 | 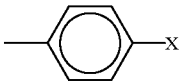 | 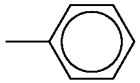 | 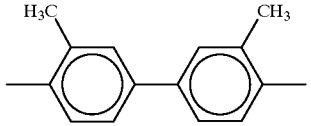 | —$COOCH_2C_6H_4$— —$(CH_2)_2Si(OMe)_3$ |
| 180 | 1 | 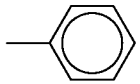 | 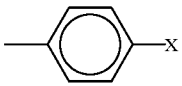 | 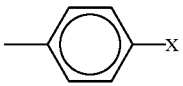 | 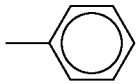 | 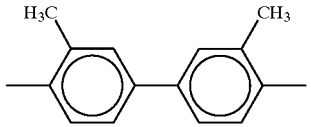 | —$CH_2COO(CH_2)_3$— —$Si(OMe)_3$ |

TABLE 37
| COMPOUND | k | $Ar^1$ | $Ar^2$ | $Ar^3$ | $Ar^4$ | $Ar^5$ | X |
|---|---|---|---|---|---|---|---|
| 181 | 1 | 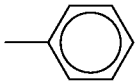 | 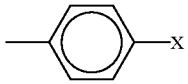 | 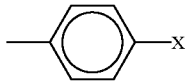 | 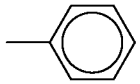 | 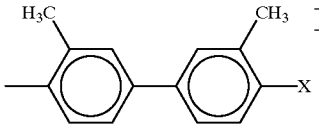 | —$CH_2COOCH_2$—<br>—$C_6H_4Si(OMe)_3$ |
| 182 | 1 | 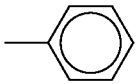 | 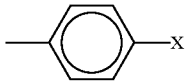 | 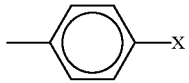 | 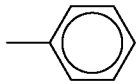 | 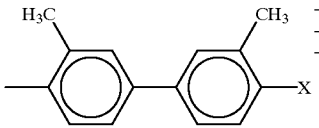 | —$CH_2COO$—<br>—$CH_2C_6H_4(CH_2)_2$—<br>—$Si(OMe)_3$ |
| 183 | 1 | 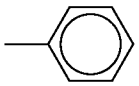 | 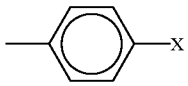 | 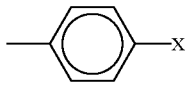 | 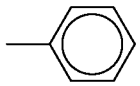 | 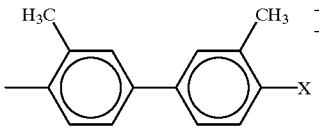 | —$(CH_2)_2COO$—<br>—$(CH_2)_3Si(OMe)_3$ |
| 184 | 1 | 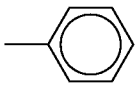 | 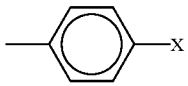 | 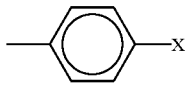 | 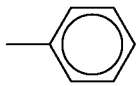 | 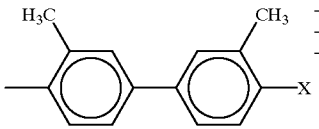 | —$(CH_2)_2COO$—<br>—$CH_2C_6H_4(CH_2)_2$—<br>—$Si(OMe)_3$ |
| 185 | 1 | 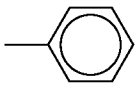 | 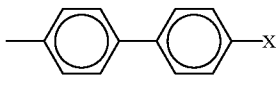 | 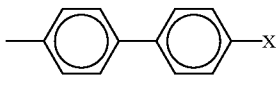 | 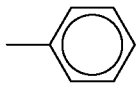 | 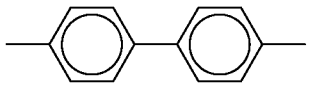 | —$COO(CH_2)_3$—<br>—$Si(OMe)_3$ |

TABLE 38
| COM-POUND | k | $Ar^1$ | $Ar^2$ | $Ar^3$ | $Ar^4$ | $Ar^5$ | X |
|---|---|---|---|---|---|---|---|
| 186 | 1 | 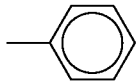 | 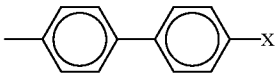 | 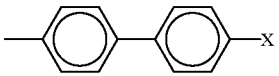 | 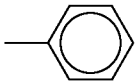 | 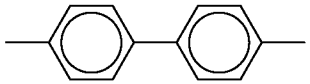 | —$COOCH_2C_6H_4$— —$Si(OMe)_3$ |
| 187 | 1 | 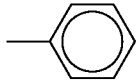 | 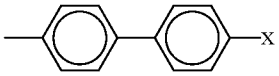 | 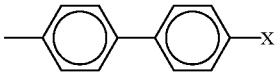 | 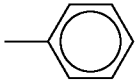 | 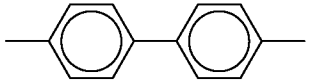 | —$COOCH_2C_6H_4$— —$(CH_2)_2Si(OMe)_3$ |
| 188 | 1 | 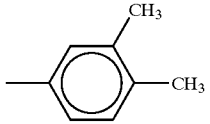 | 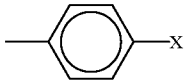 | 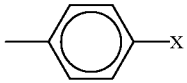 | 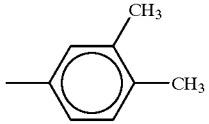 | 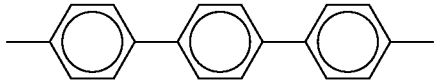 | —$COO(CH_2)_3$— —$Si(OMe)_3$ |
| 189 | 1 | 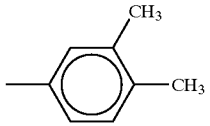 | 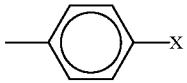 | 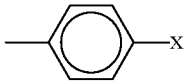 | 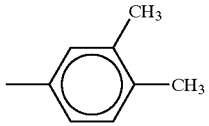 | 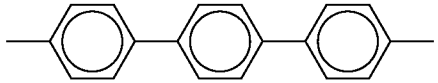 | —$COOCH_2C_6H_4$— —$Si(OMe)_3$ |
| 190 | 1 | 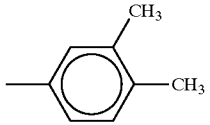 | 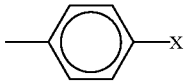 | 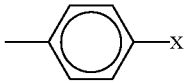 | 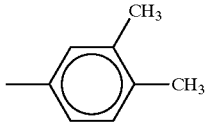 | 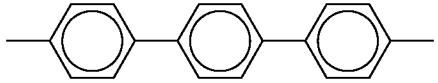 | —$COOCH_2C_6H_4$— —$(CH_2)_2Si(OMe)_3$ |

TABLE 39
| COMPOUND | k | $Ar^1$ | $Ar^2$ | $Ar^3$ | $Ar^4$ | $Ar^5$ | X |
|---|---|---|---|---|---|---|---|
| 191 | 1 | 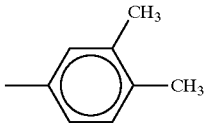 | 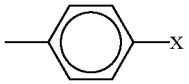 | 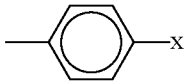 | 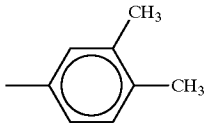 | 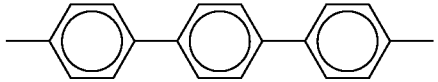 | —$CH_2COO(CH_2)_3$—<br>—$Si(OMe)_3$ |
| 192 | 1 | 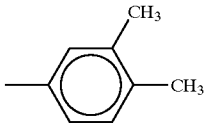 | 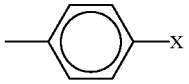 | 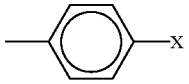 | 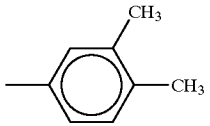 | 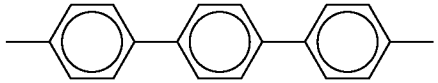 | —$(CH_2)_2COO$—<br>—$(CH_2)_3Si(OMe)_3$ |
| 193 | 1 | 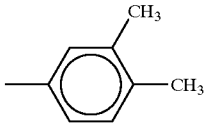 | 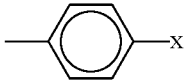 | 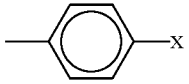 | 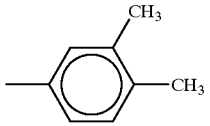 | 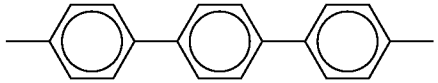 | —$(CH_2)_2COO$—<br>—$CH_2C_6H_4(CH_2)_2$—<br>—$Si(OMe)_3$ |
| 194 | 0 | 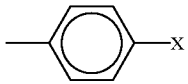 | 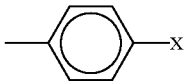 | — | — | 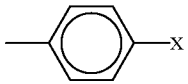 | —$(CH_2)_3$—<br>—$Si(OMe)_2Me$ |
| 195 | 0 | 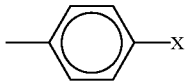 | 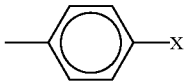 | — | — | 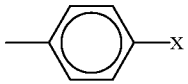 | —$(CH_2)_3Si(OEt)_3$ |

TABLE 40
| COMPOUND | k | $Ar^1$ | $Ar^2$ | $Ar^3$ | $Ar^4$ | $Ar^5$ | X |
|---|---|---|---|---|---|---|---|
| 196 | 0 | 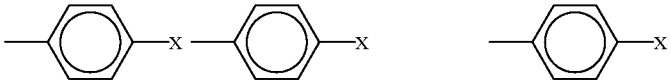 | | — | — | | —$(CH_2)_4Si(OMe)_3$ |
| 197 | 0 | 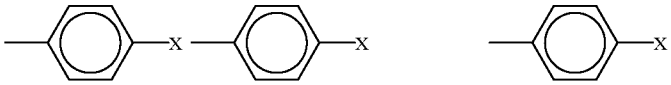 | | — | — | | —$(CH_2)_4$—<br>—$Si(OMe)_2Me$ |
| 198 | 0 | 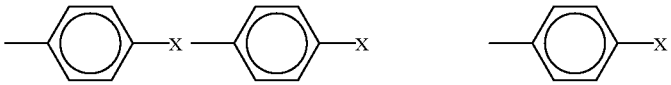 | | — | — | | —$(CH_2)_4SiMe_2(OMe)$ |
| 199 | 0 | 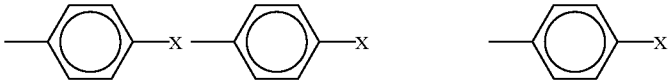 | | — | — | | —$(CH_2)_4Si(OEt)_3$ |
| 200 | 0 | 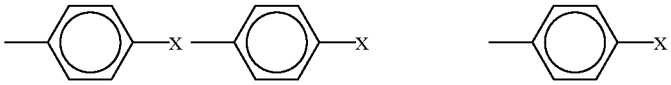 | | — | — | | —$(CH_2)_{12}Si(OMe)_3$ |
TABLE 41
| COMPOUND | k | $Ar^1$ | $Ar^2$ | $Ar^3$ | $Ar^4$ | $Ar^5$ | X |
|---|---|---|---|---|---|---|---|
| 201 | 0 | 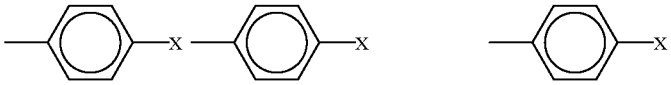 | | — | — | | —$(CH_2)_2C_6H_4$—<br>—$Si(OMe)_3$ |
| 202 | 0 | 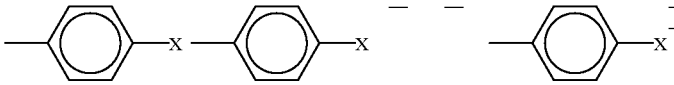 | | — | — | | —$(CH_2)_2C_6H_4$—<br>—$(CH_2)_2Si(OMe)_3$ |
| 203 | 0 | 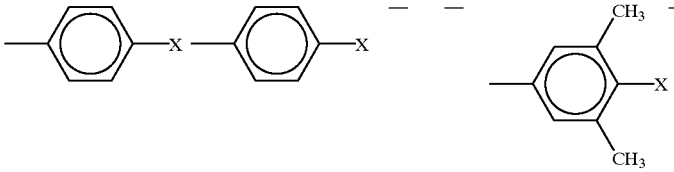 | | — | — | | —$(CH_2)_4Si(OMe)_3$ |
| 204 | 0 | 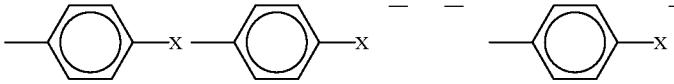 | | — | — | | —CH═CH$Si(OMe)_3$ |
| 205 | 0 | 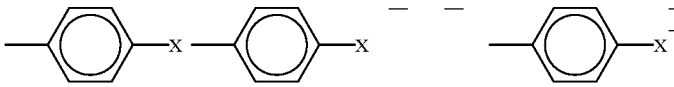 | | — | — | | —CH═$CHCH_2$—<br>—$Si(OMe)_2Me$ |

TABLE 42
| COMPOUND | k | $Ar^1$ | $Ar^2$ | $Ar^3$ | $Ar^4$ | $Ar^5$ | X |
|---|---|---|---|---|---|---|---|
| 206 | 0 | 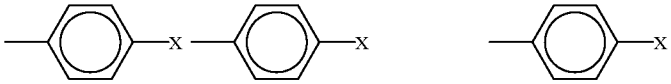 | | — | — | | —CH═CH$(CH_2)_2$— —Si$(OMe)_3$ |
| 207 | 0 | 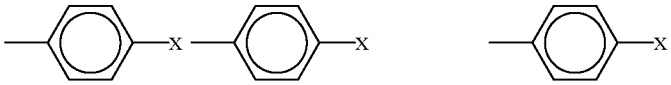 | | — | — | | —CH═CH$(CH_2)_2$— —SiMe$(OMe)_2$ |
| 208 | 0 | 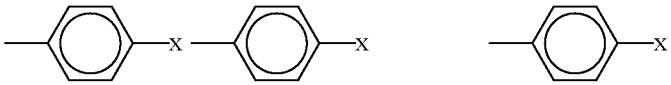 | | — | — | | —CH═CH$(CH_2)_2$— —Si$Me_2$(OMe) |
| 209 | 0 | 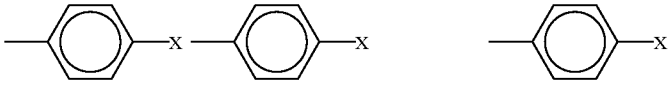 | | — | — | | —CH═CH$(CH_2)_2$— —Si$(OEt)_3$ |
| 210 | 0 | 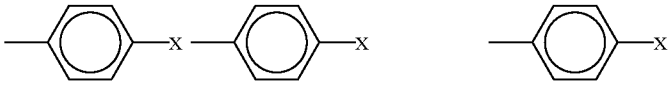 | | — | — | | —CH═CH$(CH_2)_{10}$— —Si$(OMe)_3$ |
TABLE 43
| COMPOUND | k | $Ar^1$ | $Ar^2$ | $Ar^3$ | $Ar^4$ | $Ar^5$ | X |
|---|---|---|---|---|---|---|---|
| 211 | 0 | 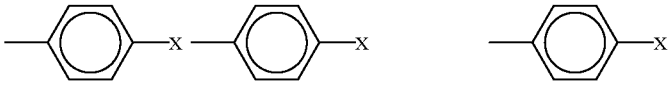 | | — | — | | —CH═CH$C_6H_4$— —Si$(OMe)_3$ |
| 212 | 0 | 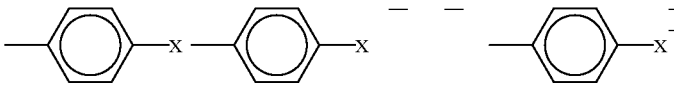 | | — | — | | —CH═CH$C_6H_4$— —$(CH_2)_2$Si$(OMe)_3$ |
| 213 | 0 | 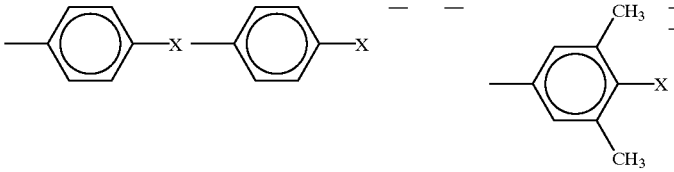 | | — | — | | —CH═CH$(CH_2)_2$— —Si$(OMe)_3$ |
| 214 | 0 | 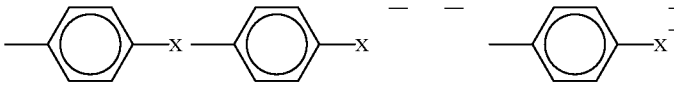 | | — | — | | —CH═N$(CH_2)_3$— —Si$(OMe)_3$ |
| 215 | 0 | 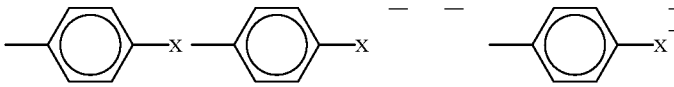 | | — | — | | —CH═N$(CH_2)_3$— —Si$(OEt)_3$ |

TABLE 44
| COMPOUND | k | $Ar^1$ | $Ar^2$ | $Ar^3$ | $Ar^4$ | $Ar^5$ | X |
|---|---|---|---|---|---|---|---|
| 216 | 0 | 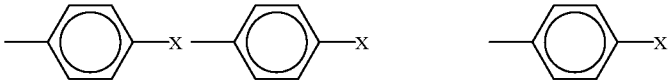 | | — | — | | —CH═NCH$_2$— —Si(OMe)$_2$Me |
| 217 | 0 | 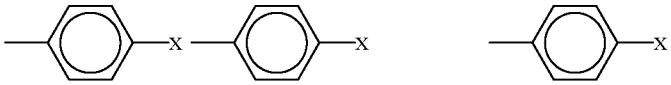 | | — | — | | —CH═NC$_6$H$_4$— —(CH$_2$)$_2$Si(OMe)$_3$ |
| 218 | 0 | 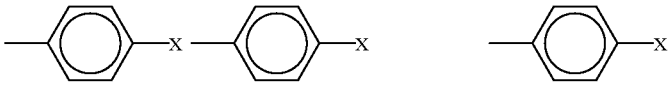 | | — | — | | —CH═N(CH$_2$)$_2$— —Si(OMe)$_3$ |
| 219 | 0 | 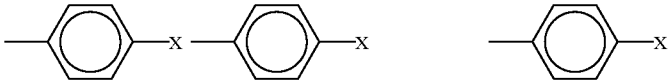 | | — | — | | —O(CH$_2$)$_3$Si(OMe)$_3$ |
| 220 | 0 | 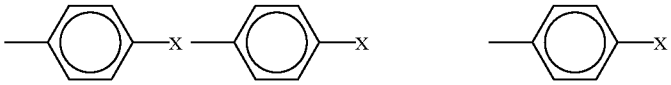 | | — | — | | —O(CH$_2$)$_3$— —Si(OMe)$_2$Me |

TABLE 45
| COMPOUND | k | $Ar^1$ | $Ar^2$ | $Ar^3$ | $Ar^4$ | $Ar^5$ | X |
|---|---|---|---|---|---|---|---|
| 221 | 0 | 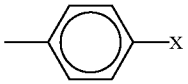 | 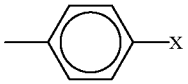 | — | — | 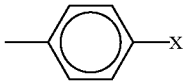 | —$O(CH_2)_3Si(OEt)_3$ |
| 222 | 0 | 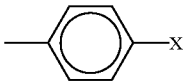 | 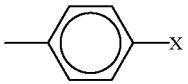 | — | — | 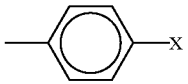 | —$CH_2O(CH_2)_3$—<br>—$Si(OMe)_3$ |
| 223 | 0 | 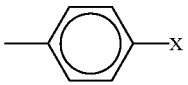 | 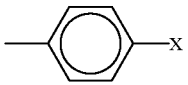 | — | — | 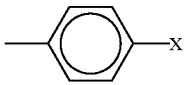 | —$(CH_2)_3O(CH_2)_3$—<br>—$Si(OMe)_2Me$ |
| 224 | 1 | 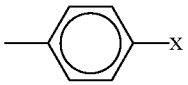 | 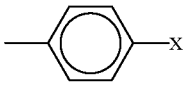 | 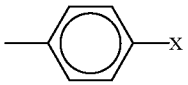 | 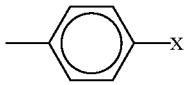 | 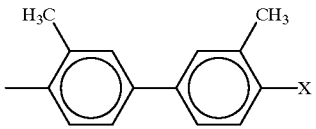 | —$(CH_2)_4Si(OMe)_3$ |
| 225 | 1 | 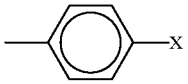 | 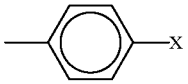 | 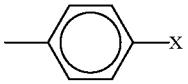 | 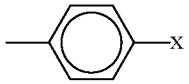 | 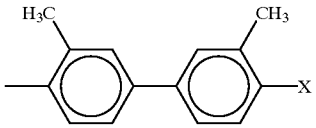 | —$(CH_2)_3Si(OEt)_3$ |

TABLE 46
| COMPOUND | k | $Ar^1$ | $Ar^2$ | $Ar^3$ | $Ar^4$ | $Ar^5$ | X |
|---|---|---|---|---|---|---|---|
| 226 | 1 | 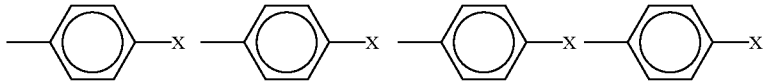 | | | | 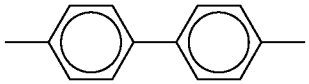 | —$CH_2CH_2$—$(CH_2)_2$— —$Si(OMe)_3$ |
| 227 | 1 | 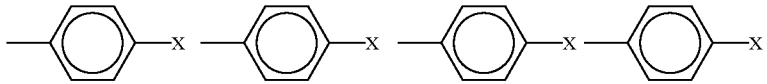 | | | | 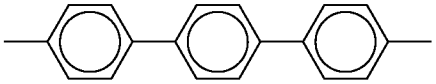 | —$CH_2CH_2$—$(CH_2)_2$— —$Si(OMe)_3$ |
| 228 | 1 | 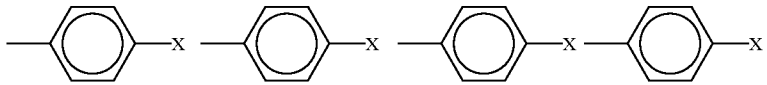 | | | | 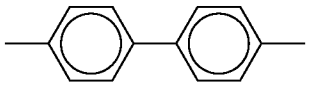 | —$CH_2CH_2$—$CH_2$— —$Si(OMe)_2Me$ |
| 229 | 1 | 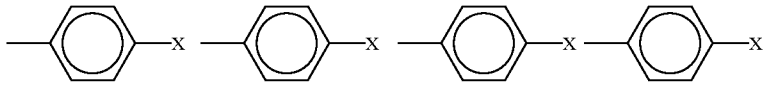 | | | | 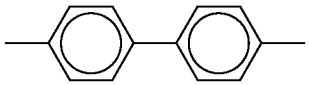 | —$CH_2CH_2$—$C_6H_4$— —$Si(OMe)_2Me$ |
| 230 | 1 | 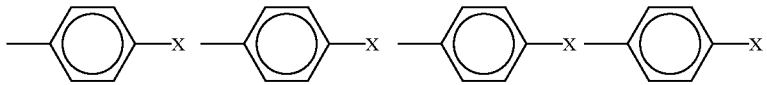 | | | | 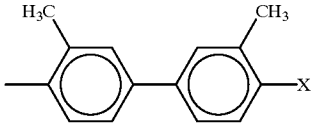 | —CH═CH$(CH_2)_2$— —$Si(OMe)_3$ |

TABLE 47
| COMPOUND | k | $Ar^1$ | $Ar^2$ | $Ar^3$ | $Ar^4$ | $Ar^5$ | X |
|---|---|---|---|---|---|---|---|
| 231 | 1 | 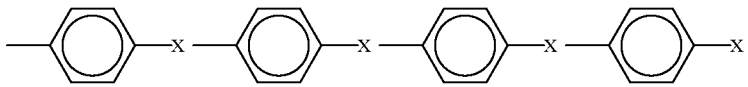 | | | | 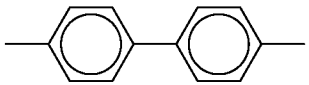 | —CH═CH$(CH_2)_2$— —Si$(OMe)_3$ |
| 232 | 1 | 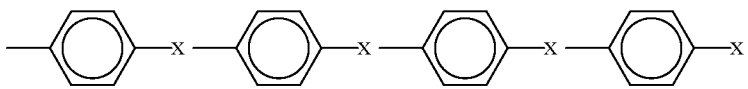 | | | | 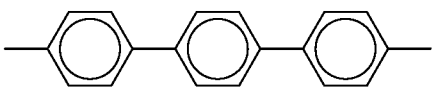 | —CH═CH$(CH_2)_2$— —Si$(OMe)_3$ |
| 233 | 1 | 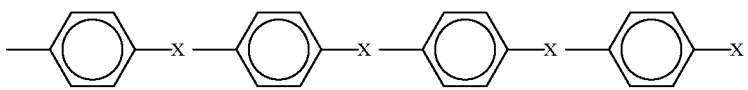 | | | | 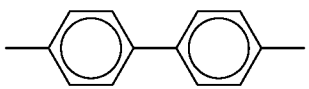 | —CH═CH$CH_2$— —Si$(OMe)_2$Me |
| 234 | 1 | 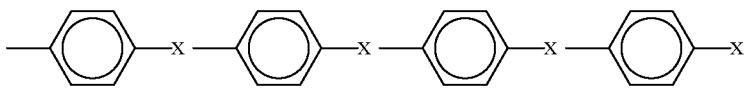 | | | | 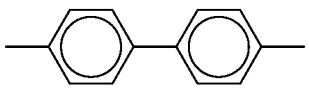 | —CH═CH$C_6H_4$— —Si$(OMe)_3$ |
| 235 | 1 | 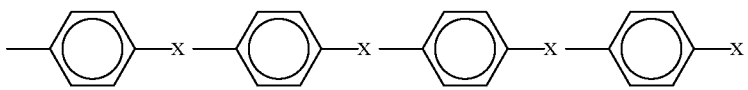 | | | | 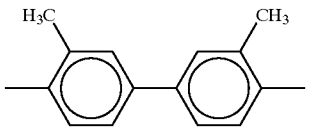 | —CH═N$(CH_2)_3$— —Si$(OMe)_3$ |

TABLE 48
| COMPOUND | k | $Ar^1$ | $Ar^2$ | $Ar^3$ | $Ar^4$ | $Ar^5$ | X |
|---|---|---|---|---|---|---|---|
| 236 | 1 | 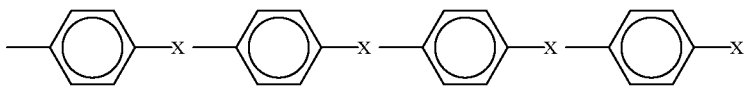 | | | | 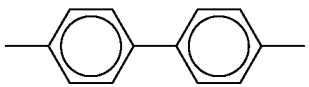 | —CH=N$(CH_2)_3$— —Si$(OMe)_3$ |
| 237 | 1 | 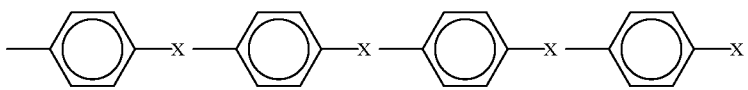 | | | | 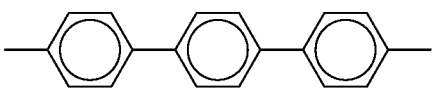 | —CH=N$(CH_2)_3$— —Si$(OMe)_3$ |
| 238 | 1 | 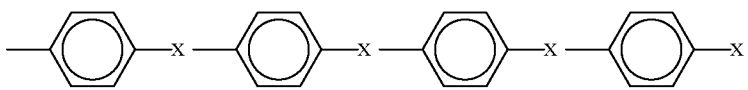 | | | | 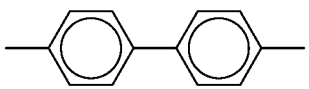 | —CH=$NCH_2$— —Si$(OMe)_2$Me |
| 239 | 1 | 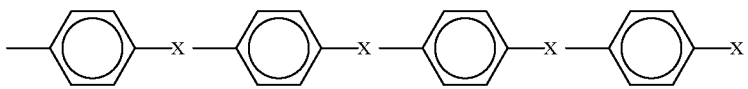 | | | | 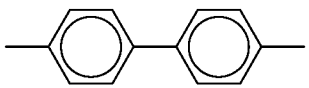 | —CH=$NC_6H_4$— —$(CH_2)_2$Si$(OMe)_3$ |
| 240 | 1 | 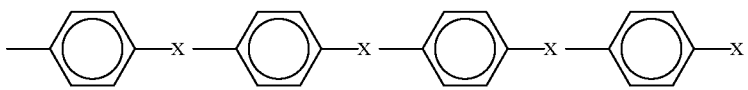 | | | | 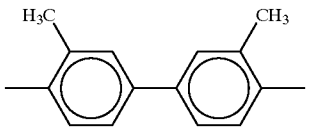  | —O$(CH_2)_3$Si$(OMe)_3$ |

TABLE 49
| COMPOUND | k | $Ar^1$ | $Ar^2$ | $Ar^3$ | $Ar^4$ | $Ar^5$ | X |
|---|---|---|---|---|---|---|---|
| 241 | 1 | 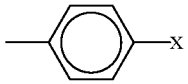 | 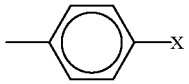 | 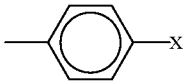 | 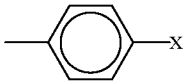 | 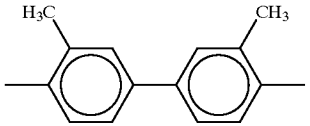 | $—O(CH_2)_3Si(OEt)_3$ |
| 242 | 1 | 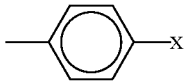 | 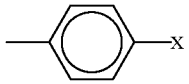 | 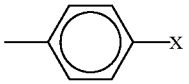 | 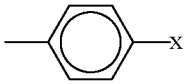 | 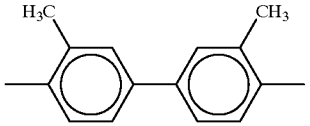 | $—CH_2O(CH_2)_3—$ $—Si(OMe)_3$ |
| 243 | 1 | 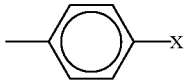 | 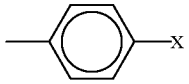 | 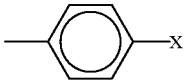 | 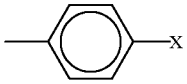 | 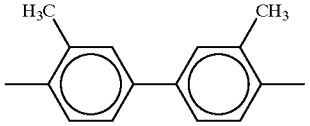 | $—CH_2O(CH_2)_3—$ $—Si(OEt)_3$ |
| 244 | 1 | 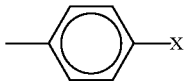 | 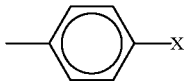 | 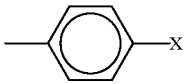 | 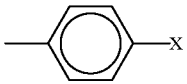 | 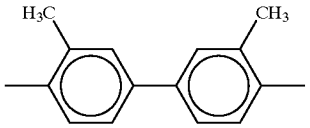 | $—(CH_2)_3O(CH_2)_3—$ $—Si(OMe)_3$ |
| 245 | 0 | 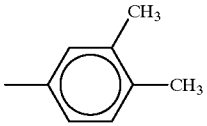 | 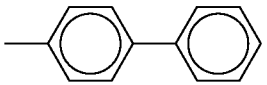 | — | — | 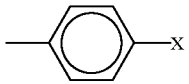 | $—COO(CH_2)_3—$ $—Si(O\text{-}i\text{-}Pr)_3$ |

TABLE 50
| COMPOUND | k | $Ar^1$ | $Ar^2$ | $Ar^3$ | $Ar^4$ | $Ar^5$ | X |
|---|---|---|---|---|---|---|---|
| 246 | 0 | 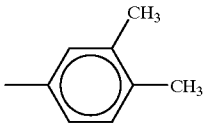 | 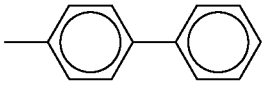 | — | — | 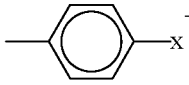 | —$COOCH_2C_6H_4$—<br>—$(CH_2)_2$—<br>—Si(O-i-Pr)$_3$ |
| 247 | 0 | 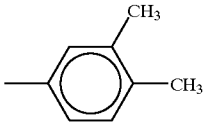 | 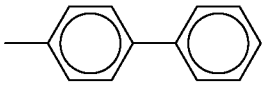 | — | — | 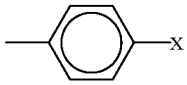 | —$CH_2COO(CH_2)_3$—<br>—Si(O-i-Pr)$_3$ |
| 248 | 0 | 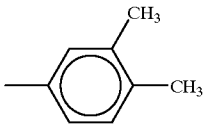 | 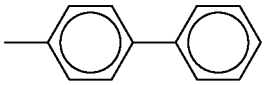 | — | — | 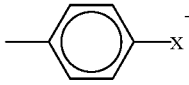 | —$CH_2COOCH_2$—<br>—$C_6H_4(CH_2)_2$—<br>—Si(O-i-Pr)$_3$ |
| 249 | 0 | 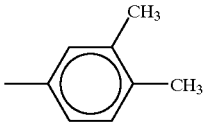 | 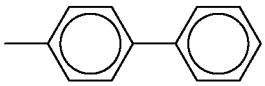 | — | — | 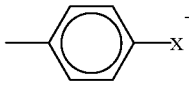 | —$(CH_2)_2COO$—<br>—$(CH_2)_3$—<br>—Si(O-i-Pr)$_3$ |
| 250 | 0 | 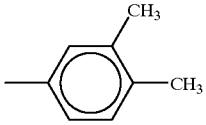 | 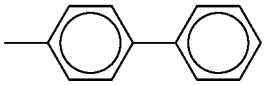 | — | — | 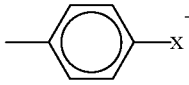 | —$(CH_2)_2COOCH_2$—<br>—$C_6H_4(CH_2)_2$—<br>—Si(O-i-Pr)$_3$ |

TABLE 51
| COMPOUND | k | $Ar^1$ | $Ar^2$ | $Ar^3$ | $Ar^4$ | $Ar^5$ | X |
|---|---|---|---|---|---|---|---|
| 251 | 1 | 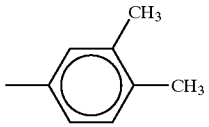 | 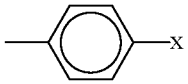 | 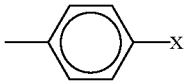 | 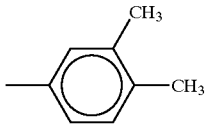 | 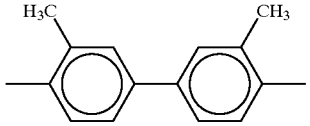 | —COO$(CH_2)_3$—<br>—Si(O-i-Pr)$_3$ |
| 252 | 1 | 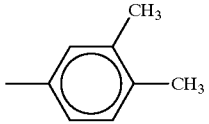 | 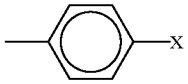 | 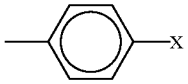 | 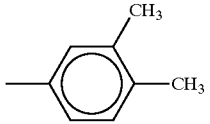 | 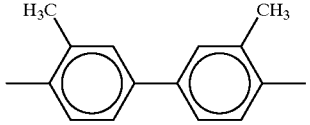 | —$COOCH_2C_6H_4$—<br>—$(CH_2)_2$—<br>—Si(O-i-Pr)$_3$ |
| 253 | 1 | 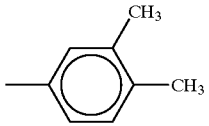 | 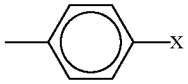 | 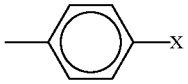 | 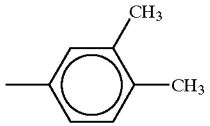 | 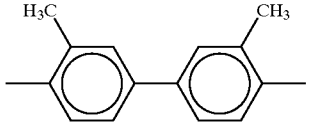 | —$CH_2COO(CH_2)_3$—<br>—Si(O-i-Pr)$_3$ |
| 254 | 1 | 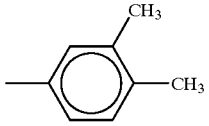 | 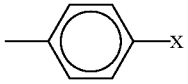 | 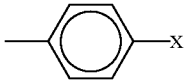 | 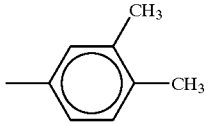 | 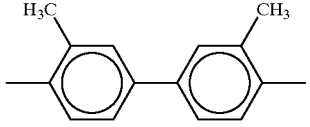 | —$CH_2COOCH_2$—<br>—$C_6H_4(CH_2)_2$—<br>—Si(O-i-Pr)$_3$ |
| 255 | 1 | 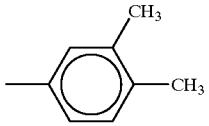 | 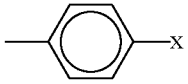 | 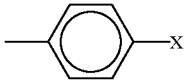 | 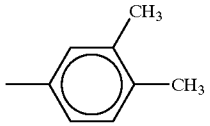 | 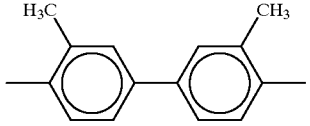 | —$(CH_2)_2COO$—<br>—$(CH_2)_3$—<br>—Si(O-i-Pr)$_3$ |

TABLE 52
| COMPOUND | k | $Ar^1$ | $Ar^2$ | $Ar^3$ | $Ar^4$ | $Ar^5$ | X |
|---|---|---|---|---|---|---|---|
| 256 | 1 | 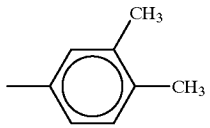 | 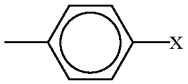 | 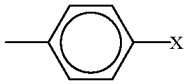 | 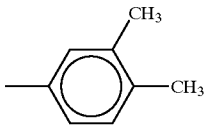 | 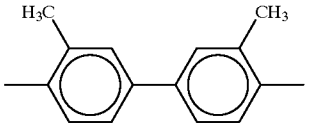 | —$(CH_2)_2COOCH_2$—<br>—$C_6H_4(CH_2)_2$—<br>—Si(O-i-Pr)$_3$ |
| 257 | 0 | 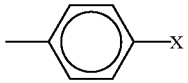 | 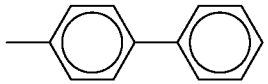 | — | — | 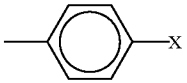 | —$COO(CH_2)_3$—<br>—Si(O-i-Pr)$_3$ |
| 258 | 0 | 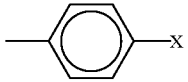 | 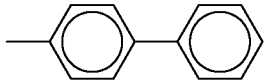 | — | — | 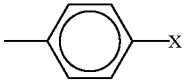 | —$COOCH_2C_6H_4$—<br>—$(CH_2)_2$—<br>—Si(O-i-Pr)$_3$ |
| 259 | 0 | 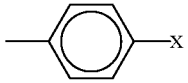 | 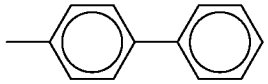 | — | — | 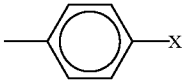 | —$CH_2COO(CH_2)_3$—<br>—Si(O-i-Pr)$_3$ |
| 260 | 0 | 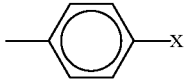 | 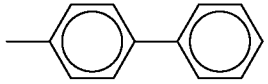 | — | — | 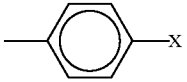 | —$CH_2COOCH_2$—<br>—$C_6H_4(CH_2)_2$—<br>—Si(O-i-Pr)$_3$ |

TABLE 53
| COMPOUND | k | $Ar^1$ | $Ar^2$ | $Ar^3$ | $Ar^4$ | $Ar^5$ | X |
|---|---|---|---|---|---|---|---|
| 261 | 0 | 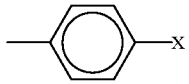 | 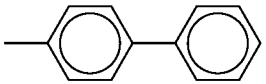 | — | — | 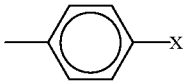 | —$(CH_2)_2COO$—<br>—$(CH_2)_3$—<br>—$Si(O\text{-}i\text{-}Pr)_3$ |
| 262 | 0 | 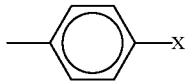 | 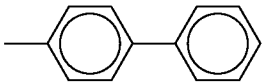 | — | — | 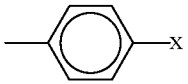 | —$(CH_2)_2COOCH_2$—<br>$C_6H_4(CH_2)_2$—<br>—$Si(O\text{-}i\text{-}Pr)_3$ |
| 263 | 1 | 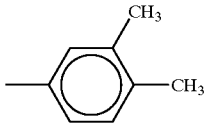 | 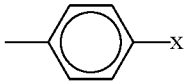 | 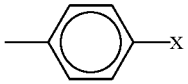 | 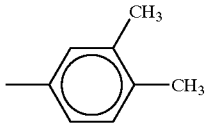 | 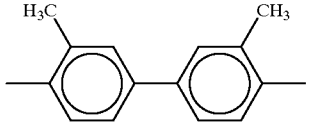 | —$COO(CH_2)_3$—<br>—$SiMe(O\text{-}i\text{-}Pr)_2$ |
| 264 | 1 | 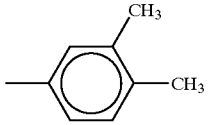 | 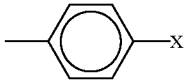 | 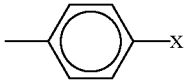 | 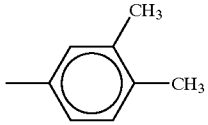 | 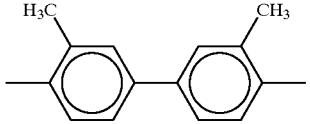 | —$COOCH_2C_6H_4$—<br>—$(CH_2)_2$—<br>$SiMe(O\text{-}i\text{-}Pr)_2$ |
| 265 | 1 | 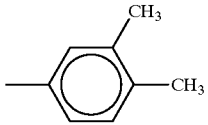 | 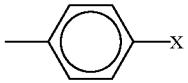 | 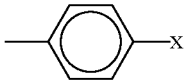 | 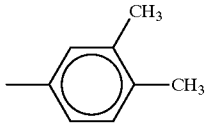 | 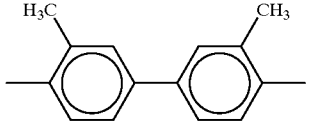 | —$CH_2COO(CH_2)_3$—<br>—$SiMe(O\text{-}i\text{-}Pr)_2$ |

TABLE 54
| COMPOUND | k | $Ar^1$ | $Ar^2$ | $Ar^3$ | $Ar^4$ | $Ar^5$ | X |
|---|---|---|---|---|---|---|---|
| 266 | 1 | 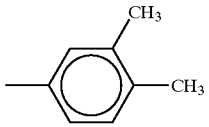 | 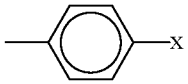 | 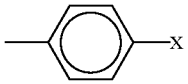 | 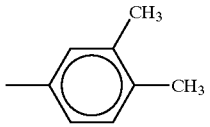 | 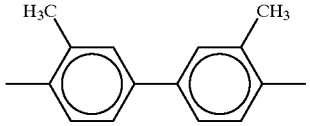 | —$CH_2COOCH_2$—<br>—$C_6H_4(CH_2)_2$—<br>—$SiMe(O\text{-}i\text{-}Pr)_2$ |
| 267 | 1 | 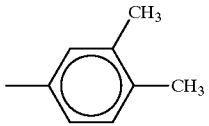 | 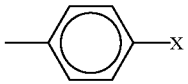 | 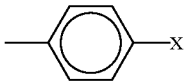 | 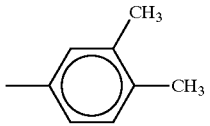 | 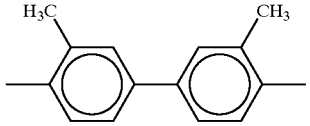 | —$(CH_2)_2COO$—<br>—$(CH_2)_3$—<br>—$SiMe(O\text{-}i\text{-}Pr)_2$ |
| 268 | 1 | 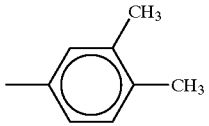 | 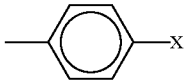 | 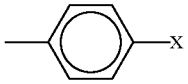 | 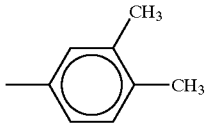 | 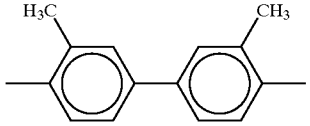 | —$(CH_2)_2COOCH_2$—<br>—$C_6H_4(CH_2)_2$—<br>—$SiMe(O\text{-}i\text{-}Pr)_2$ |
| 269 | 0 | 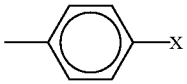 | 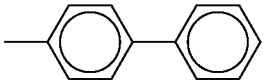 | — | — | 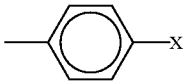 | —$COO(CH_2)_3$—<br>—$SiMe(O\text{-}i\text{-}Pr)_2$ |
| 270 | 0 | 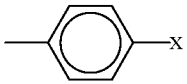 | 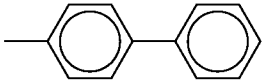 | — | — | 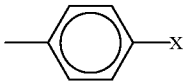 | —$COOCH_2C_6H_4$—<br>—$(CH_2)_2$—<br>—$SiMe(O\text{-}i\text{-}Pr)_2$ |

TABLE 55

| COMPOUND | k | $Ar^1$ | $Ar^2$ | $Ar^3$ | $Ar^4$ | $Ar^5$ | X |
|---|---|---|---|---|---|---|---|
| 271 | 0 | 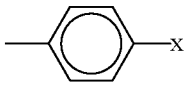 | 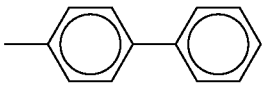 | — | — | 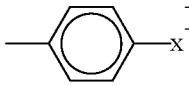 | —$CH_2COO(CH_2)_3$— —SiMe(O-i-Pr)$_2$ |
| 272 | 0 | 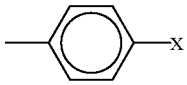 | 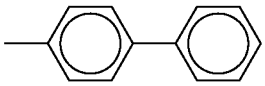 | — | — | 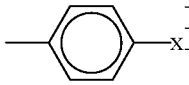 | —$CH_2COOCH_2$— —$C_6H_4(CH_2)_2$— —SiMe(O-i-Pr)$_2$ |
| 273 | 0 | 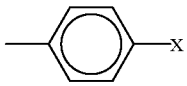 | 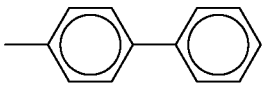 | — | — | 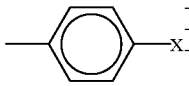 | —$(CH_2)_2COO$— —$(CH_2)_3$— —SiMe(O-i-Pr)$_2$ |
| 274 | 0 | 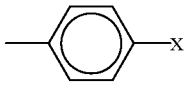 | 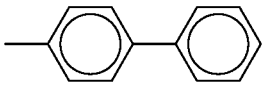 | — | — | 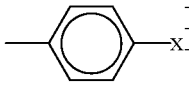 | —$(CH_2)_2COOCH_2$— —$C_6H_4(CH_2)_2$— —SiMe(O-i-Pr)$_2$ |

Specific examples of the compound in which the organic group in formula (I) is represented by formula (III-1) or (III-2) are shown in Tables 56 to 59 below. However, these specific examples are not critical in the invention. Incidentally, numbers of Example Compounds indicated in Examples to be described later are those in which "III-" is added to compound numbers in these tables. For instance, when the compound number is "12", the Example Compound number is "(III-12)".

In Tables 56 and 57, 1 to 8 and $Z^1$ correspond to 1 to 8 and $Z^1$ in formula (III-1), and S corresponds to —D—A in formula (I). Further, in Tables 58 and 59, 1 to 8, $Z^1$ and $Z^2$ correspond to 1 to 8, $Z^1$ and $Z^2$ in formula (III-2), and S corresponds to —D—A in formula (I).

In table 56 to 59 Me represents a —$CH_3$, Et represents —$C_2H_5$, and i-Pr represents isopropyl group.

TABLE 56

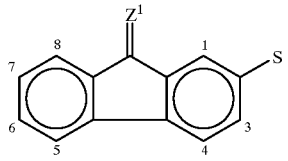

| COMPOUND | 1 | 3 | 4 | 5 | 6 | 7 | 8 | $Z^1$ | S |
|---|---|---|---|---|---|---|---|---|---|
| 1 | H | H | H | H | H | H | H | =O | —COO—$(CH_2)_3$— Si(OMe)$_3$ |
| 2 | H | H | H | H | H | H | H | =O | —COO—$(CH_2)_3$— Si(OEt)$_3$ |
| 3 | H | H | H | H | H | H | H | =O | —COO—$(CH_2)_3$— Si(O-i-Pr)$_3$ |
| 4 | H | H | H | H | H | H | H | =O | —COO—$CH_2C_6H_4$— $(CH_2)_2$—Si(OMe)$_3$ |
| 5 | H | H | H | H | H | $NO_2$ | H | =O | —COO—$(CH_2)_3$— Si(OMe)$_3$ |
| 6 | H | H | H | H | H | $NO_2$ | H | =O | —$(CH_2)_2$—COO—$(CH_2)_3$— Si(OMe)$_3$ |
| 7 | H | H | H | H | H | $NO_2$ | H | =O | —$(CH_2)_2$—COO—$(CH_2)_3$— Si(O-i-Pr)$_3$ |
| 8 | H | H | $NO_2$ | $NO_2$ | H | $NO_2$ | H | =O | —$(CH_2)_2$—COO—$(CH_2)_3$— Si(O-i-Pr)$_3$ |
| 9 | H | H | $NO_2$ | $NO_2$ | H | $NO_2$ | H | =O | —COO—$(CH_2)_3$— Si(OMe)$_3$ |
| 10 | H | H | H | H | H | H | H | =$(CN)_2$ | —COO—$(CH_2)_3$— Si(OMe)$_3$ |
| 11 | H | H | H | H | H | $NO_2$ | H | =$(CN)_2$ | —$(CH_2)_2$—COO—$(CH_2)_3$— Si(OMe)$_3$ |
| 12 | H | H | $NO_2$ | $NO_2$ | H | $NO_2$ | H | =$(CN)_2$ | —COO—$(CH_2)_3$— Si(OMe)$_3$ |

TABLE 57

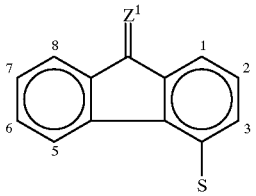

| COMPOUND | 1 | 2 | 3 | 5 | 6 | 7 | 8 | $Z^1$ | S |
|---|---|---|---|---|---|---|---|---|---|
| 13 | H | H | H | H | H | H | H | =O | —COO—$(CH_2)_3$—$Si(OMe)_3$ |
| 14 | H | H | H | H | H | H | H | =O | —COO—$(CH_2)_3$—$Si(OEt)_3$ |
| 15 | H | H | H | H | H | H | H | =O | —COO—$(CH_2)_3$—$Si(O\text{-}i\text{-}Pr)_3$ |
| 16 | H | H | H | H | H | H | H | =O | —COO—$CH_2C_6H_4$—$(CH_2)_2$—$Si(OMe)_3$ |
| 17 | H | H | H | H | H | $NO_2$ | H | =O | —COO—$(CH_2)_3$—$Si(OMe)_3$ |
| 18 | H | H | H | H | H | $NO_2$ | H | =O | —$(CH_2)_2$—COO—$(CH_2)_3$—$Si(OMe)_3$ |
| 19 | H | H | H | H | H | $NO_2$ | H | =O | —$(CH_2)_2$—COO—$(CH_2)_3$—$Si(O\text{-}i\text{-}Pr)_3$ |
| 20 | H | H | $NO_2$ | $NO_2$ | H | $NO_2$ | H | =O | —$(CH_2)_2$—COO—$(CH_2)_3$—$Si(O\text{-}i\text{-}Pr)_3$ |
| 21 | H | H | $NO_2$ | $NO_2$ | H | $NO_2$ | H | =O | —COO—$(CH_2)_3$—$Si(OMe)_3$ |
| 22 | H | H | H | H | H | H | H | =$(CN)_2$ | —COO—$(CH_2)_3$—$Si(OMe)_3$ |
| 23 | H | H | H | H | H | $NO_2$ | H | =$(CN)_2$ | —$(CH_2)_2$—COO—$(CH_2)_3$—$Si(OMe)_3$ |
| 24 | H | H | $NO_2$ | $NO_2$ | H | $NO_2$ | H | =$(CN)_2$ | —COO—$(CH_2)_3$—$Si(OMe)_3$ |

TABLE 58

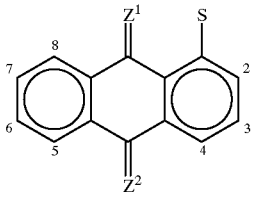

| COMPOUND | 2 | 3 | 4 | 5 | 6 | 7 | 8 | $Z^1$,$Z^2$ | S |
|---|---|---|---|---|---|---|---|---|---|
| 25 | H | H | H | H | H | H | H | =O | —COO—$(CH_2)_3$—$Si(OMe)_3$ |
| 26 | H | H | H | H | H | H | H | =O | —COO—$(CH_2)_3$—$Si(OEt)_3$ |
| 27 | H | H | H | H | H | H | H | =O | —COO—$(CH_2)_3$—$Si(O\text{-}i\text{-}Pr)_3$ |
| 28 | H | H | H | H | H | H | H | =O | —COO—$CH_2C_6H_4$—$(CH_2)_2$—$Si(OMe)_3$ |
| 29 | H | H | H | H | H | $NO_2$ | H | =O | —COO—$(CH_2)_3$—$Si(OMe)_3$ |
| 30 | H | H | H | H | H | $NO_2$ | H | =O | —$(CH_2)_2$—COO—$(CH_2)_3$—$Si(OMe)_3$ |
| 31 | H | H | H | H | H | $NO_2$ | H | =O | —$(CH_2)_2$—COO—$(CH_2)_3$—$Si(O\text{-}i\text{-}Pr)_3$ |
| 32 | H | H | $NO_2$ | $NO_2$ | H | $NO_2$ | H | =O | —$(CH_2)_2$—COO—$(CH_2)_3$—$Si(O\text{-}i\text{-}Pr)_3$ |
| 33 | H | H | $NO_2$ | $NO_2$ | H | $NO_2$ | H | =O | —COO—$(CH_2)_3$—$Si(OMe)_3$ |
| 34 | H | H | H | H | H | H | H | =$(CN)_2$ | —COO—$(CH_2)_3$—$Si(OMe)_3$ |

TABLE 58-continued

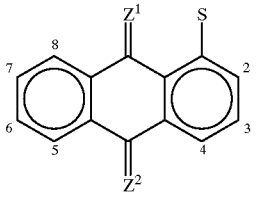

| COMPOUND | 2 | 3 | 4 | 5 | 6 | 7 | 8 | $Z^1,Z^2$ | S |
|---|---|---|---|---|---|---|---|---|---|
| 35 | H | H | H | H | H | $NO_2$ | H | $=(CN)_2$ | $—(CH_2)_2—COO—(CH_2)_3—Si(OMe)_3$ |
| 36 | H | H | $NO_2$ | $NO_2$ | H | $NO_2$ | H | $=(CN)_2$ | $—COO—(CH_2)_3—Si(OMe)_3$ |

TABLE 59

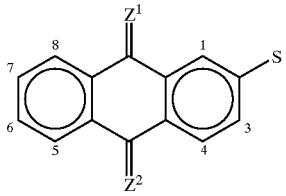

| COMPOUND | 2 | 3 | 4 | 5 | 6 | 7 | 8 | $Z^1,Z^2$ | S |
|---|---|---|---|---|---|---|---|---|---|
| 37 | H | H | H | H | H | H | H | $=O$ | $—COO—(CH_2)_3—Si(OMe)_3$ |
| 38 | H | H | H | H | H | H | H | $=O$ | $—COO—(CH_2)_3—Si(OEt)_3$ |
| 39 | H | H | H | H | H | H | H | $=O$ | $—COO—(CH_2)_3—Si(O\text{-}i\text{-}Pr)_3$ |
| 40 | H | H | H | H | H | H | H | $=O$ | $—COO—CH_2C_6H_4—(CH_2)_2—Si(OMe)_3$ |
| 41 | H | H | H | H | H | $NO_2$ | H | $=O$ | $—COO—(CH_2)_3—Si(OMe)_3$ |
| 42 | H | H | H | H | H | $NO_2$ | H | $=O$ | $—(CH_2)_2—COO—(CH_2)_3—Si(OMe)_3$ |
| 43 | H | H | H | H | H | $NO_2$ | H | $=O$ | $—(CH_2)_2—COO—(CH_2)_3—Si(O\text{-}i\text{-}Pr)_3$ |
| 44 | H | H | $NO_2$ | $NO_2$ | H | $NO_2$ | H | $=O$ | $—(CH_2)_2—COO—(CH_2)_3—Si(O\text{-}i\text{-}Pr)_3$ |
| 45 | H | H | $NO_2$ | $NO_2$ | H | $NO_2$ | H | $=O$ | $—COO—(CH_2)_3—Si(OMe)_3$ |
| 46 | H | H | H | H | H | H | H | $=(CN)_2$ | $—COO—(CH_2)_3—Si(OMe)_3$ |
| 47 | H | H | H | H | H | $NO_2$ | H | $=(CN)_2$ | $—(CH_2)_2—COO—(CH_2)_3—Si(OMe)_3$ |
| 48 | H | H | $NO_2$ | $NO_2$ | H | $NO_2$ | H | $=(CN)_2$ | $—COO—(CH_2)_3—Si(OMe)_3$ |

The optically functional organosilicon compounds represented by formula (I) may be used either singly or in combination.

For further improving the mechanical strengths of the cured film, it is advisable that a solution containing at least one of compounds having a group capable of being bound to the optically functional organosilicon compounds represented by formula (I) is added to the optically functional coating solution.

A solution containing at least one of compounds having a group capable of being bound to the optically functional organosilicon compounds represented by formula (I) may be added to the optically functional coating solution before being contacted with the solid catalyst for reaction, namely, the optically functional organosilicon compound-containing solution, or to the optically functional coating solution after separating the solid catalyst.

The group capable of being bound to the optically functional organosilicon compounds represented by formula (I) is a group capable of being bound to a silanol group generated when hydrolyzing the optically functional organosilicon compounds represented by formula (I). Specific examples thereof include a hydrolyzable group represented by $—Si(R^1)_{(3-a)}Q_a$, an epoxy group, an isocyanate group, a carboxyl group, a hydroxy group and a halogen. Of these, a hydrolyzable group represented by $—Si(R_1)_{(3-a)}Q_a$, an epoxy group and an isocyanate group are preferable because higher mechanical strengths can be provided.

The compounds having the group capable of being bound to the optically functional organosilicon compounds represented by formula (I) are preferably compounds having in a molecule two or more groups capable of being bound to the optically functional organosilicon compounds represented by formula (I) because the cured film comes to have a three-dimensional crosslinked structure, making it possible to obtain higher mechanical strengths.

The compounds having the group capable of being bound to the optically functional organosilicon compounds represented by formula (I) are preferably compounds represented by formula (IV).

$$B\text{-}[A']_n \qquad \text{(IV)}$$

wherein

A' represents a substituted silicon group having a hydrolyzable group represented by $—Si(R_1)_{(3-a)}Q_a$, B represents a divalent or higher hydrocarbon group which may be branched, a divalent or higher phenyl group, —NH—, —O—Si— or a combination thereof, a represents an integer of 1 to 3, and n is an integer of 2 or more.

The compounds represented by formula (IV) are compounds having two or more A' sites, namely, substituted silicon groups having the hydrolyzable group represented by $—Si(R_1)_{(3-a)}Q_a$. In the compounds represented by formula (IV), the moiety of the Si group contained in the A' site is reacted with the optically functional organosilicon compounds represented by formula (I) or the compounds represented by formula (IV) per se to give an Si—O—Si linkage and form the three-dimensional crosslinked cured film. Since the optically functional organosilicon compounds represented by formula (I) have also the same Si group, the cured film can be formed by the very compounds alone. However, since the compounds represented by formula (IV) have two or more A' sites, the cured film is considered to have the three-dimensional crosslinked structure whereby higher mechanical strengths are provided. Further, the A site, like the D site in the optically functional organosilicon compounds represented by formula (I), functions to give an appropriate flexibility to the cured film.

The compounds represented by formula (IV) are preferably compounds shown in the following structure group 5.

Structure Group 5

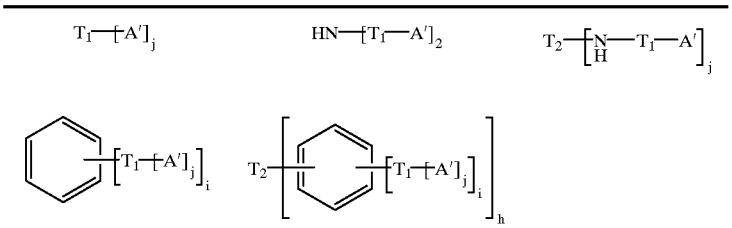

In the structure group 5, $T_1$ and $T_2$, independently from each other, represent a divalent or trivalent hydrocarbon group which may be branched. A' represents a substituted silicon group having a hydrolyzable group represented by $—Si(R_1)_{(3-a)}Q_a$, and h, i and j, independently from each other, represent an integer of 1 to 3 and selected such that the number of A' in the molecule is 2 or more.

Specific examples of the compounds represented by formula (IV) are shown below. However, these specific examples are not critical in the invention.

In below table , Me represents a $—CH_3$, Et represents $—C_2H_5$, and i-Pr represents isopropyl group.

IV-1

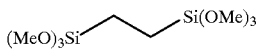

IV-2

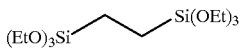

IV-3

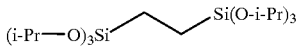

IV-4

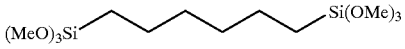

-continued

IV-5 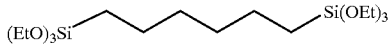

IV-6 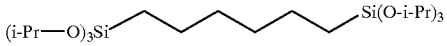

IV-7 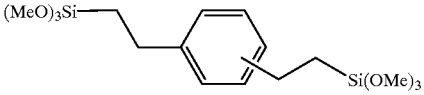

IV-8 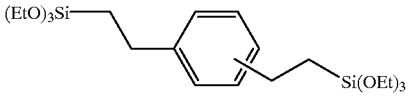

IV-9 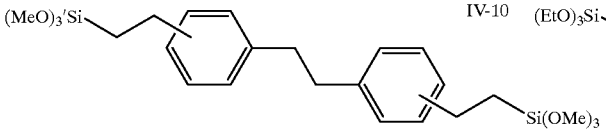

IV-10 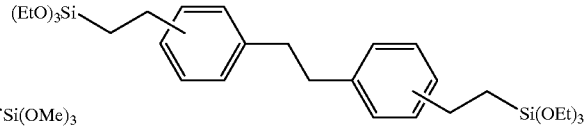

IV-11 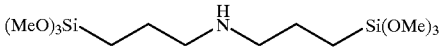

IV-12 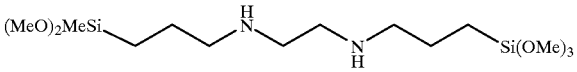

IV-13 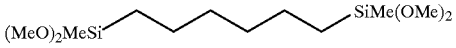

IV-14 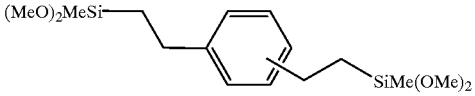

IV-15 $(MeO)_3SiC_3H_6—O—CH_2CH\{—O—C_3H_6Si(OMe)_3\}—CH_2\{—O—C_3H_6Si(OMe)_3\}$

IV-16 $(MeO)_3SiC_2H_4—SiMe_2—O—SiMe_2—O—SiMe_2—C_2H_4Si(OMe)_3$

As the compounds having the group capable of being bound to the optically functional organosilicon compounds represented by formula (I), a polymer having a group capable of being bound to the optically functional organosilicon compounds represented by formula (I) is mentioned for easily adjusting the viscosity and controlling the film thickness.

When the molecular weight of the polymer having the group capable of being bound to the optically functional organosilicon compounds represented by formula (I) is too low, mechanical strengths are sometimes decreased. Thus, it is preferably 1,000 or more, calculated as styrene. Further, when it is too high, the viscosity of the solution is hardly adjusted. Thus, it is preferably 2,000,000 or less.

The polymer having the group capable of being bound to the optically functional organosilicon compounds represented by formula (I) is, for example, a polymer containing a substituted silicon group having a hydrolyzable group represented by $—Si(R_1)_{(3-a)}Q_a$. Such a polymer can specifically be formed from a monomer containing a substituted silicon group having a hydrolyzable group represented by $—Si(R_1)_{(3-a)}Q_a$ (for example, methacryloxypropyltrimethoxysilane, methacryloxypropyltriethoxysilane, methacryloxypropylmethyldimethoxysilane or styrylethyltrimethoxysilane) by a known method using azobisisobutyronitrile or benzoyl peroxide. Further, this monomer can be mixed with a monomer such as methyl methacrylate, methyl acrylate, styrene or acrylonitrile at an optional ratio to form a copolymer.

In the step of producing the optically functional coating solution, it is advisable to add at least one curing catalyst for obtaining the cured film having high mechanical strengths at good efficiency. This curing catalyst may be added to the optically functional coating solution before being contacted with the solid catalyst for reaction, namely, the optically functional organosilicon compound-containing solution, or to the optically functional coating solution after separating the solid catalyst.

Examples of the curing catalyst include protonic acids such as hydrochloric acid, acetic acid, phosphoric acid and sulfuric acid; bases such as ammonia and triethylamine; organotin compounds such as dibutyltin diacetate, dibutyltin dioctoate and stannous octoate; organotitanium compounds such as tetra-n-butyl titanate and tetraisopropyl titanate; organoaluminum compounds such as aluminum tributoxide and aluminum trisacetylacetonate; and iron salts, manganese salts, cobalt salts, zinc salts and zirconium salts of organic carboxylic acids. In view of the storage stability, metallic compounds are preferable, and metal acetylacetonates and metal acetylacetates are more preferable.

In the step of producing the optically functional coating solution, the amount of the curing catalyst used can optionally be determined. In view of the storage stability, the characteristics and the strengths, it is preferably between 0.1 and 20% by weight, more preferably between 0.3 and 10% by weight based on the total amount of the material containing the hydrolyzable silicon substituent.

In the step of producing the optically functional coating solution, the optically functional coating solution can be produced in the absence of a solvent, or as required, in the presence of one or more solvents selected from alcohols such as methanol, ethanol, propanol and butanol, ketones such as acetone and methyl ethyl ketone, and ethers such as tetrahydrofuran, diethyl ether and dioxane. A solvent having a boiling point of 150° C. or less is preferably used. The amount of the solvent can optionally be determined. However, when the amount of the solvent is too small, the optically functional organosilicon compounds tend to precipitate. Accordingly, it is between 0.5 and 30 parts, preferably between 1 and 20 parts per part of the optically functional organosilicon compounds.

In the step of producing the optically functional coating solution, the reaction temperature and the reaction time at which to contact the optically functional organosilicon compound-containing solution and as required, the other compounds with the solid catalyst for reaction vary depending on the types of the starting materials. It is usually between 0 and 100° C., preferably between 5 and 70° C., especially preferably between 10 and 50° C. Further, the reaction time is not particularly limited. However, when the reaction time is long, gelation tends to occur. Thus, it is preferably between 10 minutes and 100 hours.

In the step of producing the optically functional coating solution, the optically functional organosilicon compound-containing solution and the other compounds which are added along with this solution may be all mixed at the same time and contacted with the solid catalyst for reaction. Alternatively, for adjusting the degree of the reaction, these may consecutively be added, or may be added after the solid catalyst is removed. In case of adding the polymer having the group capable of being bound to the optically functional organosilicon compounds represented by formula (I), the gelation is, in some cases, extremely accelerated to make the coating difficult when the solid catalyst and the polymer are present at the same time. For this reason, it is advisable that the polymer is added after removal of the solid catalyst.

In the step of producing the optically functional coating solution, the solid catalyst finally separated is not particularly limited so long as the catalyst component is insoluble in all of the optically functional organosilicon compound-containing solution, the other compounds, water, the reaction product and the solvent. Specific examples of this solid catalyst are as follows.

- Cation exchange resins: Amberlite 15, Amberlite 200C and Amberlist 15 (made by Rohm & Haas Co.); Dowex MWC-1-H, Dowex 88 and Dowex HCR-W2 (made by Dow Chemical); Levatit SPC-108 and Levatit SPC-118 (made by Bayer AG); Diaion RCP-150H (made by Mitsubishi Kasei Corp.); Sumicaion KC-470, Duolite C26-C, Duolite C-433 and Duolite-464 (made by Sumitomo Chemical Co., Ltd.); Nafion-H (made by du Pont); and Purolite (made by A. M. P. Ionex)
- Anion exchange resins: Amberlite IRA-400 and Amberlite IRA-45 (made by Rohm & Haas Co.)
- Inorganic solids to which surface a group containing a protonic acid group is bound: $Zr(O_3PCH_2CH_2SO_3H)_2$ and $Th(O_3PCH_2CH_2COOH)_2$
- Polyorganosiloxanes having a protonic acid group: polyorganosiloxane having a sulfonic acid group
- Heteropolyacids: cobalttungstic acid and phosphorusmolybdic acid
- Isopolyacids: niobic acid, tantalic acid and molybdic acid
- Simple metal oxides; silica gel, alumina, cromia, zirconia, CaO and MgO
- Composite metal oxides: silica-alumina, silica-magnesia, silica-zirconia and zeolites
- Clay minerals: acid clay, activated clay, montmorillonite and kaolinite
- Metal sulfates: $LiSO_4$ and $MgSO_4$
- Metal phosphates: zirconium phosphate and lanthanum phosphate
- Metal nitrates: $LiNO_3$ and $Mn(NO_3)_2$
- Inorganic solids to which surface a group containing an amino group is bound: solids obtained by reacting aminopropyltriethoxysilane on silica gel
- Polyorganosiloxane having an amino group: amino-modified silicone resin In the step of producing the optically functional coating solution, the reaction (mainly the hydrolytic condensation reaction) is conducted using at least one of the solid catalysts. With respect to the method in which the reaction is conducted through contact with the solid catalyst, the reaction may be conducted through circulation or batchwise by placing the solid catalyst in a fixed bed. The use amount of the solid catalyst is not particularly limited. It is preferably between 0.001 and 20% by weight, especially preferably between 0.01 and 10% by weight based on the total amount of the material containing the hydrolyzable silicon substituent.

In the step of producing the optically functional coating solution, the amount of water added in the hydrolytic condensation reaction is not particularly limited. However, since water influences the storage stability of the product and the inhibition of the gelation in the polymerization, the amount of water is preferably between 30 and 500%, more preferably between 50 and 300% of the theoretical amount required for hydrolyzing all of hydrolyzable groups of the material containing the hydrolyzable silicon substituent. When the amount of water is more than 500%, the storage stability of the product is decreased, or the optically functional organosilicon compounds tend to precipitate. Meanwhile, when the amount of water is less than 30%, the amounts of the unreacted compounds are increased to cause phase separation in coating and curing the coating solution or to decrease the strengths. Further, for improving the storage stability, it is advisable to mix alcohols.

In the step of producing the optically functional coating solution, it is effective, for improving the compatibility of the resulting cured film, to allow the solution to stand for more than 1 hour from the removal of the solid catalyst to the coating. The time for which to allow the solution to stand is between 1 and 250 hours, preferably between 2 and 200 hours.

In the step of forming the cured film, the optically functional coating solution is coated, and cured to form the cured film. The curing temperature can optionally be determined. However, for obtaining desired strengths, the curing temperature is 60° C. or higher, more preferably 80° C. or higher. The curing time can optionally be determined as required. It is preferably between 10 minutes and 5 hours. Further, it is effective that after the curing reaction, the high humidity is maintained and the specific stabilization is conducted. Still further, the hydrophobic nature can be imparted in some use by conducting surface treatment with hexamethyldisilazane or trimethylchlorosilane (Electrophotographic photoreceptor)

The electrophotographic photoreceptor of the invention has at least one layer made of the cured film which is formed by the process for producing the electrophotographic photoreceptor, namely, the step of forming the cured film in the invention.

The layer made of the cured film can be formed on the conductive support as any layer formed by the step of forming the cured film [for example, an undercoat layer, a photoreceptive layer (a photoreceptive single layer or a photoreceptive laminated layer (a charge-generating layer or a charge transfer layer)) or a surface-protecting layer]. Since the cured film obtained by the step of forming the cured film has excellent mechanical strengths and also satisfactory photoelectric characteristics, it can directly be used as a charge transfer layer of a photoreceptive laminated layer, an undercoat layer or a surface-protecting layer, or as a charge-generating layer by adding a charge-generating material. However, for improving the characteristics, various materials may be used in combination as will be described later. Further, when a necessary film thickness is not obtained by one coating in the formation of each layer, the necessary film thickness can be obtained by plural coatings. In case of the plural coatings, the heat treatment can be conducted whenever the coating is conducted or after the plural coatings are conducted.

The conductive support is described below.

Examples of the conductive support include metals such as aluminum, nickel, chromium and stainless steel; plastic films having thin films of aluminum, titanium, nickel, chromium, stainless steel, gold, vanadium, tin oxide, indium oxide and ITO; and paper and plastic films having a conductive agent coated thereon or dipped therein. These conductive supports take appropriate forms of a drum, a sheet and a plate. However, these forms are not critical. Further, the surface of the conductive support can be subjected to various treatments unless the image qualities are thereby influenced as required. For example, surface oxidation treatment, chemical treatment, coloration treatment and irregular reflection treatment such as sanding can be conducted.

The undercoat layer is described below.

The undercoat layer is mainly used for the following purposes. 1) It inhibits injection of an unnecessary carrier from the support to improve image qualities. 2) Stable image qualities are obtained without causing environmental change of a light decay curve of a photoreceptor. 3) It has an appropriate charge transferability, so that a charge is not accumulated even in long-term repetitive use and a photoreceptivity is not changed. 4) It has an appropriate resistance to a charge voltage so as not to give a defective image owing to insulation breakdown. 5) It acts as an adhesive layer by which the photoreceptive layer is integrally adhered to the support. 6) It acts to prevent reflected light of the support in some cases.

When the cured film is formed as the undercoat layer, other materials indicated below may be added as required in the step of producing the optically functional coating solution. Examples of the other materials include organozirconium compounds such as a zirconium chelate compound, a zirconium alkoxide compound and a zirconium coupling agent; organotitanium compounds such as a titanium chelate compound, a titanium alkoxide compound and a titanate coupling agent; organoaluminum compounds such as an aluminum chelate compound and an aluminum coupling agent; and organometallic compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide compound. Especially, organozirconium compounds, organotitanyl compounds and organoaluminum compounds are preferably used because good electrophotographic characteristics are exhibited with a low residual voltage.

Further, a silane coupling agent can be used. Examples of the silane coupling agent include vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercapropropyltrimethoxysilane, γ-ureidopropyltriethoxysilane and β-3,4-epoxycyclohexyltrimethoxysilane. Further, a known binder resin which is ordinarily used in the undercoat layer is also available. Examples of the binder resin include polyvinyl alcohol, polyvinylmethyl ether, poly-N-vinylimidazole, polyethylene oxide, ethyl cellulose, methyl cellulose, an ethylene-acrylic acid copolymer, a polyamide, a polyimide, casein, gelatin, polyethylene, a polyester, a phenolic resin, a vinyl chloride-vinyl acetate copolymer, an epoxy resin, polyvinyl pyrrolidone, polyvinyl pyridine, polyurethane, polyglutamic acid and polyacrylic acid.

When the cured film is formed as the undercoat layer, the amounts of the other materials can be determined as required. When the amounts of the optically functional organosilicon compounds represented by formula (I) are 10% by weight or more, preferably 20% by weight or more, the electrical characteristics are excellent. Thus, it is especially preferable.

When the cured film is formed as the undercoat layer, an electron-transferring pigment can be mixed and dispersed in the step of producing the optically functional coating solution. Examples of the electron-transferring pigment include organic pigments such as a perylene pigment, a benzimidazole perylene pigment, a polycyclic quinone pigment, an indigo pigment and a quinacridone pigment as described in Japanese Patent Laid-Open No. 30330/1972; organic pigments such as a bisazo pigment having an electron attractive substituent, for example, a cyano group, a nitro group, a nitroso group or a halogen atom and a phthalocyanine pigment; and inorganic pigments such as zinc oxide and titanium oxide. Of these pigments, a perylene pigment, a bisbenzoimidazole perylene pigment and a polycyclic quinone pigment are preferably used because of a high electron transferability.

In the step of producing the optically functional coating solution, the electron-transferring pigment can be mixed and dispersed by a method in which the electron-transferring pigment is dispersed in the solution containing the optically functional organosilicon compounds represented by formula (I), a method in which the compounds represented by formula (I) are added to the dispersion of the electron-transferring pigment to mix them, a method in which the compounds represented by formula (I) are added to the dispersion of the electron-transferring pigment in the resin to mix them, a method in which the compounds represented by formula (I) are added to the resin solution to mix them, and the electron-transferring pigment is then dispersed in the mixture, or a method in which the compounds represented by formula (I) are added to the electron-transferring pigment to mix them, and the mixture is dispersed in the resin solution. It is important that when the coating solution is formed by mixing and dispersing, gelation or agglomeration does not occur. When the amount of the electron-transferring pigment is too large, the strengths of the undercoat layer are decreased to form a defective coated film. Thus, the amount of the electron-transferring pigment is 95% by weight or less, preferably 90% by weight or less.

The electron-transferring pigment is mixed and dispersed by an ordinary method using a ball mill, a roller mill, a sand mill, an attritor or an ultrasonic wave. The pigment is mixed and dispersed in an organic solvent. In this instance, any organic solvent can be used so long as it dissolves an organometallic compound and a resin and gelation or agglomeration does not occur when the electron-transferring pigment is mixed and dispersed. Examples of the organic solvent include ordinary organic solvents such as methanol, ethanol, n-propanol, n-butanol, benzyl alcohol, methyl cellosolve, ethyl cellosolve, acetone, methyl ethyl ketone, cyclohexane, methyl acetate, n-butyl acetate, dioxane, tetrahydrofuran, methylene chloride, chloroform, chlorobenzene and toluene. These can be used either singly or in combination.

The thickness of the undercoat layer is generally between 0.1 and 20 μm, preferably between 0.2 and 10 μm. The coating in forming the undercoat layer can be conducted by an ordinary method such as a blade coating method, a Mayer bar coating method, a spray coating method, a dip coating method, a bead coating method, an air knife coating method or a curtain coating method.

The charge-generating layer is described below.

When the cured film is formed as the charge-generating layer, the dispersion of the pigment (charge-generating material) and as required, a binder resin are added in the step of producing the optically functional coating solution. Consequently, a charge-generating layer having a dispersion stability of the pigment, an increased photoreceptivity and stabilized electrical characteristics is formed. Further, when the pigment is treated with the optically functional organosilicon compounds represented by formula (I), the same effects are provided.

As the charge-generating material, known materials are all available. Especially, metal and non-metal phthalocyanine pigments are preferable. Of these, hydroxygallium phthalocyanine, chlorogallium phthalocyanine, dichlorotin phthalocyanine and titanyl phthalocyanine having specific crystals are especially preferable.

Chlorogallium phthalocyanine can be produced, as disclosed in Japanese Patent Laid-Open No. 98181/1993, by mechanically dry-milling chlorogallium phthalocyanine crystals formed in a known manner through an automatic mortar, a planetary mill, a vibration mill, a CF mill, a roller mill, a sand mill or a kneader, or wet-milling the same along with a solvent through a ball mill, a mortar, a sand mill or a kneader after dry-milling. Examples of the solvent used in the wet-milling include aromatics such as toluene and chlorobenzene; amides such as dimethylformamide and N-methylpyrrolidone; aliphatic alcohols such as methanol, ethanol and butanol; aliphatic polyhydric alcohols such as ethylene glycol, glycerin and polyethylene glycol; aromatic alcohols such as benzyl alcohol and phenetyl alcohol; esters such as acetate esters and butyl acetate; ketones such as acetone and methyl ethyl ketone; dimethyl sulfoxide; ethers such as diethyl ether and tetrahydrofuran; mixtures of these organic solvents; and mixtures of water and these organic solvents. The amount of the solvent used in the wet-milling treatment is between 1 and 200 parts, preferably between 10 and 100 parts based on chlorogallium phthalocyanine. The milling temperature is between 0° C. and the boiling point of the solvent, preferably between 10 and 60° C. Further, in the milling, a milling aid such as sodium chloride or Glauber's salt can be used. The amount of the milling aid is between 0.5 and 20 times, preferably 1 and 10 times as large as the amount of the pigment.

Dichlorotin phthalocyanine can be produced, as disclosed in Japanese Patent Laid-Open Nos. 140472/1993 and 140473/1993, by milling dichlorotin phthalocyanine crystals formed by a known method and subjecting the resulting product to the same milling and solvent treatment as in the chlorogallium phthalocyanine.

Hydroxygallium phthalocyanine can be produced, as disclosed in Japanese Patent Laid-Open Nos. 263007/1993 and 279591/1993, by subjecting chlorogallium phthalocyanine crystals formed by a known method to hydrolysis in an acid or alkaline solution and acid pasting to obtain hydroxygallium phthalocyanine crystals and directly treating the same with a solvent, or wet-milling hydroxygallium phthalocyanine crystals obtained by synthesis along with a solvent using a ball mill, a mortar, a sand mill or a kneader, or dry-milling the same without using a solvent and then conducting the solvent treatment. Examples of the solvent used in the solvent treatment include aromatics such as toluene and chlorobenzene; amides such as dimethylformamide and N-methylpyrrolidone; aliphatic alcohols such as methanol, ethanol and butanol; aliphatic polyhydric alcohols such as ethylene glycol, glycerin and polyethylene glycol; aromatic alcohols such as benzyl alcohol and phenetyl alcohol; esters such as acetate esters and butyl acetate; ketones such as acetone and methyl ethyl ketone; dimethyl sulfoxide; ethers such as diethyl ether and tetrahydrofuran; mixtures of these organic solvents; and mixtures of water and these organic solvents. The amount of the solvent used in the solvent treatment is between 1 and 200 parts by weight, preferably between 10 and 100 parts by weight based on hydroxygallium phthalocyanine. The treatment temperature is between 0 and 150° C., preferably between room temperature and 100° C. Further, in the milling, a milling aid such as sodium chloride or Glauber's salt can be used. The amount of the milling aid is between 0.5 and 20 times, preferably 1 and 10 times as large as the amount of the pigment.

Oxytitanyl phthalocyanine can be produced, as disclosed in Japanese Patent Laid-Open Nos. 189873/1992 and 43813/1993, by subjecting oxytitanyl phthalocyanine crystals formed by a known method to acid pasting or salt milling along with an inorganic salt using a ball mill, a mortar, a sand mill or a kneader to form oxytitanyl phthalocyanine crystals having a peak at 27.2 in the X-ray diffraction spectrum with a relatively low crystallinity, and then directly treating the same with a solvent or wet-milling the same along with a solvent using a ball mill, a mortar, a sand mill or a kneader. The acid used in the acid pasting is preferably sulfuric acid, and sulfuric acid having a concentration of 70 to 100%, preferably 95 to 100% is used. The dissolution is conducted at −20 to 100° C., preferably 0 to 60° C. The amount of conc. sulfuric acid is between 1 and 100 times, preferably between 3 and 50 times as large as the amounts of the oxytitanyl phthalocyanine crystals. As a solvent for precipitation, water or a mixed solvent of water and an organic solvent is used in an optional amount. A mixed solvent of water and an alcohol solvent such as methanol or ethanol or of water and an aromatic solvent such as benzene or toluene is especially preferable. The precipitation temperature is not particularly limited. For preventing heat generation, cooling with ice is preferable. Further, a ratio of oxytitanyl phthalocyanine crystals to inorganic salt is between 1/0.1 and 1/20, preferably between 1/0.5 and 1/5 in terms of a weight ratio. Examples of the solvent used in this solvent treatment include aromatics such as toluene and chlorobenzene; aliphatic alcohols such as methanol, ethanol and butanol; halogenated hydrocarbons such as dichloromethane, chloroform and trichloroethane; mixtures of these organic solvents; and mixtures of water and these organic solvents. The amount of the solvent is between 1 and 100 parts by weight, preferably between 5 and 50 parts by weight based on oxytitanyl phthalocyanine. The temperature of the treatment is between room temperature and 100° C., preferably between 50 and 100° C. The amount of the milling aid is between 0.5 and 20 times, preferably 1 and 10 times as large as the amount of the pigment.

The binder resin can be selected from a wide variety of insulating resins so long as they can be cured with the optically functional organosilicon compounds represented by formula (I). Further, it can be selected from organic photoconductive polymers such as poly-N-vinylcarbazole, polyvinylanthracene, polyvinylpyrene and polysilane. Preferable examples of the binder resin include insulating resins such as a polyvinyl butyral resin, a polyacrylate resin (a polycondensate of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin and a polyvinyl pyrrolidone resin. Especially, resins having a hydroxyl group that tends to allow a reaction such as crosslinking with an organometallic compound are preferable. These binder resins can be used either singly or in combination.

The mixing ratio (weight ratio) of the charge-generating material and the optically functional organosilicon compounds (binder resins) represented by formula (I) is preferably between 10:1 and 1:10. Further, these can be dispersed by an ordinary method such as a ball mill dispersion method, an attritor dispersion method or a sand mill dispersion method. At this time, it is required that the crystal form is not changed by the dispersion. It has been identified that the crystal form is unchanged before and after the dispersion in any of the dispersion methods practiced in the invention. Further, in this dispersion, the particle size is 0.5 $\mu$m or less, preferably 0.3 $\mu$m or less, more preferably 0.15 $\mu$m or less. Examples of the solvent used in the dispersion include ordinary organic solvents such as methanol, ethanol, n-propanol, n-butanol, benzyl alcohol, methyl cellosolve, ethyl cellosolve, acetone, methyl ethyl ketone, cyclohexane, methyl acetate, n-butyl acetate, dioxane, tetrahydrofuran, methylene chloride, chloroform, chlorobenzene and toluene. These can be used either singly or in combination.

The thickness of the charge-generating layer is generally between 0.1 and 5 $\mu$m, preferably between 0.2 and 2.0 $\mu$m. Examples of the coating method used in forming the charge-generating layer include ordinary methods such as a blade coating method, a Mayer bar coating method, a spray coating method, a dip coating method, a bead coating method, an air knife coating method and a curtain coating method.

The charge transport layer is described below.

When the cured film is formed as the charge transport layer, a charge-transporting material and a binder resin may be added in the step of producing the optically functional coating solution.

Examples of the charge-transporting material include electron-transporting compounds, for example, quinone compounds such as p-benzoquinone, chloranil, bromanil and anthraquinone, tetracyanoquinodimethane compounds, fluorenone compounds such as 2,4,7-trinitrofluorenone, xanthone compounds, benzophenone compounds, cyanovinyl compounds and ethylenic compounds; and hole-transporting compounds, for example, triarylamine compounds, benzidine compounds, arylalkane compounds, aryl-substituted ethylenic compounds, stilbene compounds, anthracene compounds and hydrazone compounds. These charge-transporting materials can be used either singly or in combination. However, they are not critical. Further, these charge-transporting materials can be used either singly or in combination.

Among the charge-transporting materials, triphenylamine compounds represented by formula (V) and benzidine compounds represented by formula (VI) are especially preferable because of the high charge (hole) transportability and the excellent stability.

(V)

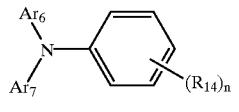

wherein $R_{14}$ represents a hydrogen atom or a methyl group, n represents 1 or 2, and $Ar^6$ and $Ar^7$, independently from each other, represent a substituted or unsubstituted aryl group in which a substituent is a halogen atom, an alkyl group having 1 to 5 carbon atoms, an alkoxy group having 1 to 5 carbon atoms or an amino group substituted with an alkyl group having 1 to 3 carbon atoms.

(VI)

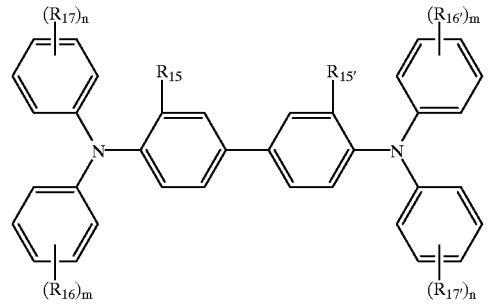

wherein $R_{15}$ and $R_{15}$', independently from each other, represent a hydrogen atom, a halogen atom, an alkyl group having 1 to 5 carbon atoms or an alkoxy group having 1 to 5 carbon atoms, $R_{16}$, $R_{16}$', $R_{17}$ and $R_{17}$', independently from each other, represent a hydrogen atom, a halogen atom, an alkyl group having 1 to 5 carbon atoms, an alkoxy group having 1 to 5 carbon atoms or an amino group substituted with an alkyl group having 1 or 2 carbon atoms, and m and n, independently from each other, represent 0, 1 or 2.

Specific examples of the triphenylamine compounds represented by formula (V) are shown in Tables 60 to 62 below. However, these specific examples are not critical in the invention. Incidentally, numbers of Example Compounds indicated in Examples to be described later are those in which "V-" is added to compound numbers in these tables. For instance, when the compound number is "12", the Example Compound number is "(V-12)".

TABLE 60
| COMPOUND No. | $R_{14}$ | $Ar_6$ | $Ar_7$ |
|---|---|---|---|
| 1<br>2 | 4—$CH_3$<br>3,4—$CH_3$ | 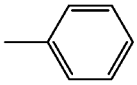 | 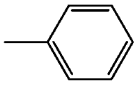 |
| 3<br>4 | 4—$CH_3$<br>3,4—$CH_3$ | 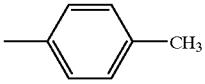 | 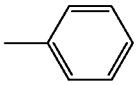 |
| 5<br>6 | 4—$CH_3$<br>3,4—$CH_3$ | 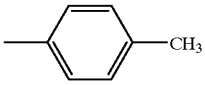 | 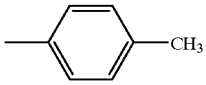 |
| 7<br>8 | 4—$CH_3$<br>3,4—$CH_3$ | 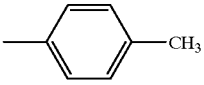 | 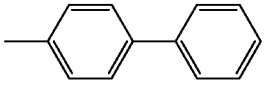 |
| 9<br>10 | 4—$CH_3$<br>3,4—$CH_3$ | 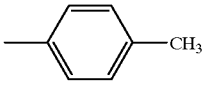 | 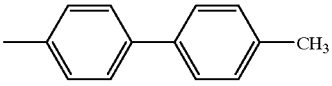 |
| 11<br>12 | 4—$CH_3$<br>3,4—$CH_3$ | 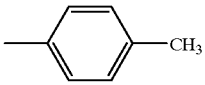 | 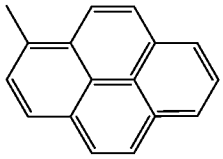 |
| 13<br>14 | 4—$CH_3$<br>3,4—$CH_3$ | 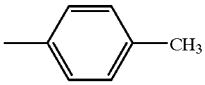 | 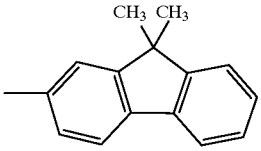 |
| 15<br>16 | 4—$CH_3$<br>3,4—$CH_3$ | 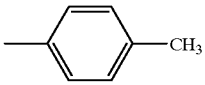 | 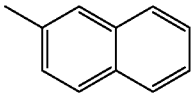 |
| 17<br>18 | 4—$CH_3$<br>3,4—$CH_3$ | 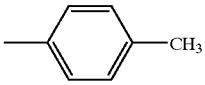 | 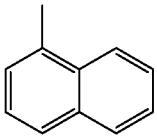 |
| 19<br>20 | 4—$CH_3$<br>3,4—$CH_3$ | 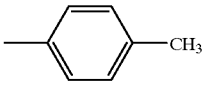 | 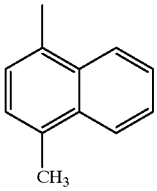 |

TABLE 60-continued
| COMPOUND No. | $R_{14}$ | $Ar_6$ | $Ar_7$ |
|---|---|---|---|
| 21<br>22 | 4—$CH_3$<br>3,4—$CH_3$ | 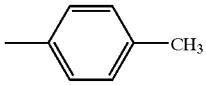 | 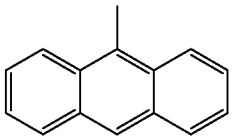 |
| 23<br>24 | 4—$CH_3$<br>3,4—$CH_3$ | 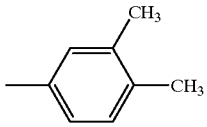 | 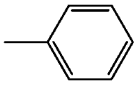 |
TABLE 61
| COMPOUND No. | $R_{14}$ | $Ar_6$ | $Ar_7$ |
|---|---|---|---|
| 25<br>26 | 4—$CH_3$<br>3,4—$CH_3$ | 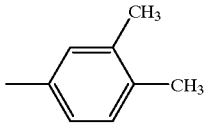 | 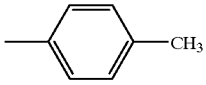 |
| 27<br>28 | 4—$CH_3$<br>3,4—$CH_3$ | 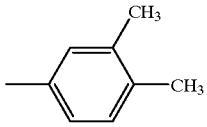 | 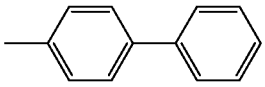 |
| 29<br>30 | 4—$CH_3$<br>3,4—$CH_3$ | 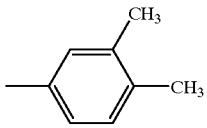 | 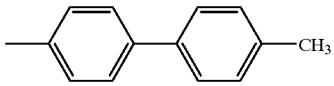 |
| 31<br>32 | 4—$CH_3$<br>3,4—$CH_3$ | 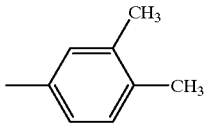 | 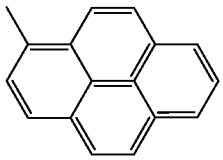 |
| 33<br>34 | 4—$CH_3$<br>3,4—$CH_3$ | 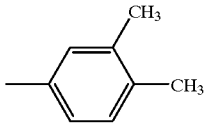 | 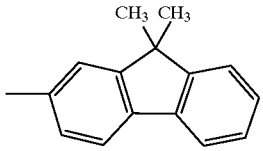 |
| 35<br>36 | 4—$CH_3$<br>3,4—$CH_3$ | 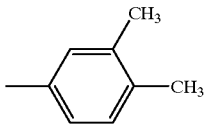 | 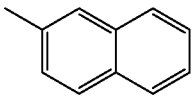 |

TABLE 61-continued
| COMPOUND No. | $R_{14}$ | $Ar_6$ | $Ar_7$ |
|---|---|---|---|
| 37<br>38 | 4—$CH_3$<br>3,4—$CH_3$ | 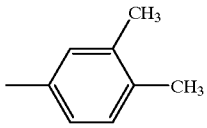 | 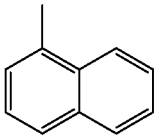 |
| 39<br>40 | 4—$CH_3$<br>3,4—$CH_3$ | 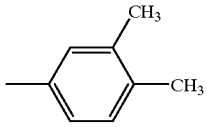 | 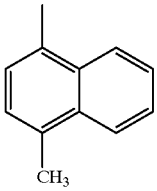 |
| 41<br>42 | 4—$CH_3$<br>3,4—$CH_3$ | 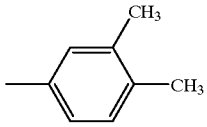 | 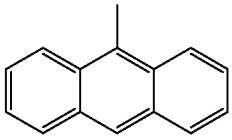 |
| 43<br>44 | 4—$CH_3$<br>3,4—$CH_3$ | 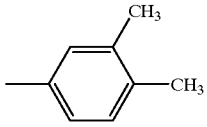 | 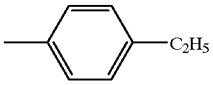 |
| 45<br>46 | 4—$CH_3$<br>3,4—$CH_3$ | 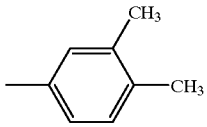 | 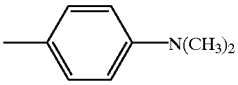 |
| 47<br>48 | 4—$CH_3$<br>3,4—$CH_3$ | 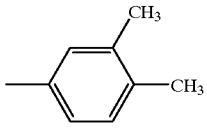 | 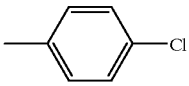 |
TABLE 62
| COMPOUND No. | $R_{14}$ | $Ar_6$ | $Ar_7$ |
|---|---|---|---|
| 49<br>50 | 4—$CH_3$<br>3,4—$CH_3$ | 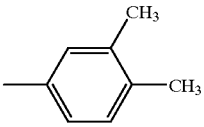 | 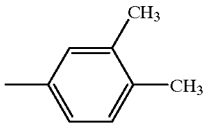 |
| 51<br>52 | 4—$CH_3$<br>3,4—$CH_3$ | 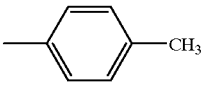 | 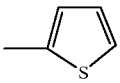 |

TABLE 62-continued

| COMPOUND No. | $R_{14}$ | $Ar_6$ | $Ar_7$ |
|---|---|---|---|
| 53<br>54 | 4—$CH_3$<br>3,4—$CH_3$ | 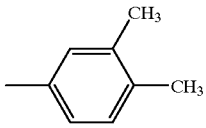 | 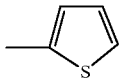 |
| 55<br>56 | 4—$CH_3$<br>3,4—$CH_3$ | 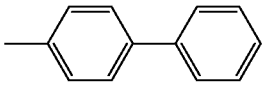 | 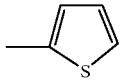 |
| 57<br>58 | 4—$CH_3$<br>3,4—$CH_3$ | 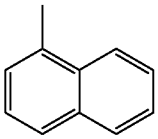 | 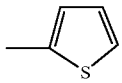 |
| 59<br>60 | 4—$CH_3$<br>3,4—$CH_3$ | 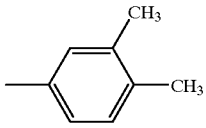 | 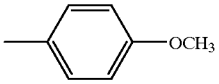 |
| 61<br>62 | 4—$CH_3$<br>3,4—$CH_3$ | 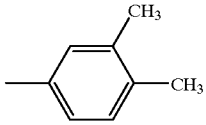 | 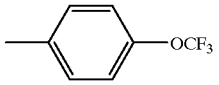 |

Specific examples of the benzidine compounds represented by formula (VI) are shown in Tables 63 to 65 below. However, these specific examples are not critical in the invention. Incidentally, numbers of Example Compounds indicated in Examples to be described later are those in which "VI-" is added to compound numbers in these tables. For instance, when the compound number is "12", the Example Compound number is "(VI-12)".

TABLE 63

| COMPOUND No. | $R_{15}$, $R_{15'}$ | $(R_{16})_m$, $(R_{16'})_m$ | $(R_{17})_n$, $(R_{17'})_n$ |
|---|---|---|---|
| 1 | $CH_3$ | H | H |
| 2 | $CH_3$ | 2-$CH_3$ | H |
| 3 | $CH_3$ | 3-$CH_3$ | H |
| 4 | $CH_3$ | 4-$CH_3$ | H |
| 5 | $CH_3$ | 4-$CH_3$ | 2-$CH_3$ |
| 6 | $CH_3$ | 4-$CH_3$ | 3-$CH_3$ |
| 7 | $CH_3$ | 4-$CH_3$ | 4-$CH_3$ |
| 8 | $CH_3$ | 3, 4-$CH_3$ | H |
| 9 | $CH_3$ | 3, 4-$CH_3$ | 3, 4-$CH_3$ |
| 10 | $CH_3$ | 4-$C_2H_5$ | H |
| 11 | $CH_3$ | 4-$C_3H_7$ | H |
| 12 | $CH_3$ | 4-$C_4H_9$ | H |
| 13 | $CH_3$ | 4-$C_2H_5$ | 2-$CH_3$ |
| 14 | $CH_3$ | 4-$C_2H_5$ | 3-$CH_3$ |
| 15 | $CH_3$ | 4-$C_2H_5$ | 4-$CH_3$ |
| 16 | $CH_3$ | 4-$C_2H_5$ | 3, 4-$CH_3$ |
| 17 | $CH_3$ | 4-$C_3H_7$ | 3-$CH_3$ |
| 18 | $CH_3$ | 4-$C_3H_7$ | 4-$CH_3$ |
| 19 | $CH_3$ | 4-$C_4H_9$ | 3-$CH_3$ |
| 20 | $CH_3$ | 4-$C_4H_9$ | 4-$CH_3$ |

TABLE 64

| COMPOUND No. | $R_{15}$, $R_{15'}$ | $(R_{16})_m$, $(R_{16'})_m$ | $(R_{17})_n$, $(R_{17'})_n$ |
|---|---|---|---|
| 21 | $CH_3$ | 4-$C_2H_5$ | 4-$C_2H_5$ |
| 22 | $CH_3$ | 4-$C_2H_5$ | 4-$OCH_3$ |
| 23 | $CH_3$ | 4-$C_3H_7$ | 4-$C_3H_7$ |
| 24 | $CH_3$ | 4-$C_3H_7$ | 4-$OCH_3$ |
| 25 | $CH_3$ | 4-$C_4H_9$ | 4-$C_4H_9$ |
| 26 | $CH_3$ | 4-$C_4H_9$ | 4-$OCH_3$ |
| 27 | H | 3-$CH_3$ | H |
| 28 | Cl | H | H |
| 29 | Cl | 2-$CH_3$ | H |
| 30 | Cl | 3-$CH_3$ | H |
| 31 | Cl | 4-$CH_3$ | H |
| 32 | Cl | 4-$CH_3$ | 2-$CH_3$ |
| 33 | Cl | 4-$CH_3$ | 3-$CH_3$ |
| 34 | Cl | 4-$CH_3$ | 4-$CH_3$ |
| 35 | $C_2H_5$ | H | H |
| 36 | $C_2H_5$ | 2-$CH_3$ | H |
| 37 | $C_2H_5$ | 3-$CH_3$ | H |
| 38 | $C_2H_5$ | 4-$CH_3$ | H |
| 39 | $C_2H_5$ | 4-$CH_3$ | 4-$CH_3$ |
| 40 | $C_2H_5$ | 4-$C_2H_5$ | 4-$CH_3$ |

TABLE 65

| COMPOUND No. | $R_{15}$, $R_{15'}$ | $(R_{16})_m$, $(R_{16'})_m$ | $(R_{17})_n$, $(R_{17'})_n$ |
|---|---|---|---|
| 41 | $C_2H_5$ | 4-$C_3H_7$ | 4-$CH_3$ |
| 42 | $C_2H_5$ | 4-$C_4H_9$ | 4-$CH_3$ |
| 43 | $OCH_3$ | H | H |
| 44 | $OCH_3$ | 2-$CH_3$ | H |
| 45 | $OCH_3$ | 3-$CH_3$ | H |

TABLE 65-continued

| COMPOUND No. | $R_{15}$, $R_{15'}$ | $(R_{16})_m$, $(R_{16'})_m$ | $(R_{17})_n$, $(R_{17'})_n$ |
|---|---|---|---|
| 46 | $OCH_3$ | 4-$CH_3$ | H |
| 47 | $OCH_3$ | 4-$CH_3$ | 4-$CH_3$ |
| 48 | $OCH_3$ | 4-$C_2H_5$ | 4-$CH_3$ |
| 49 | $OCH_3$ | 4-$C_3H_7$ | 4-$CH_3$ |
| 50 | $OCH_3$ | 4-$C_4H_9$ | 4-$CH_3$ |
| 51 | $CH_3$ | 2-$N(CH_3)_2$ | H |
| 52 | $CH_3$ | 3-$N(CH_3)_2$ | H |
| 53 | $CH_3$ | 4-$N(CH_3)_2$ | H |
| 54 | $CH_3$ | 4-Cl | H |

As the charge-transporting material, a high-molecular charge-transporting material is also available. As the high-molecular charge-transporting material, known charge-transporting materials such as poly-N-vinylcarbazole and polysilane can be used. Polyester-type high-molecular charge-transporting materials described in Japanese Patent Laid-Open Nos. 176293/1996 and 208820/1996 are especially preferable because of the high charge transferability.

The binder resin is not particularly limited so long as it can be cured with the optically functional organosilicon compounds represented by formula (I). Examples include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicon resin, a silicon-alkyd resin, a phenol-formaldehyde resin, a styrene-alkyd resin, poly-N-vinylcarbazole, polysilane and polyester-type high-molecular charge-transferring materials described in Japanese Patent Laid-Open Nos. 176293/1996 and 208820/1996. Further examples thereof include organozirconium compounds such as a zirconium chelate compound, a zirconium alkoxide compound and a zirconium coupling agent, organotitanium compounds such as a titanium chelate compound, a titanium alkoxide compound and a titanate coupling agent, organoaluminum compounds such as an aluminum chelate compound and an aluminum coupling agent, and organometallic compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, and an aluminum zirconium alkoxide compound. Especially, organozirconium compounds, organotitanyl compounds and organoaluminum compounds are preferable because good electrophotographic characteristics are exhibited with a low residual potential. Moreover, silane coupling agents such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane, and curing-type matrices such as a photosetting resin may be used. These binder resins can be used either singly or in combination.

The mixing ratio (weight ratio) of the charge-transferring material and the optically functional organosilicon compounds (binder resins) represented by formula (I) is preferably between 10:1 and 1:5.

The thickness of the charge transport layer is generally between 5 and 50 μm, preferably between 10 and 30 μm. Examples of the coating method can include ordinary methods such as a blade coating method, a Mayer bar coating method, a spray coating method, a dip coating method, a bead coating method, an air knife coating method and a curtain coating method. Examples of the solvent used in forming the charge transport layer include aromatic hydrocarbons such as benzene, toluene, xylene and chlorobenzene; ketones such as acetone and 2-butanone; halogenated aliphatic hydrocarbons such as methylene chloride, chloroform and ethylene chloride; cyclic or linear ethers such as tetrahydrofuran and ethyl ether. These can be used either singly or in combination.

The surface-protecting layer is described below.

The surface-protecting layer is formed on the photoreceptive layer to prevent the chemical denaturation of the charge transfer layer and to improve mechanical strengths of the photoreceptive layer in charging the photoreceptive layer having a laminated structure.

When the cured film is formed as the surface-protecting layer, a conductive material and a binder resin may be added, as required, in the step of producing the optically functional coating solution.

Examples of the conductive material can include metallocene compounds such as N,N'-dimethylferrocene; aromatic amine compounds such as N,N'-diphenyl-N,N'-bis(3-methylphenyl)-[1,1'-biphenyl]-4,4'-diamine; and metallic oxides such as antimony oxide, tin oxide, titanium oxide, indium oxide and tin oxide-antimony oxide. However, these are not critical in the invention.

The binder resin is not particularly limited so long as it can be cured with the optically functional organosilicon compounds represented by formula (I). Examples of the binder resin can include ordinary resins such as a polyamide resin, a polyurethane resin, a polyester resin, an epoxy resin, a polyketone resin, a polycarbonate resin, a polyvinyl ketone resin, a polystyrene resin, a polyacrylamide resin, a polyimide resin, a polyamide-imide resin and a polyether imide resin.

When the cured film is formed as the surface-protecting layer, it is especially preferable that an organometallic compound or a curing-type matrix is added in the step of producing the optically functional coating solution.

Examples of the organometallic compound include organozirconium compounds such as a zirconium chelate compound, a zirconium alkoxide compound and a zirconium coupling agent, organotitanium compounds such as a titanium chelate compound, a titanium alkoxide compound and a titanate coupling agent, organoaluminum compounds such as an aluminum chelate compound and an aluminum coupling agent, and organometallic compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, and an aluminum zirconium alkoxide compound. Especially, organozirconium compounds, organotitanyl compounds and organoaluminum compounds are preferable because good electrophotographic characteristics are exhibited with a low residual potential.

Examples of the curing-type matrix can include silane coupling agents such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane.

When the cured film is formed as the surface-protecting layer, the compounds represented by formula (IV) may be added, or inorganic fine particles of silica or alumina or organic fine particles of PTFE or crosslinked polystyrene may be added for obtaining a stronger cured film, in the step of producing the optically functional coating solution. Inorganic fine particles are preferably those coated with an organic group in view of the image qualities.

The surface-protecting layer is preferably adapted such that the electrical resistance is between $10^9$ and $10^{14}\Omega\cdot$cm. When the electrical resistance is more than $10^{14}\Omega\cdot$cm, a residual potential is increased to obtain a copy with much fogging. When it is less than $10^9\Omega\cdot$cm, the image becomes dim and the resolution is decreased. Further, the surface-protecting layer has to be substantially adapted not to disturb transmission of light used in the image exposure.

The film thickness of the surface-protecting layer is between 0.5 and 20 μm, preferably between 1 and 10 μm. Examples of the coating method can include ordinary methods such as a blade coating method, a Mayer bar coating method, a spray coating method, a dip coating method, a bead coating method, an air knife coating method and a curtain coating method.

The photoreceptive single layer is described below.

When the cured film is formed as the surface-protecting layer, a charge-generating material, and as required, a charge-transporting material and a binder resin are added in the step of producing the optically functional coating solution. These materials can be the same as those listed above. The charge-generating material is added such that its amount in the photoreceptive single layer is between 10 and 85% by weight, preferably between 20 and 50% by weight. The amount of the charge-transporting material is preferably between 5 and 50% by weight. The solvent used in the coating and the coating method can be the same as those mentioned in the charge-generating layer and the charge transfer layer. The film thickness is preferably between 5 and 50 μm, more preferably between 10 and 40 μm.

When the cured film is used as each of these layers, an antioxidant may be added in the step of producing the optically functional coating solution to inhibit deterioration owing to an oxidative gas such as ozone generated in a charging unit. When mechanical strengths of the photoreceptor surface are increased to provide a long life of the photoreceptor, the photoreceptor comes to be contacted with an oxidative gas for a long period of time. Thus, a high oxidation resistance has been so far required.

As the antioxidant, a hindered phenol antioxidant and a hindered amine antioxidant are preferable. Known antioxidants such as an organoiodine antioxidant, a phosphite antioxidant, a dithiocarbamate antioxidant, a thiourea antioxidant and a benzimidazole antioxidant are also available. The amount of the antioxidant is preferably 15% by weight or less, more preferably 10% by weight or less.

Examples of the hindered phenol antioxidant include 2,6-di-tert-butyl-4-methylphenol, 2,5-di-tert-butylhydroquinone, N,N'-hexamethylenebis(3,5-di-tert-butyl-4-hydroxyhydrocinnamide), 3,5-di-tert-butyl-4-hydroxybenzylphosphonate diethyl ester, 2,4-bis[(octylthio)methyl]-o-cresol, 2,6-di-tert-butyl-4-ethylphenol, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 2,5-di-tert-amylhydroquinone, 2-tert-butyl-6-(3-butyl-2-hydroxy-5-methylbenzyl)-4-methylphenyl acrylate and 4,4'-butylidenebis(3-methyl-6-tert-butylphenol).

When the cured film is formed as each of the layers, additives such as a coupling agent, a commercial silicon-type hard coating agent and a fluorine compound may be added to adjust the film-forming property and the flexibility of the cured film or to impart the water repellency, in the step of producing the optically functional coating solution.

As the coupling agent, various silane coupling agents are mentioned. Specific examples thereof include vinyltrichlorosilane, vinyltrimethoxysilane, vinyltriethoxysilane, γ-glycidoxypropylmethyldiethoxysilane, γ-glycidoxypropyltrimethoxysilane, γ-glycidoxypropyltriethoxysilane, γ-aminopropyltriethoxysilane, γ-aminopropyltrimethoxysilane, γ-aminopropylmethyldimethoxysialne, N-β-(aminoethyl) γ-aminopropyltriethoxysilane, tetramethoxysilane, methyltrimethoxysilane and dimethyldimethoxysilane.

Examples of the commercial silicon-type hard coating agent include "KP-85", "X-40-9740" and "X-40-2239" made by The Shin-etsu Silicone; and "AY42-440", "AY42-441" and "AY49-208" made by Toray Dow Corning.

Examples of the fluorine compound include (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane.

With respect to these additives, the silane coupling agent can be used in an optional amount, and the fluorine compound is preferably used in an amount of 0.25% by weight or less based on the fluorine-free compounds. When the amount exceeds this range, the film-forming property of the cured film is sometimes problematic.

The electrophotographic photoreceptor is described below.

The electrophotographic photoreceptor of the invention has at least one layer made of the cured film formed by the process for producing the electrophotographic photoreceptor in the invention. Consequently, the electrophotographic photoreceptor having the excellent mechanical strengths and the long life can be obtained. It is especially effective that the layer made of the cured film is used as the uppermost surface layer.

Specific examples of the electrophotographic photoreceptor of the invention are shown in FIGS. 1 to 5.

Figure 2:
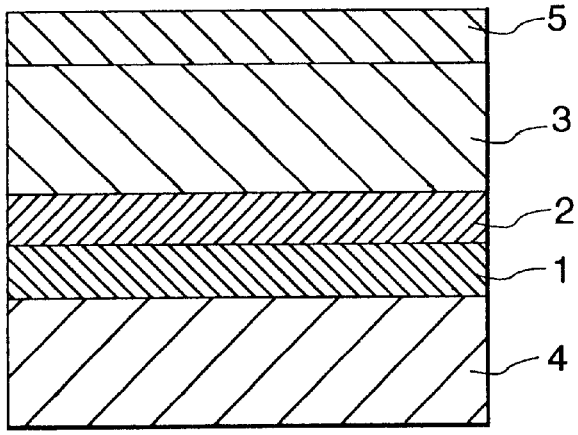
FIG. 2 is an enlarged sectional view showing another example of the electrophotographic photoreceptor of the invention.
Figure 3:
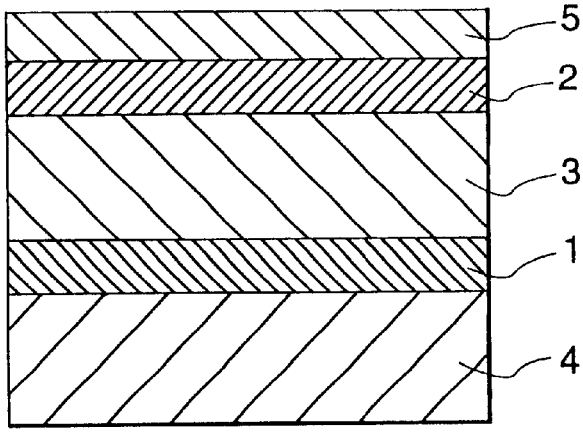
FIG. 3 is an enlarged sectional view showing still another example of the electrophotographic photoreceptor of the invention.
Figure 4:
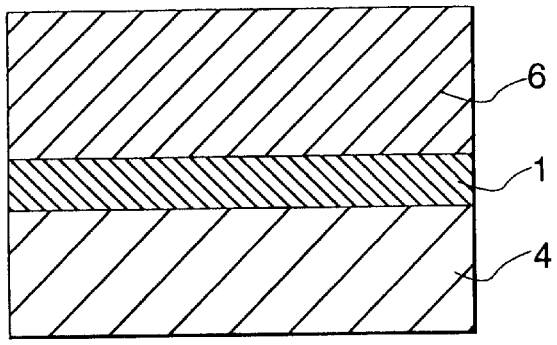
FIG. 4 is an enlarged sectional view showing the other example of the electrophotographic photoreceptor of the invention.
Figure 5:
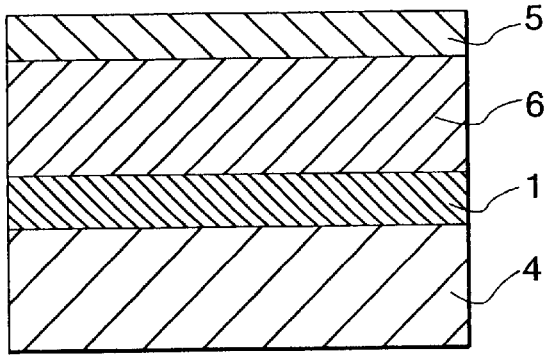
FIG. 5 is an enlarged sectional view showing the other example of the electrophotographic photoreceptor of the invention.

FIGS. 1 to 5 are enlarged sectional views showing examples of the electrophotographic photoreceptor of the invention. FIGS. 1 to 3 show electrophotographic photoreceptors in which a photoreceptive layer has a laminated structure. FIGS. 4 and 5 show electrophotographic photoreceptors in which a photoreceptive layer has a single layer structure.

In FIG. 1, an undercoat layer 1 is formed on a conductive support 4, and a charge-generating layer 2and a charge transfer layer 3 are formed thereon in this order.

In FIG. 2, the undercoat layer 1 is formed on the conductive support 4, and the charge-generating layer 2, the charge transport layer 3 and a surface-protecting layer 5 are formed thereon in this order.

In FIG. 3, the undercoat layer 1 is formed on the conductive support 4, and the charge transport layer 3, the charge-generating layer 2 and the surface-protecting layer 5 are formed thereon in this order.

In FIG. 4, the undercoat layer 1 is formed on the conductive support 4, and a photoreceptive layer (charge-generating/charge transport layer) 6 is formed thereon.

In FIG. 5, the undercoat layer 1 is formed on the conductive support 4, and the photoreceptive layer (charge-generating/charge transport layer) 6 and the surface-protecting layer 5 are formed thereon in this order.

The image-forming apparatus of the invention is described below.

The image-forming apparatus of the invention is an electrophotographic image-forming apparatus having at least the electrophotographic photoreceptor of the invention and its charging unit.

The image-forming apparatus of the invention may have, as required, an exposure unit such as a laser optical system or a LED alley, a developing unit for forming an image with a toner, a transfer unit for transferring a toner image onto a medium such as paper, a fixing unit for fixing a toner image on a medium such as paper, a cleaning unit for removing a toner or dust adhered to the photoreceptor and a static eliminator for removing an electrostatic latent image remaining on the surface of the photoreceptor in a usual manner.

In the image-forming apparatus of the invention, the charging method may be any of a non-contact method and a contact charging method by a known corotron or scorotron. Since the photoreceptor of the invention has strong mechanical strengths, an especially excellent durability is exhibited when using a contact charging method to give a great stress to the photoreceptor.

In the contact charging method, the surface of the photoreceptor is charged by applying a voltage to a conductive member in contact with the surface of the photoreceptor. The conductive member may take the form of a brush, a blade, a pin electrode or a roller. Especially, a roller-like member is preferable. Ordinarily, the roller-like member has a resistive layer, an elastic layer for supporting the same and a core which are mounted in this order from the outside. Further, a protecting layer can be mounted outside the resistive layer as required.

The roller-like member is rotated at the same peripheral velocity as that of the photoreceptor by being contacted with the photoreceptor without having a driving unit in particular, and it acts as a charging unit. However, any driving unit may be mounted on the roller-like member and rotated at a peripheral velocity different from that of the photoreceptor for charging.

The material of the core is a conductive material. Examples thereof include iron, copper, brass, stainless steel, aluminum and nickel. Further, a resin molded product having other conductive particles dispersed therein is also available.

The material of the elastic layer is a conductive or semiconductive material. A rubber material having conductive particles or semiconductive particles dispersed therein is generally used.

Examples of the rubber material include EPDM, polybutadiene, natural rubber, polyisobutylene, SBR, CR, NBR, silicon rubber, urethane rubber, epichlorohydrin rubber, SBS, thermoplastic elastomer, norbomene rubber, fluorosilicone rubber and ethylene oxide rubber.

Examples of the conductive or semiconductive particles can include metals such as carbon black, zinc, aluminum, copper, iron, nickel, chromium and titanium; and metallic oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO. These materials may be used either singly or in combination.

The material of the resistive layer and the protecting layer is obtained by dispersing conductive or semiconductive particles in a binder resin to control its resistance. The resistivity is between $10^3$ and $10^{14}$ Ωcm, preferably between 105 and $10^{12}$ Ωcm, more preferably between $10^7$ and $10^{12}$ Ωcm. The film thickness is between 0.01 and 1,000 μm, preferably between 0.1 and 500 μm, more preferably between 0.5 and 100 μm.

Examples of the binder resin include an acrylic resin, a cellulose resin, a polyamide resin, a methoxymethylated nylon, an ethoxymethylated nylon, a polyurethane resin, a polycarbonate resin, a polyester resin, a polyethylene resin, a polyvinyl resin, a polyarylate resin, a polythiophene resin, a polyolefin resin such as PFA, PEP or PET and a styrene-butadiene resin.

As the conductive or semiconductive particles, the same carbon black, metals and metallic oxides as in the elastic layer are used. Further, an antioxidant such as hindered phenol or hindered amine, a filler such as clay or kaolin and a lubricant such as silicone oil can be added as required.

These layers can be formed by a blade coating method, a Mayer bar coating method, a spray coating method, a dip coating method, a bead coating method, an air knife coating method or a curtain coating method.

The photoreceptor is charged using these conductive members by applying a voltage to the conductive members. The applied voltage is preferably a DC voltage or a DC voltage superposed with an AC voltage. The DC voltage is preferably a positive or negative voltage of 50 to 2,000 V, more preferably 100 to 1,500 V according to the photoreceptor charge voltage required. When the DC voltage is superposed with the AC voltage, the peak to peak voltage is between 400 and 1,800 V, preferably between 800 and 1,600 V, more preferably between 1,200 and 1,600 V. The frequency of the AC voltage is between 50 and 20,000 Hz, preferably between 100 and 5,000 Hz.

Figure 6:
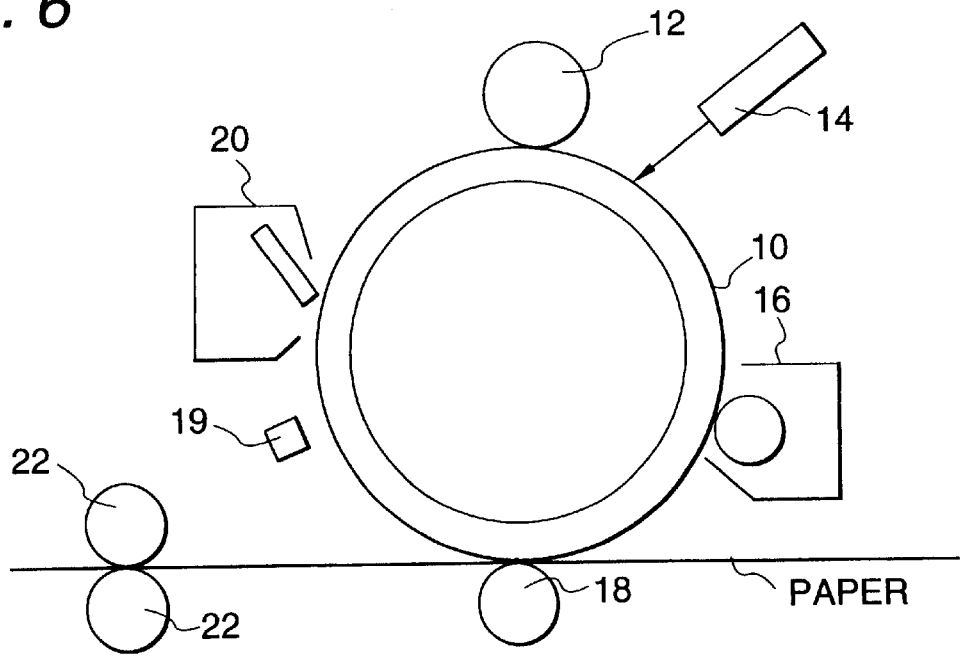
FIG. 6 is a schematic view showing an example of an electrophotographic image-forming apparatus to which the electrophotographic photoreceptor of the invention is applied.

FIG. 6 is a schematic view showing an example of an electrophotographic image-forming apparatus to which the electrophotographic photoreceptor of the invention is applied. It has a photoreceptor 10 which is the electrophotographic photoreceptor of the invention, a charging roll 12 which is a charging unit of a contact-charging system, a laser exposure optical system 14, a developing unit 16 using a toner powder, a transfer roll 18, a cleaning blade 20 which is a mechanical cleaning unit and a fixing roll 22.

EXAMPLES

Example 1

A solution made of 20 parts of a zirconium compound (trade name: Organotix ZC 540, Matsumoto Seiyaku), 2.5 parts of a silane compound (trade name: A1100, Nippon Unicar) and 45 parts of a polyvinyl butyral resin (trade name: Esleck BM-S, Sekisui Chemical) and butanol was coated by a dip coating method on an aluminum substrate subjected to horning treatment and having an outer diameter of 30 mm, and heat-dried at 150° C. for 10 minutes to form an undercoat layer having a film thickness of 1.0 μm.

One part of chlorogallium phthalocyanine having intense diffraction peaks at Bragg angles (2θ±0.2°) of 7.4°, 16.6°, 25.5° and 28.3° in the X-ray diffraction spectrum was mixed with 1 part of polyvinyl butyral (Esleck BM-S, Sekisui Chemical) and 100 parts of n-butyl acetate, and these were dispersed through a paint shaker along with glass beads for 1 hour. Then, the resulting coating solution was dip-coated on the undercoat layer, and heat-dried at 100° C. for 10 minutes to form a charge-generating layer having a film thickness of approximately 0.15 μm.

A coating solution obtained by dissolving 2 parts of Example Compound (VI-27), a benzidine compound and 3 parts of a high-molecular compound (viscosity average molecular weight 39,000) represented by the following basic unit 1

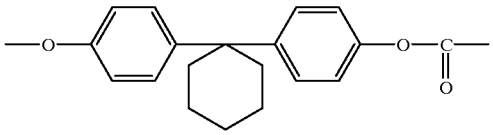

Basic unit 1 in 20 parts of chlorobenzene was coated on the charge-generating layer by a dip coating method, and heated at 110° C. for 40 minutes to form a charge transport layer having a film thickness of 20 μm. The resulting structure is designated a base photoreceptor 1.

The following structural materials were dissolved in 5 parts of isopropyl alcohol, 3 parts of tetrahydrofuran and 0.3 part of distilled water, and 0.5 part of an ion exchange resin (Amberlist 15E) was added thereto. The hydrolysis was conducted for 24 hours by stirring them at room temperature.

Structural materials

Example Compound (II-261) . . . 2 parts methyltrimethoxysilane . . . 2 parts

To 2 parts of the solution obtained by separating the ion exchange resin from the hydrolyzate through filtration was added 0.04 part of aluminum trisacetylacetonate to form a coating solution 1.

This coating solution 1 was coated on the charge transport layer of the base photoreceptor 1 by a ring dip coating method, air-dried at room temperature for 30 minutes, and cured by heat treatment at 120° C. for 1 hour to form a surface-protecting layer having a film thickness of approximately 3 μm. This is designated a photoreceptor of Example 1.

Examples 2 to 5

Photoreceptors of Examples 2 to 5 were produced in the same manner as in Example 1 except that Example Compound (II-261) as a structual material for forming a coating solution of a surface-protecting layer in the photoreceptor of Example 1 was changed to Example Compounds shown in Table 66.

TABLE 66

| Photoreceptor | Example Compound |
|---|---|
| Example 2 | II-126 |
| Example 3 | II-273 |
| Example 4 | II-145 |
| Example 5 | II-255 |

Comparative Example 1

A photoreceptor having no surface-protecting layer, namely, the base photoreceptor 1 in Example 1, was formed as the photoreceptor of Comparative Example 1.

The photoreceptors in Examples 1 to 5 and Comparative Example 1 were mounted on Laser Press 4160II manufactured by Fuji Xerox to conduct a test for a printing resistance. With respect to the printing resistance, image qualities and a weight loss of a film thickness of the photoreceptor due to abrasion were evaluated before and after printing 50,000 sheets of paper. As paper for continuous printing, PPC paper (L, A4) made by Fuji Xerox was used, and the printing was conducted approximately at 22° C. and 55% RH. The results are shown in Table 67.

TABLE 67

| Photoreceptor | Initial image qualities | After printing 50,000 sheets of paper | Abrasion loss [μm] |
|---|---|---|---|
| Example 1 | good | good | 2.3 |
| Example 2 | good | good | 2.3 |
| Example 3 | good | good | 2.0 |
| Example 4 | good | good | 1.7 |
| Example 5 | good | good | 1.2 |
| Comparative Example 1 | good | Printing density decreases and defective images occur. | 12.0 |

As is clear from Table 67, in Examples 1 to 5, both of the 256-grade pattern and the 400-line resolution pattern were good (400 dpi and 600 dpi modes) at the initial stage and after the printing of 50,000 sheets of paper. The abrasion loss was low, and no large striped flaw was observed on the surface. Accordingly, it is considered that satisfactory mechanical strengths are provided. In Comparative Example 1, the initial image qualities were good, but many striped and dotted flaws occurred on the surface of the photoreceptor after printing 50,000 sheets of paper. Defective images considered to be provided by the flaws occurred. Further, the decrease in the image density considered to be attributed to the weight loss occurred.

Example 6

A photoreceptor of Example 6 was produced as in Example 1 except that Amberlist used as the hydrolysis catalyst to produce the coating solution of the surface-protecting layer in the photoreceptor of Example 1 was replaced with Purolite (cation exchange resin made by A. M. P. Ionex).

Example 7

A photoreceptor of Example 7 was produced as in Example 1 except that the structural materials used to produce the coating solution of the surface-protecting layer in the photoreceptor of Example 1 were changed as follows.

| Structural materials | |
|---|---|
| Example Compound (II-261) | 3 parts |
| methyltrimethoxysilane | 1 part |

Example 8

A photoreceptor of Example 8 was produced as in Example 1 except that the structural materials used to produce the coating solution of the surface-protecting layer in the photoreceptor of Example 1 were changed as follows.

Structural material

Example Compound (II-261) . . . 4 parts

Example 9

A photoreceptor of Example 9 was produced as in Example 1 except that the structural materials used to produce the coating solution of the surface-protecting layer in the photoreceptor of Example 1 were changed as follows.

Structural materials

Example Compound (II-261) . . . 2 parts

Example Compound (IV-4) . . . 2 parts

Example 10

A photoreceptor of Example 10 was produced as in Example 9 except that the structural materials used to produce the coating solution of the surface-protecting layer in the photoreceptor of Example 9 were changed as follows.

Structural materials

Example Compound (II-261) . . . 3 parts

Example Compound (IV-4) . . . 1 part

Example 11

A photoreceptor of Example 11 was produced as in Example 1 except that the structural materials used to produce the coating solution of the surface-protecting layer in the photoreceptor of Example 1 were changed as follows.

Structural materials

Example Compound (II-261) . . . 2 parts

Example Compound (IV-2) . . . 2 parts

Example 12

A photoreceptor of Example 12 was produced as in Example 1 except that the structural materials used to produce the coating solution of the surface-protecting layer in the photoreceptor of Example 1 were changed as follows.

| Structural materials | |
|---|---|
| Example Compound (II-261) | 2 parts |
| Example Compound (IV-7) | 2 parts |

Example 13

A photoreceptor of Example 13 was produced as in Example 1 except that the structural materials used to produce the coating solution of the surface-protecting layer A in the photoreceptor of Example 1 were changed as follows.

| Structural materials | |
|---|---|
| Example Compound (II-26) | 2 parts |
| Compound α shown below | 2 parts |

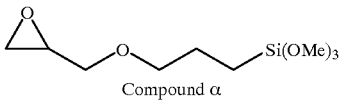

Compound α

Example 14

A photoreceptor of Example 14 was produced as in Example 1 except that the structural materials used to produce the coating solution of the surface-protecting layer in the photoreceptor of Example 1 were changed as follows.

| Structural materials | |
|---|---|
| Example Compound (II-261) | 2 parts |
| methyltrimethoxysilane | 1.4 parts |
| dimethyldimethoxysilane | 0.6 part |

Example 15

A photoreceptor of Example 15 was produced as in Example 1 except that the structural materials used to produce the coating solution of the surface-protecting layer in the photoreceptor of Example 1 were changed as follows.

Structural materials

| Structural materials | |
|---|---|
| Example Compound (II-261) | 2 parts |
| methyltrimethoxysilane | 1.4 parts |
| tetramethoxysilane | 0.6 part |

Example 16

A photoreceptor of Example 16 was produced as in Example 1 except that the structural materials used to produce the coating solution of the surface-protecting layer in the photoreceptor of Example 1 were changed as follows.

| Structural materials | |
|---|---|
| Example Compound (II-261) | 2 parts |
| methyltrimethoxysilane | 1.4 parts |
| dimethyldimethoxysilane | 0.3 part |
| tetramethoxysilane | 0.3 part |

Example 17

A photoreceptor of Example 17 was produced as in Example 1 except that the structural materials used to produce the coating solution of the surface-protecting layer in the photoreceptor of Example 1 were changed as follows.

| Structural materials | |
|---|---|
| Example Compound (II-261) | 2 parts |
| methyltrimethoxysilane | 1.4 parts |
| Example Compound (IV-2) | 0.6 part |

Example 18

A photoreceptor of Example 18 was produced as in Example 1 except that the structural materials used to produce the coating solution of the surface-protecting layer in the photoreceptor of Example 1 were changed as follows.

| Structural materials | |
|---|---|
| Example Compound (II-261) | 2 parts |
| methyltrimethoxysilane | 1.4 parts |
| Compound α | 0.6 part |

Example 19

A photoreceptor of Example 19 was produced as in Example 1 except that the structural materials used to produce the coating solution of the surface-protecting layer in the photoreceptor of Example 1 were changed as follows.

| Structural materials | |
|---|---|
| Example Compound (II-261) | 2 parts |
| Example Compound (IV-13) | 2 parts |

Example 20

A photoreceptor of Example 20 was produced as in Example 1 except that the structural materials used to produce the coating solution of the surface-protecting layer in the photoreceptor of Example 1 were changed as follows.

| Structural materials | |
|---|---|
| Example Compound (II-261) | 2 parts |
| Compound α | 2 parts |

Example 21

A photoreceptor of Example 21 was produced as in Example 1 except that the structural materials used to produce the coating solution of the surface-protecting layer in the photoreceptor of Example 1 were changed as follows.

Structural materials

| Structural materials | |
|---|---|
| Example Compound (II-273) | 2 parts |
| Example Compound (IV-13) | 2 parts |

Example 22

A photoreceptor of Example 22 was produced as in Example 1 except that the structural materials used to produce the coating solution of the surface-protecting layer in the photoreceptor of Example 1 were changed as follows.

| Structural materials | |
|---|---|
| Example Compound (II-273) | 2 parts |
| Example Compound (IV-4) | 2 parts |

Example 23

A photoreceptor of Example 23 was produced as in Example 1 except that the structural materials used to produce the coating solution of the surface-protecting layer in the photoreceptor of Example 1 were changed as follows.

| Structural materials | |
|---|---|
| Example Compound (II-273) | 2 parts |
| Example Compound (IV-4) | 1 part |
| Example Compound (IV-13) | 1 part |

Example 24

A photoreceptor of Example 24 was produced as in Example 1 except that the structural materials used to produce the coating solution of the surface-protecting layer in the photoreceptor of Example 1 were changed as follows.

| Structural materials | |
|---|---|
| Example Compound (II-126) | 2 parts |
| Example Compound (IV-4) | 2 parts |

Example 25

A photoreceptor of Example 25 was produced in exactly the same manner as in Example 1 except that a charge-generating layer was formed using hydroxygallium phthalocyanine with a specific crystal form having intense diffraction peaks at Bragg angles (2θ±0.2°) of 7.5°, 9.9°, 12.5°, 16.3°, 18.6°, 25.1° and 28.3° in the X-ray diffraction spectrum instead of chlorogallium phthalocyanine in Example 1.

Example 26

A photoreceptor of Example 26 was produced in exactly the same manner as in Example 1 except that a charge-generating layer was formed using hydroxygallium phthalocyanine with a crystal form having a peak at a Bragg angle (2θ±0.2°) of 27.3° in the X-ray diffraction spectrum instead of chlorogallium phthalocyanine in Example 1.

Example 27

A photoreceptor of Example 27 was produced in exactly the same manner as in Example 1 except that 2 parts of Example Compound (VI-27), a benzidine compound used to form the charge transfer layer was replaced with 1.3 parts of Example Compound (VI-27), a benzidine compound and 0.7 part of Example Compound (V-28).

Example 28

An undercoat layer and a charge-generating layer were formed on an aluminum drum in this order by the method described in Example 1.

One part of a high-molecular charge transport material ($M_w$ up to 100,000) having the following basic unit

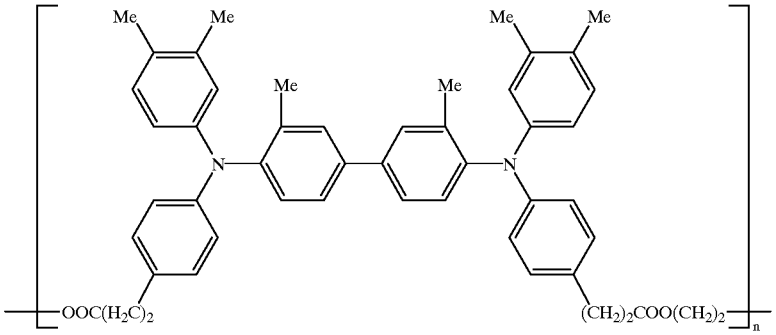

was dissolved in 4 parts of chlorobenzene. The solution was dip-coated on the charge-generating layer, and heat-dried at 115° C. for 1 hour to form a charge transport layer having a film thickness of 20 μm.

Subsequently, a surface-protecting layer was formed in exactly the same manner as in Example 1 to form a photoreceptor of Example 28.

Example 29

A product having a surface-protecting layer was formed in exactly the same manner as in Example 1 except that after the coating solution of the surface-protecting layer was coated and the product was air-dried for 30 minutes and heat-treated at 120° C. for 1 hour, the resulting product was humidified at 80° C. and 90% RH for 4 hours. The thus-obtained product was designated a photoreceptor of Example 29.

The photoreceptors of Examples 6 to 29 were tested for the printing resistance as in Example 1. The results are shown in Table 68.

TABLE 68

| Example | Initial image qualities | After printing 50,000 sheets of paper | Abrasion loss [μm] |
|---|---|---|---|
| Example 6 | good | good | 2.3 |
| Example 7 | good | good | 2.0 |
| Example 8 | good | good | 1.8 |
| Example 9 | good | good | 0.7 |
| Example 10 | good | good | 0.8 |
| Example 11 | good | good | 1.0 |
| Example 12 | good | good | 1.0 |
| Example 13 | good | good | 1.2 |
| Example 14 | good | good | 2.5 |
| Example 15 | good | good | 2.1 |
| Example 16 | good | good | 2.3 |
| Example 17 | good | good | 2.0 |
| Example 18 | good | good | 1.9 |
| Example 19 | good | good | 1.2 |
| Example 20 | good | good | 1.4 |
| Example 21 | good | good | 1.5 |
| Example 22 | good | good | 1.9 |
| Example 23 | good | good | 1.8 |
| Example 24 | good | good | 2.2 |
| Example 25 | good | good | 2.3 |
| Example 26 | good | good | 2.3 |
| Example 27 | good | good | 2.3 |
| Example 28 | good | good | 2.3 |
| Example 29 | good | good | 2.3 |

Table 68 reveals that all of the photoreceptors exhibit the excellent printing resistance.

Example 30

An undercoat layer was formed on an aluminum substrate subjected to honing treatment and having an outer diameter of 30 mm as in Example 1.

A charge transfer layer was formed thereon as in Example 1. A charge-generating layer was further formed thereon as in Example 1. (The order of the charge-generating layer and the charge transport layer in Example 1 was reversed in this Example.)

A surface-protecting layer was formed on the charge-generating layer as in Example 1 to produce a photoreceptor of Example 30 except that the structural materials used to produce the coating solution of the surface-protecting layer in the photoreceptor of Example 1 were changed as follows.

| Structural materials | |
|---|---|
| Example Compound (III-24) | 2 parts |
| methyltrimethoxysilane | 1.4 parts |
| tetramethoxysilane | 0.6 part |

This photoreceptor of Example 30 was mounted on remodeled Laser Press 4160II. This machine is adapted to supply a BCR power source, a power source of a developing unit and a transfer power source from an external power source. The test was conducted as in Example 1 that a voltage supplied to BCR was changed to a DC voltage of +500 V superposed with an AC voltage (1 kHz/1 mA) and polarities of a developing system (containing a toner) and a transfer system were changed according to the voltage changed. The results are shown in Table 69.

TABLE 69

| Example | Initial image qualities | After printing 50,000 sheets of paper | Abrasion loss [μm] |
|---|---|---|---|
| Example 30 | Good | good | 2.5 |

Table 69 reveals that the same good initial characteristics and printing resistance are exhibited even with the positive charge.

Example 31

A base photoreceptor 1 was produced as in Example 1.

A surface-protecting layer was formed thereon as in Example 30 to form a photoreceptor of Example 31.

This photoreceptor of Example 31 was mounted on remodeled Laser Press 4160II. When a DC voltage of −500 V was supplied as a BCR charge voltage, it was found that the resolution and the gradation were good and uniform charging was possible.

The same experiment was conducted using the photoreceptor of Comparative Example 1. As a result, the image density distribution was great, and good conditions could not be obtained even by changing the intensity of the applied voltage. Consequently, the cured film of the invention is available as the surface layer of the photoreceptor which can also be applied to a BCR charge system of only a DC voltage.

Further, a test for a printing resistance was conducted as in Example 1 to obtain good results as shown in Table 70.

TABLE 70

| Example | Initial image qualities | After printing 50,000 sheets of paper | Abrasion loss [μm] |
|---|---|---|---|
| Example 31 | Good | good | 1.5 |

Example 32

The surface-protecting layer used in Example 30 was directly coated on an aluminum pipe subjected to horning treatment to form an undercoat layer.

A charge-generating layer and a charge transfer layer were formed thereon in this order as in Example 1 to give a photoreceptor of Example 32.

Example 33

The surface-protecting layer used in Example 1 was formed on the photoreceptor of Example 32 to give a photoreceptor of Example 33.

Example 34

An undercoat layer and a charge-generating layer were formed on an aluminum pipe subjected to horning treatment as in Example 32. A charge transfer layer having the same structure as in Example 27 was formed thereon. Further, a surface-protecting layer having the same structure as in Example 1 was formed thereon to give a photoreceptor of Example 34.

The photoreceptors of Examples 32 to 34 and Comparative Example 1 were subjected to an acceleration test of a continuous charge exposure at a high temperature and high humidity. The photoreceptor was rotated at 120 rpm. During one cycle, it was charged with a surface voltage of −450 V through scorotron, exposed to light with LED of 600 nm, and decayed to −100 V. This cycle was conducted 100,000 times. The test was conducted at 28° C. and 85% RH.

This stressed photoreceptor was mounted on Laser Press 4160II, and the image was evaluated. In the photoreceptors of Examples 32 to 34, no defective image was provided, and the resolution and the gradation were also good. However, in the photoreceptor of Comparative Example 1, occurrence of black spots was identified.

The cured film formed by the invention is considered to exhibit the excellent electrical durability because the charge transferability is excellent and the charge is therefore less accumulated even when the film is used as the undercoat layer.

Example 35

The same surface-protecting layer as that used in Example 1 was formed on an aluminum pipe subjected to horning treatment to provide an undercoat layer. The same charge transfer layer and charge-generating layer as those used in Example 1 were laminated thereon in this order. Further, a surface-protecting layer was formed as in Example 30 to give a photoreceptor of Example 35.

The photoreceptor of Example 35 was mounted on remodeled Laser Press 4160II. A DC voltage of +500 V superposed with an AC voltage (800 Hz/1 mA) was supplied to BCR from an external power source, and a test for a printing resistance was conducted. A developing system and a transfer system were changed to adapt to a BCR charge. The results are shown in Table 71.

TABLE 71

| Example | Initial image qualities | After printing 50,000 sheets of paper | Abrasion loss [μm] |
|---|---|---|---|
| Example 35 | Good | good | 2.5 |

Table 71 reveals that the cured film formed by the invention can also be used as the undercoat layer and the surface-protecting layer of the positively charged photoreceptor which are laminated in reverse order.

Example 36

An undercoat layer and a charge-generating layer were formed on an aluminum pipe subjected to horning treatment as in Example 1.

The following structural materials were dissolved in 3.5 parts of isopropyl alcohol, 2 parts of tetrahydrofuran and 0.3 part of distilled water, and 0.5 part of activated clay was added. The hydrolysis was conducted at room temperature for 24 hours through stirring.

| Structural materials | |
|---|---|
| Example Compound (II-261) | 2 parts |
| methyltrimethoxysilane | 2 parts |

To 2 parts of a solution obtained by separating activated clay from the hydrolyzate through filtration was added 0.04 part of aluminum triacetylacetonate to give a coating solution 1. This coating solution 1 was coated on the charge transfer layer by a ring dip coating method, air-dried at room temperature for 30 minutes, and cured by heat treatment at 120° C. for 1 hour to form a charge transfer layer having a film thickness of approximately 8 μm. This was designated a photoreceptor of Example 36.

Example 37

A photoreceptor of Example 37 was produced in exactly the same manner as in Example 36 except that only a charge-generating layer was formed as in Example 25.

The photoreceptors of Examples 36 and 37 were subjected to a test for a printing resistance with 10,000 sheets of paper using Laser Press 4160II. The results are shown in Table 72.

TABLE 72

| Photoreceptor | Initial image qualities | After printing 50,000 sheets of paper | Abrasion loss [μm] |
|---|---|---|---|
| Example 36 | good | good | 0.5 |
| Example 37 | good | good | 0.5 |

Table 72 reveals that the good results are obtained.

Example 38

An undercoat layer was formed on an aluminum pipe subjected to horning treatment as in Example 1.

One part of chlorogallium phthalocyanine having intense diffraction peaks at Bragg angles (2θ±0.2°) of 7.4°, 16.6°, 25.5° and 28.3° in the X-ray diffraction spectrum and 4 parts of the high-molecular compound (viscosity average molecular weight 39,000) represented by the basic unit 1 were mixed with 20 parts of chlorobenzene, and these were dispersed through a paint shaker along with glass beads for 1 hour. Then, the resulting coating solution was dip-coated on the aluminum substrate subjected to horning treatment and having an outer diameter of 30 mm to form a photoreceptive layer having a film thickness of 15 μm.

The same surface-protecting layer as that used in the photoreceptor of Example 30 was formed thereon to give a photoreceptor of Example 38.

Example 39

The same surface-protecting layer as that used in Example 1 was formed on an aluminum substrate subjected to horning treatment and having an outer diameter of 30 mm to provide an undercoat layer, A photoreceptive layer having the same structure as in Example 38 was formed thereon to give a photoreceptor of Example 39.

Example 40

An undercoat layer was formed on an aluminum pipe subjected to horning treatment as in Example 1.

One part of chlorogallium phthalocyanine having intense diffraction peaks at Bragg angles (2θ±0.2°) of 7.4°, 16.6°, 25.5° and 28.3° in the X-ray diffraction spectrum and 4 parts of polyvinyl butyral (Esleck BM-S, Sekisui Chemical) were mixed with 20 parts of n-butyl acetate, and these were dispersed through a paint shaker along with glass beads for 1 hour to form a coating solution A.

The following structural materials were dissolved in 3.5 parts of isopropyl alcohol, 2 parts of tetrahydrofuran and 0.3 part of distilled water, and 0.5 part of an ion exchange resin (Amberlist 15E) was added thereto. The hydrolysis was conducted at room temperature for 24 hours through stirring.

| Structural materials | |
|---|---|
| Example Compound (II-261) | 2 parts |
| methyltrimethoxysilane | 1.4 parts |

To 2 parts of a solution obtained by separating the ion exchange resin from the hydrolyzate through filtration was added 0.04 part of aluminum trisacetylacetonate to form a coating solution B.

The mixed solution of 1 part of the coating solution A and 2 parts of the coating solution B was ring-coated on the undercoat layer, air-dried at room temperature for 30 minutes, and cured by heat treatment at 120° C. for 1 hour to give a photoreceptive layer having a film thickness of 12 μm. This was designated a photoreceptor of Example 40.

The photoreceptors of Examples 38 to 40 were subjected to a test for a printing resistance with 10,000 sheets of paper using remodeled Laser Press 4160II. The good results were obtained as shown in Table 73. Incidentally, as in the evaluation of the photoreceptor of Example 30, a DC voltage of +500 V superposed with an AC voltage (800 Hz/1 mA) was supplied from an external powder source as a charge voltage to BCR, and a developing system and a transfer system were changed. The results are shown in Table 73.

TABLE 73

| Photoreceptor | Initial image qualities | After printing 10,000 sheets of paper | Abrasion loss [μm] |
|---|---|---|---|
| Example 38 | good | good | 0.5 |
| Example 39 | good | good | 0.5 |
| Example 40 | good | good | 1.2 |

Example 41

An undercoat layer, a charge-generating layer, a charge transport layer and a surface-protecting layer were formed in this order on an aluminum pipe subjected to horning treatment and having an outer diameter of 84 mm as in Example 1. This was designated a photoreceptor of Example 41.

The photoreceptor of Example 41 was mounted on A color 936 manufactured by Fuji Xerox, and copy and print image evaluation was conducted. Consequently, the full color image reproducibility and the 400-line pattern resolution were both good. After the color printing of 5,000 sheets of paper, the same image qualities as at the initial stage were still maintained. The photoreceptor was withdrawn, and the surface thereof was observed. Consequently, a striped pattern or a flaw found in the absence of the surface-protecting layer was not observed, nor did peeling of the surface-protecting layer occur.

Example 42

An undercoat layer, a charge-generating layer and a charge transport layer were formed in this order on an aluminum pipe subjected to horning treatment and having an outer diameter of 84 mm as in Example 1.

Two parts of Example Compound 261 were dissolved in 5 parts of isopropyl alcohol, 3 parts of tetrahydrofuran and 0.3 part of distilled water, and 0.5 part of an ion exchange resin (Amberlist 15E) was added thereto. The hydrolysis was conducted at room temperature for 24 hours through stirring, and the ion exchange resin was separated through filtration. To this was added 2 parts of a polymer made of methacryloxypropyltrimethoxysilane, butyl acrylate and methyl methacrylate and having a molecular weight of approximately 130,000, and these were dissolved. Aluminum triacetylacetonate was added in an amount of 0.04 part to prepare a coating solution. This coating solution was coated on the charge transport layer by a ring dip coating method, air-dried at room temperature for 30 minutes, and cured by heat treatment at 120° C. for 1 hour to form a surface-protecting layer having a film thickness of approximately 3 μm. This was designated a photoreceptor of Example 42.

The photoreceptor of Example 42 was mounted on A color 936 manufactured by Fuji Xerox, and copy and print image evaluation was conducted. Consequently, the full color image reproducibility and the 400-line pattern resolution were both good. After the color printing of 5,000 sheets of paper, the same image qualities as at the initial stage were still maintained. The photoreceptor was withdrawn, and the surface thereof was observed. Consequently, a striped pattern or a flaw found in the absence of the surface-protecting layer was not observed, nor did peeling of the surface-protecting layer occur.

Thus, the invention can provide the process for producing the electrophotographic photoreceptor in which the electrophotographic photoreceptor having excellent mechanical strengths and a long life can stably be obtained on an industrial scale over a long period of time by using the stable coating solution having the long pot life, the electrophotographic photoreceptor excellent in stability and mechanical strengths and having the long life, and the image-forming apparatus having the excellent stability and the long life.

What is claimed is:

1. A process for producing an electrophotographic photoreceptor, which comprises contacting a solution containing at least one of optically functional organosilicon compounds with a solid catalyst for reaction, then separating the solid catalyst to form an optically functional coating solution, and coating and curing the optically functional coating solution to form a cured film, the at least one optically functional organosilicon compounds is represented by formula (I)

$$F—[D—A]_b \quad (I)$$

wherein

F represents an organic group derived from optically functional compounds,

D represents a flexible subunit,

A represents a substituted silicon group having a hydrolyzable group represented by $—Si(R_1)_{(3-a)}Q_a$ in which $R_1$ represents hydrogen, an alkyl group or a substituted or unsubstituted aryl group, Q represents a hydrolyzable group, and a represents an integer of 1 to 3, and b represents an integer of 1 to 4.

2. The process for producing the electrophotographic photoreceptor as claimed in claim 1, wherein the organic group F is a hole-transportable group or an electron-transportable group.

3. The process for producing the electrophotographic photoreceptor as claimed in claim 2, wherein the organic group F is a group represented by formula (II), (III-1) or (III-2)

(II)

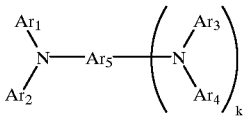

wherein $Ar^1$ to $Ar^4$, independently from each other, represent a substituted or unsubstituted aryl group, $Ar^5$ represents a substituted or unsubstituted aryl or arylene group, provided at least one to four of $Ar^1$ to $A^5$ have a binding site capable of being bound to a bonding group represented by —D—A in formula (I), and k represents 0 or 1

(III-1)

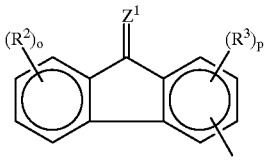

-continued (III-2)

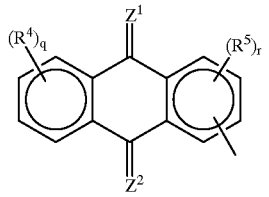

wherein $R^2$ to $R^5$, independently from each other, represent hydrogen, a halogen, a nitro group or a cyano group, $Z^1$ and $Z^2$, independently from each other, represent =O, $=C(CN)_2$, $=C(CO_2R^a)$, =N—CN or $=N—Ar^a$ in which $R^a$ represents an alkyl group having 1 to 10 carbon atoms or a substituted or unsubstituted aryl group having 1 to 10 carbon atoms, and $Ar^a$ represents a substituted or unsubstituted aryl group, and o to r, independently from each other, represent 0, 1 or 2.

4. The process for producing the electrophotographic photoreceptor as claimed in any of claims 1, wherein at least one of compounds having a group capable of being bound to the optically functional organosilicon compounds is added to the optically functional coating solution before being contacted with the solid catalyst.

5. The process for producing the electrophotographic photoreceptor as claimed in claim 1, wherein at least one of compounds having a group capable of being bound to the optically functional organosilicon compounds represented by formula (I) is added to the optically functional coating solution after separating the solid catalyst.

6. The process for producing the electrophotographic photoreceptor as claimed in any of claim 1, wherein at least one curing catalyst is added to the optically functional coating solution.

7. An electrophotographic photoreceptor having at least one layer of the cured film formed by the process as claimed in claim 1.

8. The electrophotographic photoreceptor as claimed in claim 7, wherein the layer is the uppermost surface layer.

9. An image-forming apparatus comprising at least an electrophotographic photoreceptor and a charging unit, the electrophotographic photoreceptor being the electrophotographic photoreceptor as claimed in claim 7.

10. The image-forming apparatus as claimed in claim 9, wherein the charging unit is a contact type charging system.

* * * * *